US007673868B2

(12) United States Patent
Nakamura et al.

(10) Patent No.: US 7,673,868 B2
(45) Date of Patent: Mar. 9, 2010

(54) SHEET PROCESSING SYSTEM

(75) Inventors: Tomokazu Nakamura, Chiba (JP); Akihiro Sato, Kanagawa (JP); Akihiro Shimizu, Chiba (JP); Tatsuya Goto, Chiba (JP); Katsuaki Hirai, Ibaraki (JP); Hideki Kushida, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 93 days.

(21) Appl. No.: 12/027,400

(22) Filed: Feb. 7, 2008

(65) Prior Publication Data

US 2009/0066997 A1 Mar. 12, 2009

Related U.S. Application Data

(62) Division of application No. 10/963,821, filed on Oct. 14, 2004, now Pat. No. 7,380,779.

(30) Foreign Application Priority Data

Oct. 16, 2003 (JP) ..... 2003-356733
Oct. 16, 2003 (JP) ..... 2003-356734

(51) Int. Cl.
*B65H 37/04* (2006.01)

(52) U.S. Cl. ..... 270/58.25; 270/58.07; 270/58.08; 270/58.18; 270/58.14; 399/83

(58) Field of Classification Search ..... 270/58.01, 270/58.07, 58.08, 58.14, 58.18, 58.25; 271/288, 271/289, 290; 399/83, 407
See application file for complete search history.

(56) References Cited

U.S. PATENT DOCUMENTS

| | | | | |
|---|---|---|---|---|
| 5,100,119 | A * | 3/1992 | Komada et al. | 270/58.14 |
| 5,248,136 | A | 9/1993 | Hamanaka | 270/58.14 |
| 5,465,949 | A | 11/1995 | Yamada et al. | 271/110 |
| 5,573,233 | A | 11/1996 | Hirai et al. | 270/58.08 |
| 5,671,917 | A | 9/1997 | Choho et al. | 271/111 |
| 5,697,040 | A | 12/1997 | Rabjohns et al. | 399/382 |
| 5,752,694 | A | 5/1998 | Yamashita et al. | 270/58.12 |
| 5,897,250 | A | 4/1999 | Hirai et al. | 399/404 |
| 6,003,853 | A | 12/1999 | Nakazawa et al. | 270/58.11 |
| 6,027,107 | A * | 2/2000 | Natsume et al. | 270/37 |
| 6,029,026 | A * | 2/2000 | Natsume et al. | 399/82 |
| 6,120,015 | A * | 9/2000 | Albright et al. | 270/58.07 |
| 6,264,194 | B1 | 7/2001 | Hayashi et al. | 271/220 |
| 6,283,470 | B1 | 9/2001 | Hirai | 271/189 |
| 6,347,203 | B1 * | 2/2002 | Kutsuwada | 399/82 |
| 6,381,443 | B1 * | 4/2002 | Kawata et al. | 399/407 |
| 6,474,633 | B1 | 11/2002 | Hirai | 270/58.09 |

(Continued)

FOREIGN PATENT DOCUMENTS

JP 7-214936 8/1995

(Continued)

*Primary Examiner*—Gene Crawford
*Assistant Examiner*—Leslie A Nicholson, III
(74) *Attorney, Agent, or Firm*—Fitzpatrick, Cella, Harper & Scinto

(57) ABSTRACT

A sheet processing system comprises a plurality of sheet processing devices, a primary sheet conveyance path, a secondary sheet conveyance path, and a controller which controls the sheet processing devices. The controller uses the primary sheet conveyance path to execute one job, and uses the secondary sheet conveyance path to execute another job in parallel with that one job.

6 Claims, 32 Drawing Sheets

U.S. PATENT DOCUMENTS

| | | | | |
|---|---|---|---|---|
| 6,616,135 | B1 | 9/2003 | Shida et al. | 270/58.08 |
| 6,647,243 | B2 | 11/2003 | Sato et al. | 399/407 |
| 6,793,216 | B2 | 9/2004 | Nakamura | 271/188 |
| 6,804,473 | B2 | 10/2004 | Nakamura et al. | 399/16 |
| 6,823,154 | B2 * | 11/2004 | Koga et al. | 399/110 |
| 6,908,078 | B2 * | 6/2005 | Suzuki et al. | 270/15 |
| 6,947,684 | B2 | 9/2005 | Fujii et al. | 399/90 |
| 6,975,815 | B2 * | 12/2005 | Kato et al. | 399/9 |
| 7,080,830 | B2 | 7/2006 | Suzuki et al. | 270/58.08 |
| 7,380,779 | B2 * | 6/2008 | Nakamura et al. | 270/58.25 |
| 2003/0156872 | A1 | 8/2003 | Hirai | 399/407 |
| 2003/0168796 | A1 | 9/2003 | Suzuki et al. | 270/58.07 |

FOREIGN PATENT DOCUMENTS

| | | |
|---|---|---|
| JP | 7-228415 | 8/1995 |
| JP | 7-309517 | 11/1995 |
| JP | 11-255414 | 9/1999 |
| JP | 2001-75434 | 3/2001 |
| JP | 2001-156969 | 6/2001 |
| JP | 2002-370469 | 12/2002 |
| JP | 2003-89473 | 3/2003 |

* cited by examiner

SHEET PROCESSING SYSTEM

This application is a divisional of U.S. patent application Ser. No. 10/963,821, filed Oct. 14, 2004 now U.S. Pat. No. 7,380,779.

BACKGROUND OF THE INVENTION

1. Field of the Invention

The present invention relates to a sheet processing system which is enabled to execute a plurality of jobs in parallel by combining a plurality of sheet processing devices arbitrarily.

2. Description of the Related Art

In the related art, there has been provided a sheet processing system, in which a sheet stacker, an inserter, a finisher and so on are connected in series with an image forming apparatus such as a copying machine so that it can process the sheets from a printing process or an image forming process to a bookbinding process including special sheet inserting, folding and stapling operations.

A sheet processing system of this kind according to the related art is shown in FIG. 32.

In JP-A-2003-89473, there is disclosed an image forming system, in which a plurality of sheet post-processing devices are connected to an image forming apparatus. FIG. 32 is a schematic sectional view showing one example of the image forming system of the related art schematically. An image forming system B, as shown in FIG. 32, is provided with a document feeder 1100, an image forming apparatus 1000 having an image reader 1200 and a printer 1300, a buffer module 1400, a folder 1500 and a finisher 1600.

In this image forming system B, however, the folder 1500 or the finisher 1600 cannot be used while the sheets are being conveyed for a job from the printer 1300 to the buffer module 1400. The execution of another job has to await the end of the aforementioned job. This lowers the working efficiency of the entire system seriously.

SUMMARY OF THE INVENTION

The present invention contemplates to solve the aforementioned problems of the sheet processing system of the related art, and has an object to provide a sheet processing system having a high productivity.

In order to achieve this object, the invention adopts the following constructions.

According to a first aspect of the invention, there is provided a sheet processing system comprising: a plurality of sheet processing devices having sheet processing functions; a primary sheet conveyance path which conveys sheets outputted from one of the plural sheet processing devices, to another sheet processing device; a secondary sheet conveyance path which is disposed independently of the primary sheet conveyance path and conveys the sheets between the plural sheet processing devices; and a controller which controls the plural sheet processing devices. The controller uses the primary sheet conveyance path to execute one job of sheet processing and uses the secondary sheet conveyance path to execute another job of sheet processing in parallel with the one job.

According to a second aspect of the invention, there is provided a sheet processing system comprising: a plurality of sheet output devices which output sheets; a plurality of sheet post-processing devices which subject the sheets outputted from the sheet output devices, to a post-processing; and a controller which controls the plural sheet output devices and the plural sheet post-processing devices. The controller is enabled to execute jobs by combining either the sheet output device and the sheet output device or the sheet output device and the sheet post-processing device, and executes a plurality of jobs in parallel by sharing at least one of the plural sheet output devices and the plural sheet post-processing devices.

DESCRIPTION OF THE PREFERRED EMBODIMENTS

The preferred embodiments of the invention will be illustratively described in detail with reference to the accompanying drawings. However, the sizes, materials, shapes and relative arrangements of components described in the embodiments are not intended to limit the scope of the invention to them unless otherwise specifically described.

First Embodiment

Figure 1:
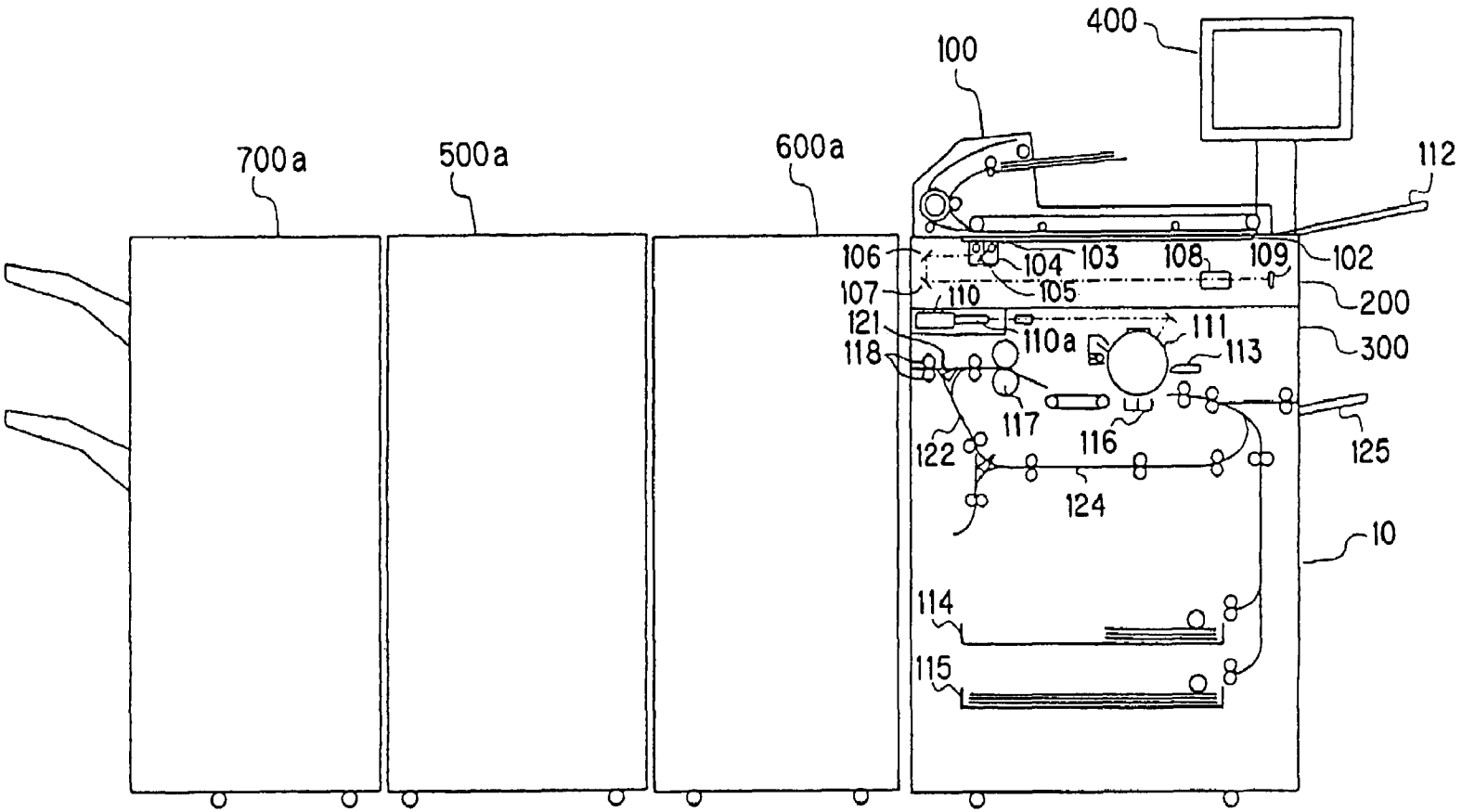
FIG. 1 is a schematic construction diagram showing a construction of a sheet processing system.

FIG. 1 is a schematic construction diagram showing an internal construction of a sheet processing system according to a first embodiment of the invention.

The sheet processing system is provided with a plurality of sheet processing devices having different sheet processing functions. In this embodiment, four sheet processing devices of an image forming device 10 (or a printer 300), an inserter 600*a*, a sheet stacker 500*a* and a finisher 700*a* are sequentially connected in tandem.

<Image Forming Device 10>

The image forming device 10 reads a document and outputs an image-formed sheet. The image forming device 10 is provided with the printer 300, an image reader 200 mounted over the printer 300, a document feeder 100 mounted freely openably on the image reader 200, and an operation display device 400 disposed over the image reader 200.

The document feeder 100 separates a plurality of documents set upward on a document tray, one by one from the leading page, conveys the separated document through a curved path to the document image reading position of the image reader 200, and causes the image reader 200 to read through the document. After this, the document is discharged to a discharge tray 112, which is disposed at the righthand end of the document feeder 100.

The image reader 200 reads the document and is equipped therefor with a platen glass 102 on the upper surface. Below this platen glass 102, there is disposed a scanner unit 104 for reading the image of the document which is conveyed from the document feeder 100 to the document image reading position on the platen glass 102.

When the document is read through, the document is irradiated at its read face, each time the document passes through the document image reading position on the platen glass 102, with a lamp 103 which is mounted in the scanner unit 104. The light reflected from the document is guided into an image sensor 109 via lens 108 by both a mirror 105 disposed in the scanner unit 104 and mirrors 106 and 107 disposed in the image reader 200. That light is transformed into electric signals by the image sensor 109. Specifically, the document is read in its entirety by repeating the operations, in which the image sensor 109 reads the document image of one line in the primary scanning direction (in the direction perpendicular to the conveyance direction of the document), while conveying the document in the secondary scanning direction.

The image data outputted from the image sensor 109 are subjected to a predetermined image processing and are then inputted as video signals to the printer 300.

The printer 300 is a device for forming an image on a sheet on the basis of the image data of the document read by the image reader 200. The printer 300 is equipped with an exposure control unit 110, a polygon mirror 110*a*, a photosensitive drum 111, a developer 113, a transfer unit 116, a fixer 117, cassettes 114 and 115, a manual sheet feeder 125, an inverse path 122, a double-sided conveyance path 124, a flapper 121 and a discharge roller pair 118. The exposure control unit 110 modulates and outputs a laser beam on the basis of the video signals produced from the image data. When the polygon mirror 110*a* is scanned with the laser beam, an electrostatic latent image is formed on the photosensitive drum 111. The electrostatic latent image is developed by the developer 113 so that a developer image is formed on the photosensitive drum 111. On the other hand, the sheet is fed from either the cassettes 114 and 115 or the manual feeder 125 acting as the sheet feeder to the transfer unit 116 arranged below the photosensitive drum 111. In the transfer unit 116, the developer image formed on the photosensitive drum 111 is transferred to the sheet. The developer image is fixed in the fixer 117. The sheet having passed the fixer 117 is discharged to the outside of the printer 300 by the discharge roller pair 118.

Figure 2:
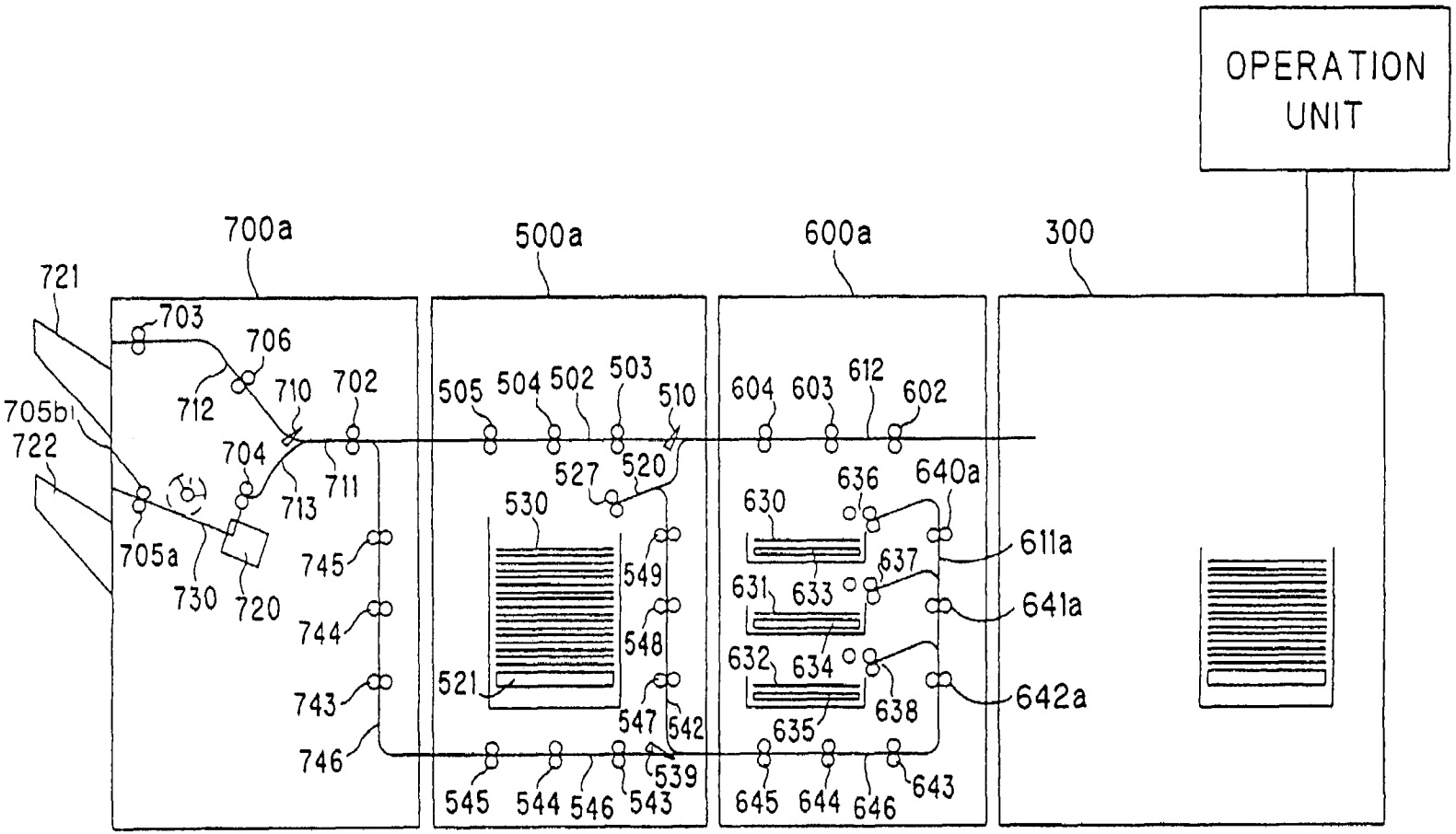
FIG. 2 is a schematic construction diagram showing an internal construction of a sheet processing system according to a first embodiment.

FIG. 2 is a schematic construction diagram showing the internal constructions of the inserter 600*a*, the sheet stacker 500*a* and the finisher 700*a* of the sheet processing system according to the first embodiment.

<Inserter 600*a*>

The inserter 600*a* inserts a special sheet (e.g., color copy paper) such as a cover or a tab into the head page or an intermediate page of the sheets outputted from the printer 300. The inserter 600*a* itself does not form any image on the sheets. The inserter 600*a* is equipped, as shown in FIG. 2, with: a horizontal conveyance path 612 acting as a primary sheet conveyance path for guiding the sheets discharged from the printer 300, into the sheet stacker 500*a* or the finisher 700*a*; conveyance roller pairs 602, 603 and 604 disposed on the horizontal conveyance path 612; sheet storages 630, 631 and 632 for storing special sheets such as covers or tabs; a second horizontal conveyance path 646 acting as a secondary sheet conveyance path for conveying the special sheets stored in the sheet storages 630, 631 and 632, to the adjoining sheet processing system (or the sheet stacker 500*a*); conveyance roller pairs 643, 644 and 645 disposed on the second horizontal conveyance path 646; sheet separators 636, 637 and 638 for feeding the special sheets stored in the sheet storages 630, 631 and 632; a vertical conveyance path 611*a* for guiding the special sheets fed from the sheet storages 630, 631 and 632, to the second horizontal conveyance path 646; and conveyance roller pairs 640*a*, 641*a* and 642*a* disposed on the vertical conveyance path 611*a*.

In the inserter 600*a* thus constructed, the separately printed special sheets are stored in the sheet storages 630, 631 and 632. At a predetermined timing, the inserter 600*a* properly inserts the special sheets such as the covers or tabs fed from the sheet storages 630, 631 and 632, into the sheets outputted from the printer 300.

<Sheet Stacker 500*a*>

The sheet stacker 500*a* is a buffer device for temporarily storing the sheets outputted from another sheet output device (e.g., the printer 300 or the inserter 600*a*) and for subsequently outputting them again. The sheet stacker 500*a* is equipped, as shown in FIG. 2, with: a horizontal conveyance path 502 acting as a primary sheet conveyance path for introducing the sheets discharged from the printer 300 or the inserter 600*a*, into the finisher 700*a*; conveyance roller pairs 503, 504 and 505 disposed on the horizontal conveyance path 502 for conveying the sheets; a flapper 510 disposed on the entrance side of the horizontal conveyance path 502 (i.e., on the side of the inserter 600*a*); a sheet stacking unit 530 capable of storing the sheets outputted from the printer 300 or the inserter 600*a*; and a path 520 for introducing the sheets outputted from the printer 300 or the inserter 600*a* into the sheet stacking unit 530. The sheet stacker 500*a* of this embodiment is further equipped with: a vertical conveyance path 542 for conveying the sheets outputted from the second horizontal conveyance path 646 of the inserter 600*a*, to the sheet stacking unit 530; conveyance roller pairs 547, 548 and 549 disposed on the vertical conveyance path 542; a second horizontal conveyance path (or a secondary sheet conveyance path) 546 for conveying the sheets outputted from the second horizontal conveyance path 646 of the inserter 600*a*, to the adjoining finisher 700*a*; conveyance roller pairs 543, 544 and 545 disposed on the second horizontal conveyance path 546; and a path selecting flapper 539 disposed on the entrance side of the second horizontal conveyance path 546 and the vertical conveyance path 542 for guiding the sheets selectively into the sheet stacking unit 530 or the finisher 700*a*.

In case the sheet stacker 500*a* performs the sheet stacking operation, the flapper 510 is switched to the position, in which it blocks the introduction of the sheets into the horizontal conveyance path 502. As a result, the sheets discharged from the printer 300 are guided to the path 520. The sheets thus guided to the path 520 are sequentially stacked in the sheet stacking unit 530.

In case the sheets are not stacked in the sheet stacking unit 530, on the other hand, the flapper 510 is switched to the position, in which it blocks the introduction of the sheets to the path 520. As a result, the sheets discharged from the printer 300 are conveyed through the horizontal conveyance path 502 to the finisher 700*a*.

In case the sheet stacker 500*a* stacks the sheets outputted from the second horizontal conveyance path 646 of the inserter 600*a*, moreover, the path selecting flapper 539 is switched to the position, in which it blocks the introduction of the sheets into the second horizontal conveyance path 546. As a result, the sheets outputted from the inserter 600*a* are guided into the vertical conveyance path 542. The sheets thus introduced into the vertical conveyance path 542 are sequentially stacked in the sheet stacking unit 530.

In case the stacking operation to stack the sheets outputted from the printer 300 in the sheet stacking unit 530 and the stacking operation of the sheets outputted from the inserter 600*a* in the sheet stacking unit 530 are executed in parallel, they employ the path 520 by turns or alternately. As a result, the two stacking operations can be executed in parallel.

In case the stacking operation to stack the sheets outputted from the inserter 600*a* is not performed, on the other hand, the path selecting flapper 539 is switched to the position, in which it obstructs the introduction of the sheets into the vertical conveyance path 542. As a result, the sheets outputted from the inserter 600*a* are conveyed to the finisher 700*a* through the second horizontal conveyance path 546 different from the horizontal conveyance path 502. It is preferable that the secondary sheet conveyance paths owned by the individual sheet processing devices are thus connected to convey the sheets to the downstream sheet processing devices. Therefore, it is arbitrary to combine the sheet processing devices which execute jobs in parallel.

Figure 3:
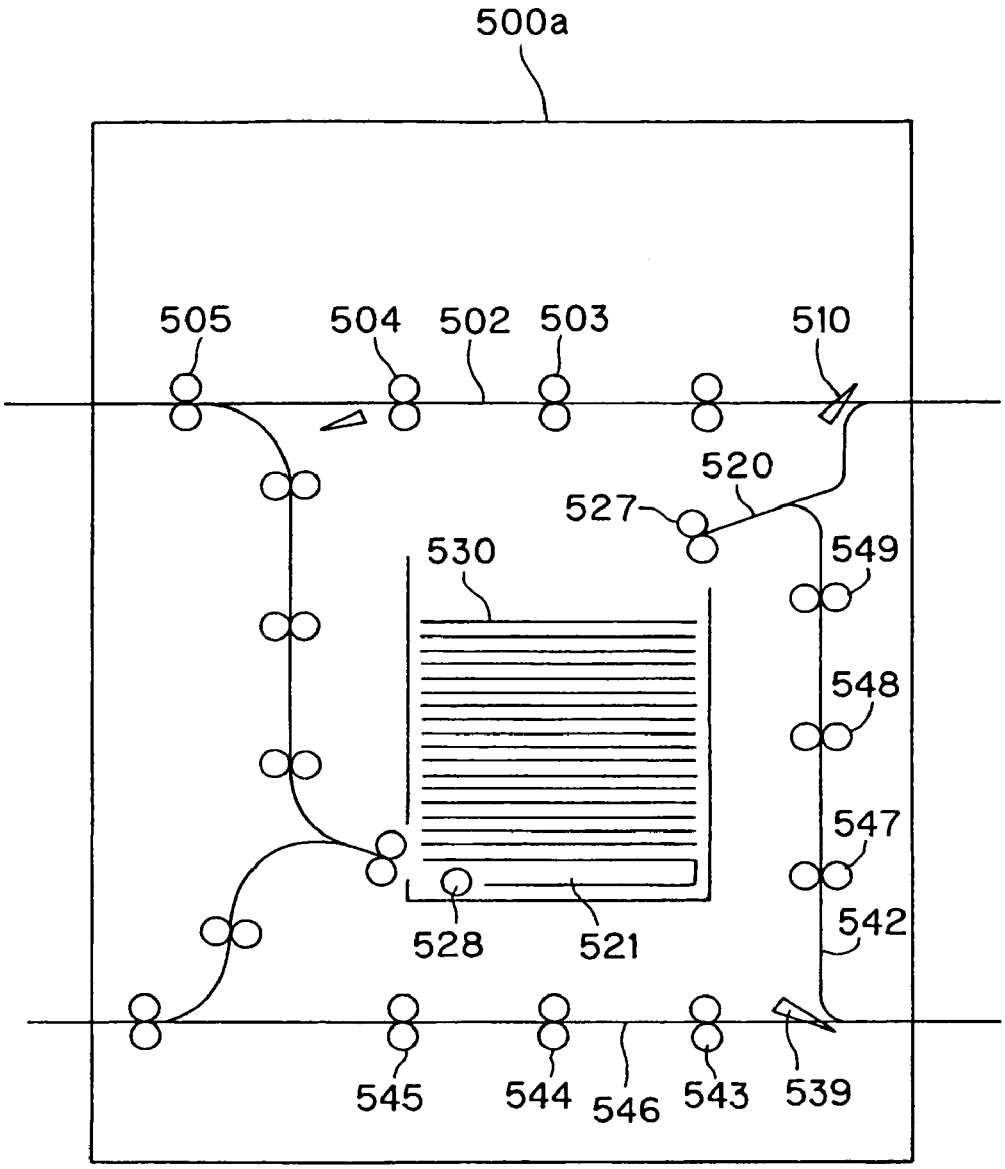
FIG. 3 is a diagram showing a modification of a sheet stacker.

Here, it is also preferable that the sheet stacker 500*a* is provided with re-feed means (or a re-feed roller) 528, as shown in FIG. 3. The sheets stacked in the sheet stacking unit 530 are returned again by the re-feed means 528 either to the horizontal conveyance path 502 acting as the primary sheet conveyance path or to the second horizontal conveyance path 546 acting as the secondary sheet conveyance path so that they are conveyed to the finisher 700*a*. In this case, it is possible to adjust/control the processing capacities between the printer 300, and the inserter 600*a* and the finisher 700*a*. On the other hand, the sheet stacker 500*a* may be provided with not the buffer function but only the sheet stacking function.

<Finisher 700*a*>

The finisher 700*a* performs a sorting operation, a stapling (binding) operation, a punching operation and so on. The finisher 700*a* is equipped, as shown in FIG. 2, with: a finisher path 711 and an entrance roller pair 702 for introducing the sheets outputted through the horizontal conveyance path 502 or the second horizontal conveyance path 546 from the sheet stacker 500*a*; a non-sort path 712 not for sorting but for conveying the sheets to a sample tray 721; a sort path 713 for conveying the sheet to a sorter; a switch flapper 710 for switching the non-sort path 712 and the sort path 713 selectively; an intermediate tray 730 for performing the sorting operation, the stapling operation and so on; a stapler 720 for stapling the sheets stacked and arranged on the intermediate tray 730; a stack tray 722, to which the sheets having been subjected to the sorting operation, the stapling operation and the like on the intermediate tray 730 are discharged; a vertical conveyance path 746 for introducing the sheets conveyed from the second horizontal conveyance path 546 of the sheet stacker 500*a*, to the entrance roller pair 702; and conveyance roller pairs 743, 744 and 745 disposed on the vertical conveyance path 746.

In the finisher 700*a* thus constructed, the switch flapper 710 is switched to the position, in which it obstructs the introduction of the sheets into the sort path 713, in case the sorting operation or the like is not performed. The sheets outputted from the sheet stacker 500*a* are guided into the non-sort path 712 and are discharged onto the sample tray 721 through a conveyance roller pair 706 and a non-sort discharge roller pair 703, which are disposed on the non-sort path 712.

In the case of performing the sorting operation and so on, on the other hand, the switch flapper 710 is switched to the position, in which it blocks the introduction of the sheets into the non-sort path 712. The sheets thus outputted from the sheet stacker 500*a* are guided into the sort path 713 and are stacked in a bundled shape on the intermediate tray 730 through a sort discharge roller 704. Moreover, the sheets stacked on the intermediate tray 730 are properly subjected to an arranging operation, the stapling operation, the punching operation or the like and are then discharged through a pair of discharge rollers 705*a*, 705*b* onto the stack tray 722. Here, the stack tray 722 is constructed to run properly by itself in the vertical directions.

<Armor Cover Construction>

Figure 4:
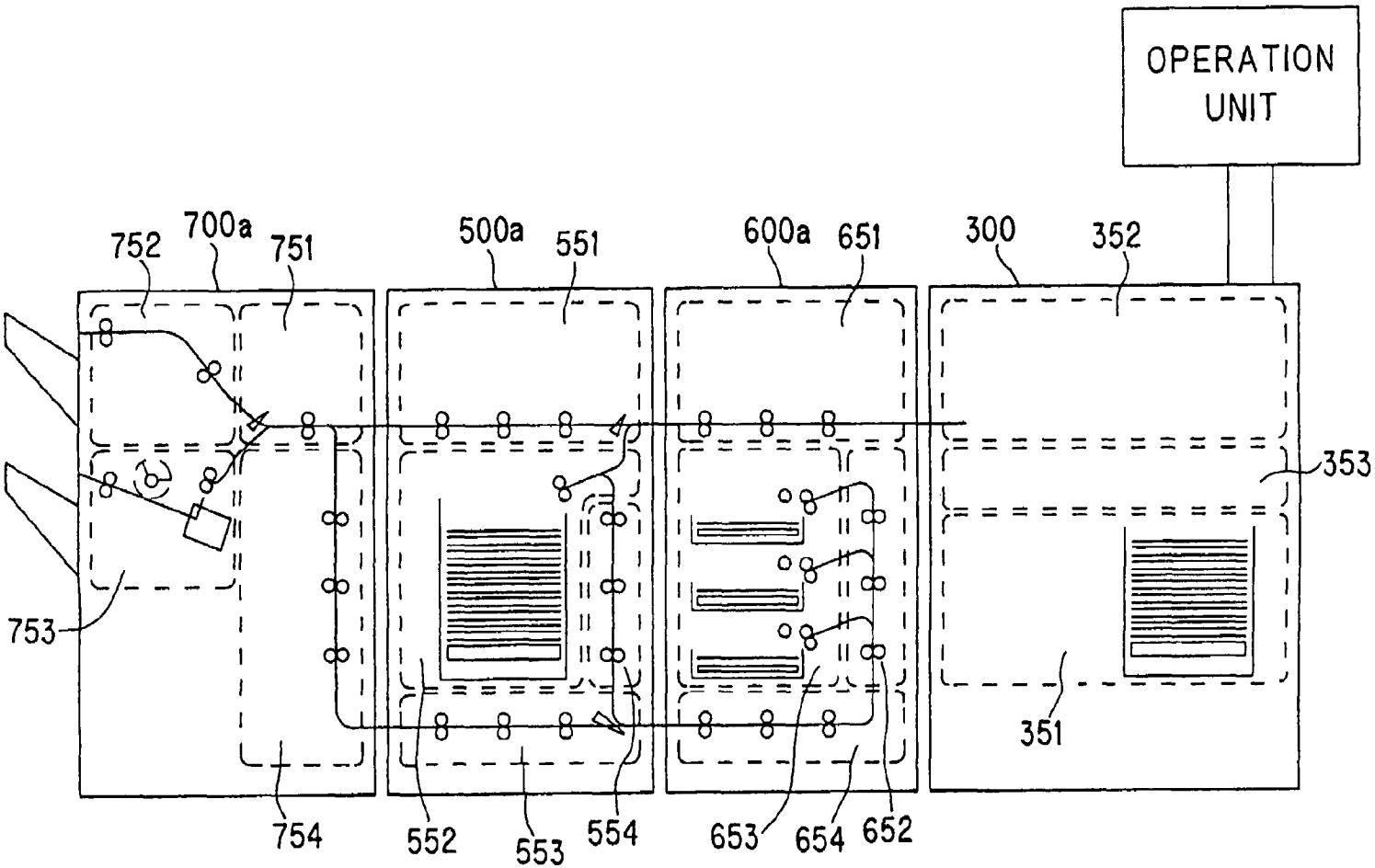
FIG. 4 is a schematic construction diagram showing a construction of cover members.

FIG. 4 is a schematic construction diagram showing the construction of the armor covers of the printer 300, the inserter 600*a*, the sheet stacker 500*a* and the finisher 700*a*.

The sheet processing system of this embodiment is provided with covers for opening the individual insides of the sheet processing devices (i.e., the printer 300, the inserter 600*a*, the sheet stacker 500*a* and the finisher 700*a*).

The sheet stacker 500*a* is equipped with: a cover 551 for covering the horizontal conveyance path 502; a cover 552 for covering the sheet stacking unit 530; a cover 553 for covering the second horizontal conveyance path 546; and a cover 554 for covering the vertical conveyance path 542. These covers 551, 552, 553 and 554 can be opened/closed independently of one another.

The opened/closed states of the covers 551 and 552 are detected by cover opening/closing detection sensors S54 and S55, respectively. Moreover, the opened/closed state of the cover 554 is detected by a cover opening/closing detection sensor S56, and the opened/closed state of the cover 553 is detected by a cover opening/closing detection sensor S57 (as referred to FIG. 6).

These covers 551, 552, 553 and 554 are opened/closed at the time of clearing the jam of the sheet stacker 500*a* or at the time of maintenances for parts-replacing, cleaning, adjusting or sheet extracting operation or the like.

The inserter 600*a* is equipped with: a cover 651 for covering the horizontal conveyance path 612; a cover 652 for covering the vertical conveyance path 611*a*; a cover 653 for covering the sheet stackers 630, 631 and 632 and the sheet separators 636, 637 and 638; and a cover 654 for covering the second horizontal conveyance path 646. These covers 651, 652, 653 and 654 can be opened/closed independently of one another. The opened/closed states of the covers 651, 652, 653 and 654 are detected by cover opening/closing detection sensors S64, S65, S66 and S67, respectively (as referred to FIG. 7).

These covers 651, 652, 653 and 654 are opened/closed at the jam clearing time or at the time of maintenances for parts-replacing, cleaning, adjusting or sheet supplying operation or the like.

The finisher 700*a* is equipped with: a cover 751 for covering the finisher path 711; a cover 752 for covering the non-sort path 712; a cover 753 for covering a stapling unit including the stapler 720; and a cover 754 for covering the vertical conveyance path 746. The covers 751, 752, 753 and 754 can be opened/closed independently of one another. The opened/closed states of the covers 751, 752, 753 and 754 are detected by cover opening/closing detection sensors S74, S75, S76 and S77, respectively (as referred to FIG. 8).

These covers 751, 752, 753 and 754 are opened/closed at the jam clearing time or at the time of maintenances for parts-replacing, cleaning, adjusting or sheet supplying operation or the like.

The printer 300 is equipped with: a cover 351 for covering a sheet supplier; a cover 352 for covering a conveyance path to guide the sheets individually to the photosensitive drum 111, the transfer unit 116, the fixer 117 and the flapper 121; and a cover 353 for covering the double-sided conveyance path 124. The covers 351, 352 and 353 can be opened/closed independently of one another. The opened/closed states of the covers 351, 352 and 353 are detected by cover opening/closing detection sensors (although not shown).

These covers 351, 352 and 353 are opened/closed at the jam clearing time or at the time of maintenances for parts-replacing, cleaning, adjusting or sheet supplying operation or the like.

<Construction of Controller>

Figure 5:
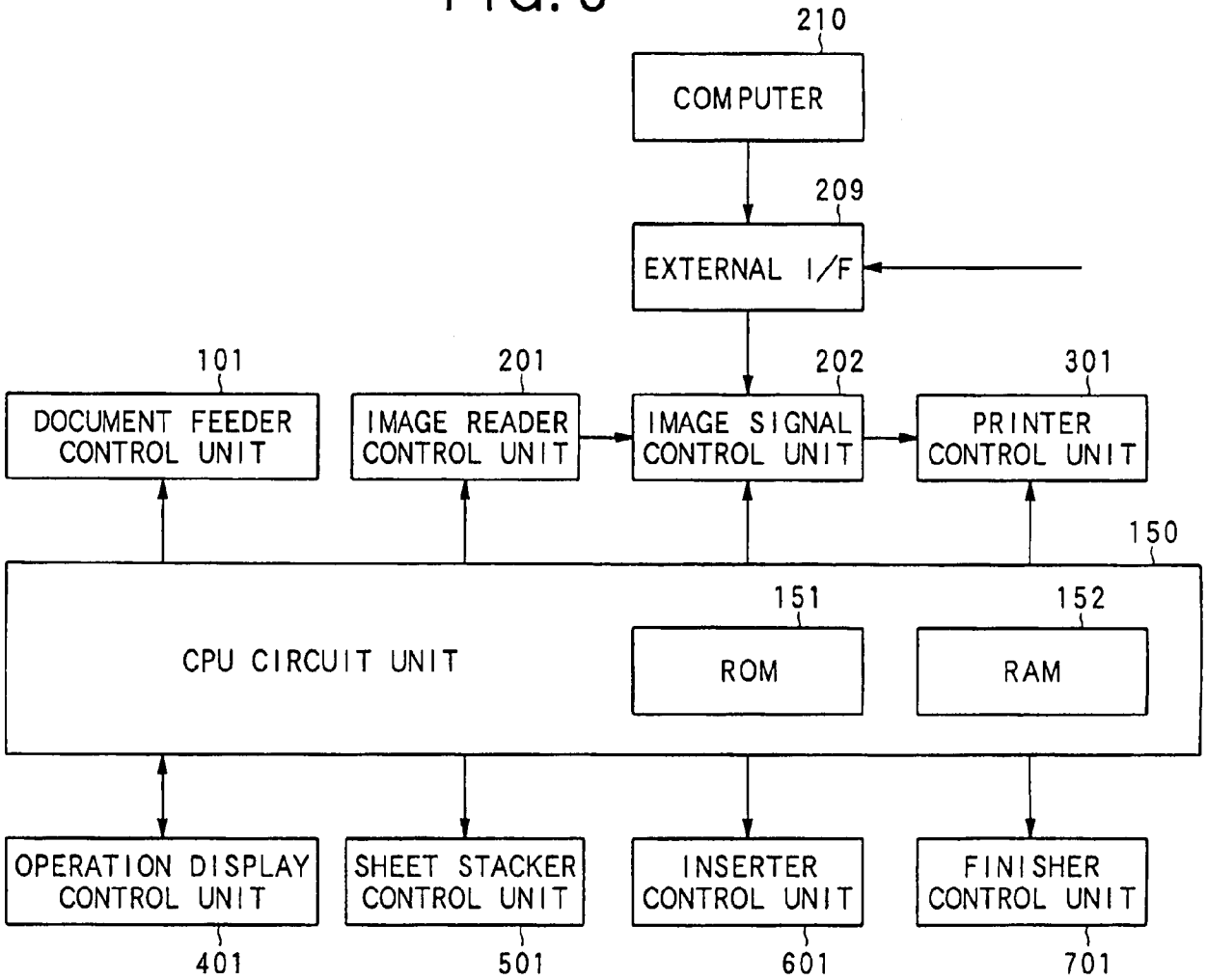
FIG. 5 is a block diagram showing an overall configuration of a controller for controlling the sheet processing system.

FIG. 5 is a block diagram showing an overall configuration of a controller for controlling the sheet processing system.

As shown in FIG. 5, the controller includes a CPU circuit unit 150. This CPU circuit unit 150 has a (not-shown) CPU, a ROM 151 and a RAM 152 packaged therein.

With control programs stored in the ROM 151, the CPU circuit unit 150 generally controls a document feeder control unit 101, an image reader control unit 201, an image signal control unit 202, an external interface 209, a printer control unit 301, an operation display control unit 401, a sheet stacker control unit 501, an inserter control unit 601 and a finisher control unit 701.

The RAM 152 packaged in the CPU circuit unit 150 is used either as a temporary storage area for temporarily holding control data to control the individual control units or as a working area for arithmetic operations following those controls.

The document feeder control unit 101 controls the drive of the document feeder 100 on the basis of an instruction coming from the CPU circuit unit 150.

The image reader control unit 201 controls the drive of the scanner unit 104, the image sensor 109 and so on, and transfers analog image signals outputted from the image sensor 109, to the image signal control unit 202.

On the basis of an instruction from the CPU circuit unit 150, the signal control unit 202 converts analog image signals transferred from the image sensor 109, into digital signals, and processes the digital signals in various manners to convert them into video signals thereby to output the video signals to the printer control unit 301. Moreover, the image signal control unit 202 processes digital image signals inputted from a computer 210 through the external I/F 209, in various manners to convert them into video signals thereby to output the video signals to the printer control unit 301. On the basis of the video signals inputted from the image signal control unit 202, the printer control unit 301 drives the exposure control unit 110.

The operation display control unit 401 exchanges information between the operation display device 400 disposed in the image forming device 10 and the CPU circuit unit 150. The operation display control unit 401 is equipped with: a plurality of keys for setting various functions for image formations; and a display for displaying information indicating the set states of the individual sheet processing devices. Key signals corresponding to the individual keys of the operation display device 400 are outputted to the CPU circuit unit 150 through the operation display control unit 401. Moreover, the operation display control unit 401 controls the operation display device 400 to display the corresponding information on the display of the operation display device 400 on the basis of the signals coming from the CPU circuit unit 150.

The sheet stacker control unit 501 is mounted on the sheet stacker 500*a*, and controls the drive of the sheet stacker 500*a* by exchanging the information with the CPU circuit unit 150.

The inserter control unit 601 is mounted on the inserter 600*a*, and controls the drive of the inserter 600*a* by exchanging the information with the CPU circuit unit 150.

The finisher control unit 701 is mounted on the finisher 700*a*, and controls the drive of the finisher 700*a* by exchanging the information with the CPU circuit unit 150.

<Configuration of Sheet Stacker Control Unit>

Figure 6:
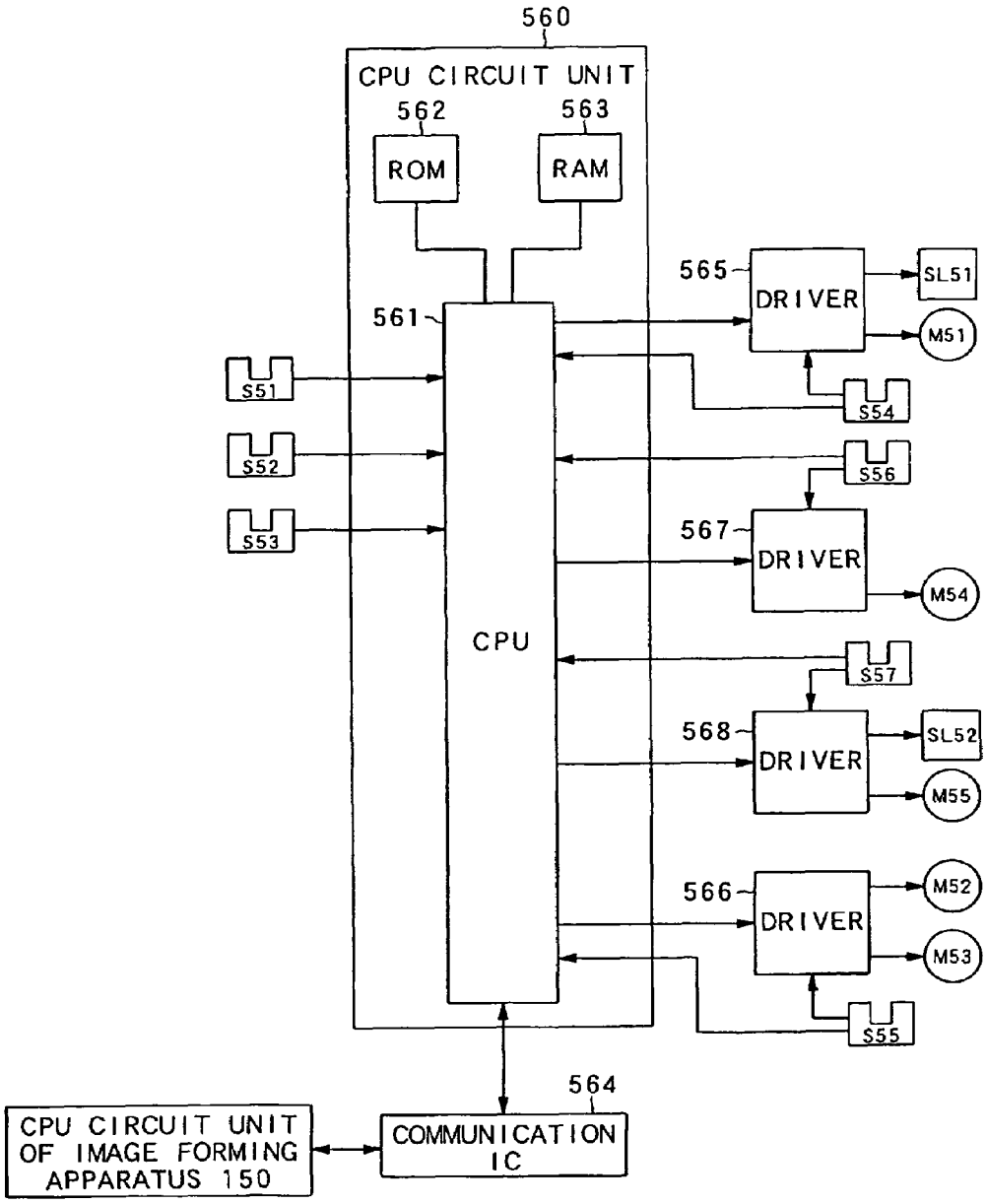
FIG. 6 is a block diagram showing a configuration of a sheet stacker control unit for controlling the drive of the sheet stacker.

FIG. 6 is a block diagram showing a configuration of the sheet stacker control unit 501 for controlling the drive of the sheet stacker 500*a*.

As shown in FIG. 6, the sheet stacker control unit 501 includes a CPU circuit unit 560, which is configured of a CPU 561, a ROM 562 and a RAM 563. The CPU circuit unit 560 communicates and exchanges data with the CPU circuit unit 150 disposed on the side of the image forming device 10, through a communication IC 564, and executes various programs stored in the ROM 562, on the basis of an instruction coming from the CPU circuit unit 150 thereby to control the drive of the sheet stacker 500*a*. To the CPU circuit unit 560, there are inputted the detection signals coming from various path sensors S51, S52 and S53 for detecting the delay and jam of the sheets being conveyed, and the detection signals coming from the cover opening/closing detection sensors S54, S55, S56 and S57.

With the CPU circuit unit 560, there are connected drivers 565, 566, 567 and 568.

The driver 565 drives a motor M51 and a solenoid SL51 of a conveying module on the basis of signals coming from the CPU circuit unit 560.

The driver 566 drives motors M52 and M53 of a stack module on the basis of signals coming from the CPU circuit unit 560.

The driver 567 drives a motor M54 of a vertical conveying module on the basis of a signal coming from the CPU circuit 560.

The driver 568 drives a motor M55 and a solenoid SL52 of a second horizontal conveying module on the basis of signals coming from the CPU circuit unit 560.

Here, the conveying module is configured of: the conveyance roller pairs 503, 504 and 505 disposed in the sheet stacker 500*a*; the horizontal path conveying motor M51 acting as the drive source for the roller pairs; and the solenoid SL51 for switching the flapper 510.

Moreover, the stack module is configured of: the sheet stacking plate motor M52 acting as the drive source for a sheet stacking plate 521 composing the sheet stacking unit 530; and the sheet stacking/conveying motor M53 acting as the drive source for a conveyance roller 527 disposed on the path 520.

Moreover, the vertical conveying module is configured of: the conveyance roller pairs 547, 548 and 549 disposed on the vertical conveyance path 542; and the vertical path conveying motor M54 acting as the drive source for the roller pairs.

Moreover, the second horizontal conveying module is configured of: the conveyance roller pairs 543, 544 and 545 disposed on the second horizontal conveyance path 546; the horizontal path conveying motor M55 acting as the drive source for the roller pairs; and the solenoid SL52 for switching the path selecting flapper 539.

In case the open state of the cover 551 is detected with the detection signal coming from the cover opening/closing detection sensor S54, the power of the driver 565 is turned OFF to stop the drive of the conveying module forcibly. Simultaneously with this, the power of the driver 566 is turned OFF to stop the drive of the stack module forcibly, too.

In case the open state of the cover 552 is detected with the detection signal coming from the cover opening/closing detection sensor S55, only the power of the driver 566 is turned OFF to stop only the drive of the stack module forcibly.

In case the open state of the cover 554 is detected with the detection signal coming from the cover opening/closing detection sensor S56, the power of the driver 567 is turned OFF to stop only the drive of the vertical conveying module forcibly.

In case the open state of the cover 553 is detected with the detection signal coming from the cover opening/closing detection sensor S57, only the power of the driver 568 is turned OFF to stop the drive of the second horizontal conveying module forcibly.

<Configuration of Feeder Control Unit>

Figure 7:
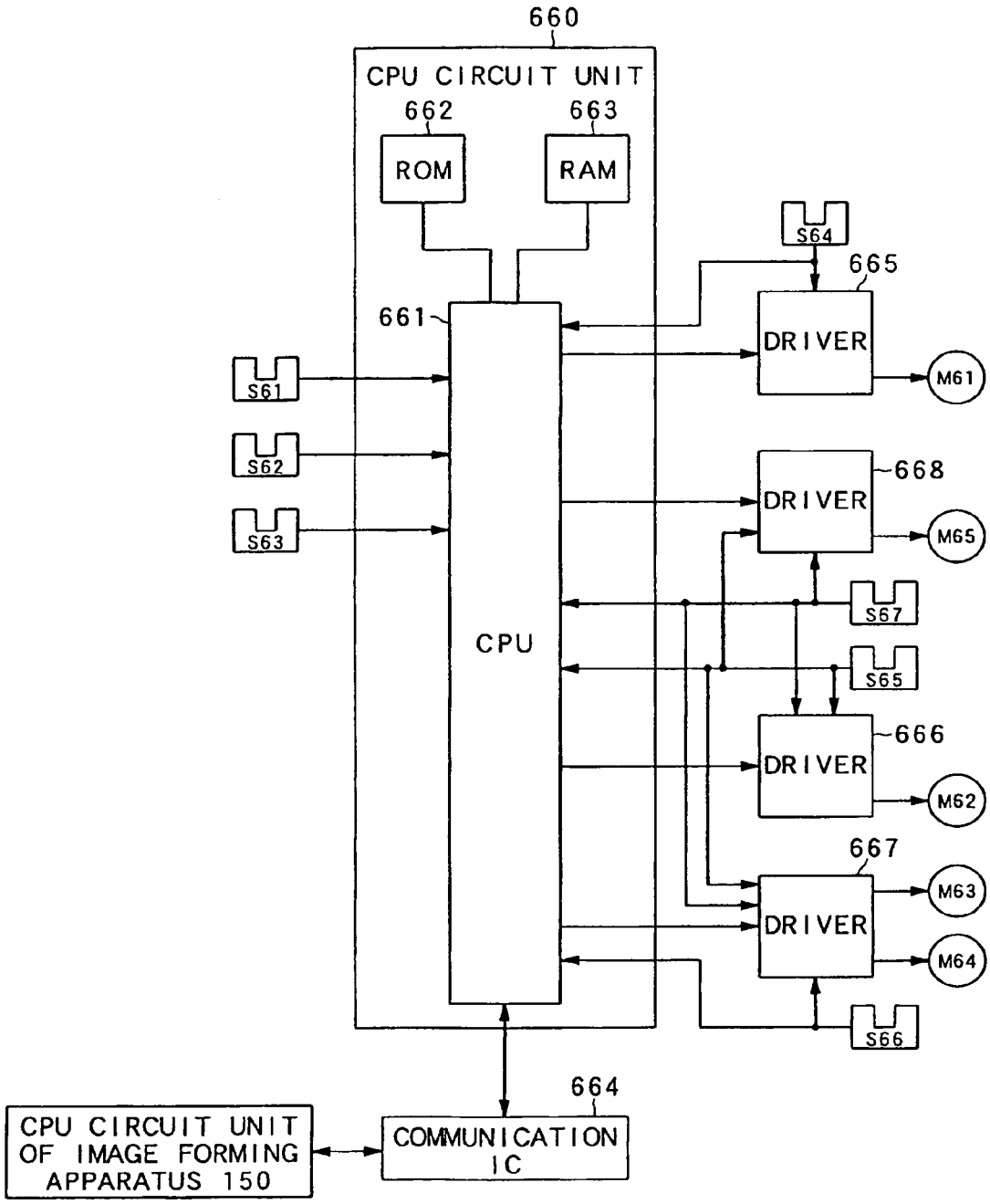
FIG. 7 is a block diagram showing a configuration of an inserter control unit for controlling the drive of the inserter.

FIG. 7 is a block diagram showing a configuration of the inserter control unit 601 for controlling the drive of the inserter 600*a*.

As shown in FIG. 7, the inserter control unit 601 includes the CPU circuit unit 660, which is configured of a CPU 661, a ROM 662 and a RAM 663. The CPU circuit unit 660 communicates and exchanges data with the CPU circuit unit 150 disposed on the side of the image forming device 10, through a communication IC 664, and executes various programs stored in the ROM 662, on the basis of an instruction coming from the CPU circuit unit 150 thereby to control the control of the inserter 600*a*. To the CPU circuit unit 660, there are inputted the detection signals coming from various path sensors S61, S62 and S63, and the detection signals coming from the cover opening/closing detection sensors S64, S65, S66 and S67.

With the CPU circuit unit 660, there are connected drivers 665, 666, 667 and 668.

The driver 665 drives a motor M61 of the horizontal conveying module on the basis of a signal coming from the CPU circuit unit 660.

The driver 666 drives motor M62 of the vertical conveying module on the basis of a signal coming from the CPU circuit unit 660.

The driver 667 drives motors M63 and M64 of a feed module on the basis of a signal coming from the CPU circuit 660.

The driver 668 drives a motor M65 of a second horizontal conveying module on the basis of a signal coming from the CPU circuit unit 660.

Here, the horizontal conveying module is configured of: the conveyance roller pairs 602, 603 and 604; and the horizontal path conveying motor M61 acting as the drive source for the roller pairs.

Moreover, the vertical conveying module is configured of: conveyance roller pairs 640*a*, 641*a* and 642*a*; and the vertical path conveying motor M62 acting as the drive source for the roller pairs.

Moreover, the feed module is configured of: the sheet separators 636, 637 and 638; the sheet separator motor M63 acting as the drive source for the separators; and the intermediate plate ascending/descending motor M64 acting as the drive source for ascending/descending intermediate plates 633, 634 and 635.

Moreover, the second horizontal conveying module is configured of: the conveyance roller pairs 643, 644 and 645; and the second horizontal path conveying motor M65 acting as the drive source for the roller pairs.

In case the open state of the cover 651 is detected with the detection signal coming from the cover opening/closing detection sensor S64, the power of the driver 665 is turned OFF to stop the drive of the horizontal conveying module forcibly, and the powers of the drivers 666 and 667 are turned OFF to stop all the drives of the inserter 600*a* forcibly.

In case the open state of the cover 652 is detected with the detection signal coming from the cover opening/closing detection sensor S65, the power of the driver 666 is turned OFF to stop the drive of the vertical conveying module forcibly. Simultaneously with this, the power of the driver 667 is turned OFF to stop the drive of the feed module forcibly, too.

In case the open state of the cover 653 is detected with the detection signal coming from the cover opening/closing detection sensor S66, the power of the driver 667 is turned OFF to stop the drive of the feed module forcibly.

In case the open state of the cover 654 is detected with the detection signal coming from the cover opening/closing detection sensor S67, the power of the driver 668 is turned OFF to stop the drive of the second horizontal conveying module forcibly. Simultaneously with this, the power of the driver 666 is also turned OFF to stop the drive of the vertical conveying module forcibly.

<Configuration of Finisher Control Unit>

Figure 8:
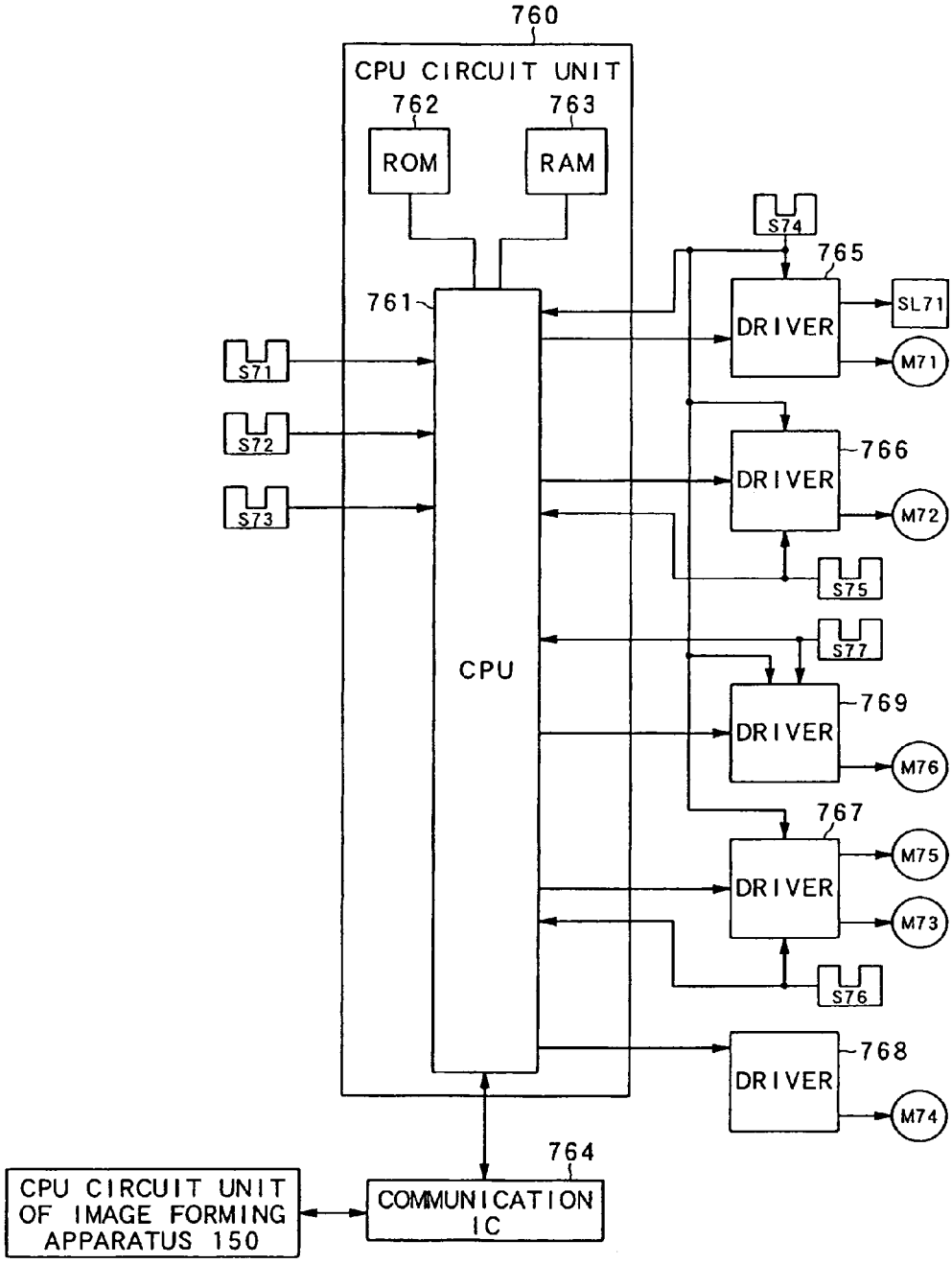
FIG. 8 is a block diagram showing a configuration of a finisher control unit for controlling the drive of the finisher.

FIG. 8 is a block diagram showing a configuration of the finisher control unit 701 for controlling the drive of the finisher 700*a*.

As shown in FIG. 8, the finisher control unit 701 includes the CPU circuit unit 760, which is configured of a CPU 761, a ROM 762 and a RAM 763. The CPU circuit unit 760 communicates and exchanges data with the CPU circuit unit 150 disposed on the side of the image forming device 10, through a communication IC 764, and executes various programs stored in the ROM 762, on the basis of an instruction coming from the CPU circuit unit 150 thereby to control the drive of the finisher 700*a*. To the CPU circuit unit 760, there are inputted the detection signals coming from various path sensors S71, S72 and S73, and the detection signals coming from the cover opening/closing detection sensors S74, S75, S76 and S77.

With the CPU circuit unit 760, there are connected drivers 765, 766, 767, 768 and 769.

The driver 765 drives a motor M71 and a solenoid SL71 of the conveying module on the basis of signals coming from the CPU circuit unit 760.

The driver 766 drives motor M72 of the non-sort discharge module on the basis of a signal coming from the CPU circuit unit 760.

The driver 767 drives motors M75 and M73 of a sort discharge module on the basis of a signal coming from the CPU circuit 760.

The driver 768 drives a motor M74 of the stack module on the basis of a signal coming from the CPU circuit unit 760.

The driver 769 drives a motor M76 of the vertical conveyance path module on the basis of a signal from the CPU circuit unit 760.

Here, the conveying module is configured of: the entrance roller pair 702; the conveying motor M71 acting as the drive source for the roller pair; and the solenoid SL71 for switching the switch flapper 710.

The non-sort discharge module is configured of: the conveyance roller pair 706; the non-sort discharge roller pair 703; and the discharge motor M72 acting as the drive source for those roller pairs.

Moreover, the sort module is configured of: the sort discharge roller 704; the sort discharge motor M75 acting as the drive source for the roller; a discharge roller pair 705; and the bundle conveying motor M73 acting as the drive source for the roller pair.

Moreover, the stack module is configured of: the stack tray 722; and the tray ascending/descending motor M74 acting as the drive source for the tray.

Moreover, the vertical conveyance path module is configured of: the conveyance roller pairs 743, 744 and 745 disposed on the vertical conveyance path 746; and the vertical path conveying motor M76 acting as the drive source for those roller pairs.

The conveying motor M71, the non-sort discharge motor M72, the sort discharge motor M75 and the vertical path conveying motor M76 are made of a stepping motor, so that they are enabled by controlling an energizing pulse rate to rotate the driving roller pairs at common or individual speeds. On the other hand, the bundle conveying motor M73 is made of a DC motor.

In case the open state of the cover 751 is detected with the detection signal coming from the cover opening/closing detection sensor S74, the power of the driver 765 is turned OFF to stop the drive of the conveying module forcibly. Simultaneously with this, the powers of the drivers 766, 767, 768 and 769 are turned OFF to stop all the drives of the finisher 700*a* forcibly.

In case the open state of the cover 752 is detected with the detection signal coming from the cover opening/closing detection sensor S75, on one hand, the power of the driver 766 is turned OFF to stop only the drive of the non-sort module forcibly.

In case the open state of the cover 753 is detected with the detection signal coming from the cover opening/closing detection sensor S76, on the other hand, the power of the driver 767 is turned OFF to stop only the drive of the sort module forcibly.

In case the open state of the cover 754 is detected with the detection signal coming from the cover opening/closing detection sensor S77, on the other hand, the power of the driver 769 is turned OFF to stop only the drive of the vertical conveyance path module forcibly.

<Description of Operations of Sheet Processing System>

Here are described the operations of the sheet processing system according to this embodiment.

The sheet processing system according to this embodiment is provided with a plurality of sheet processing devices. These sheet processing devices include sheet output devices for outputting the sheets, and a post-processing device for subjecting the sheets outputted from the sheet output device, to a post-processing. This embodiment is provided as the sheet output devices with: the image forming device 10 (or the printer 300) for forming images on the sheets and outputting them; the inserter 600*a* for outputting the sheets without forming the images; the sheet stacker (or the buffer device) 500*a* for re-outputting the once-outputted sheets after a temporary standby; and the sheet feeding devices (i.e., the cassettes 114 and 115) for feeding the sheets to other sheet processing devices. The finisher 700*a* is provided as the post-processing device.

The sheet processing system executes one job as a sheet process unit by using the primary sheet conveyance path, via which the sheets outputted from the printer 300 are conveyed to the inserter 600*a*, the sheet stacker 500*a* and the finisher 700*a*. Without awaiting the end of that one job, moreover, another job can be executed in parallel with that job by using the secondary sheet conveyance path, via which the sheets are conveyed from the inserter 600*a* to the sheet stacker 500*a* and the finisher 700*a*.

Figure 9:
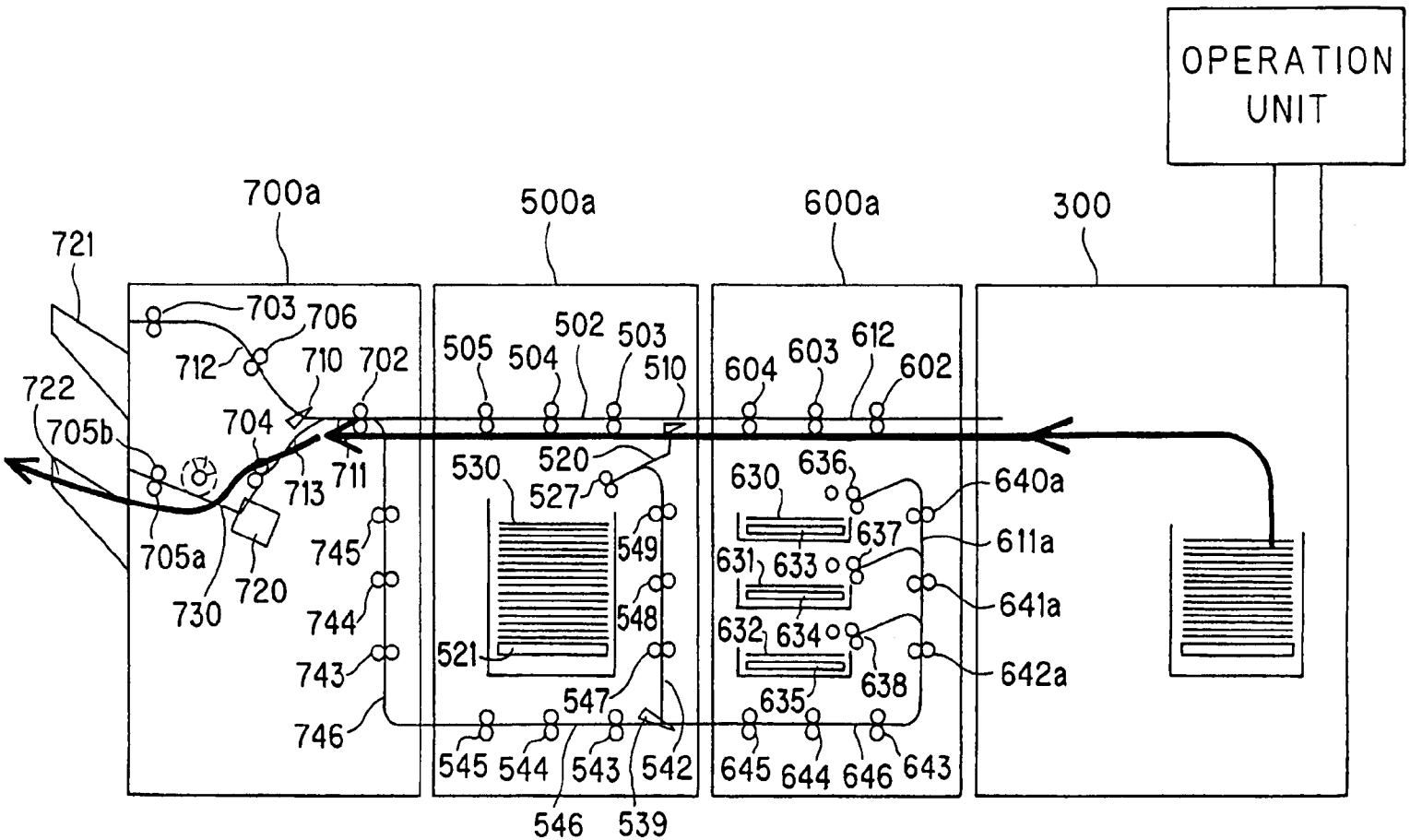
FIG. 9 is a diagram for explaining a first job of the sheet processing system.

FIG. 9 is a diagram for explaining the first job.

The first job is a bookbinding job to be executed by combining the printer 300, the inserter 600*a*, the sheet stacker 500*a* and the finisher 700*a*. In this bookbinding job, the sheets having images formed by the printer 300 are bundled and stapled into a plurality of pages by the finisher 700*a* and are then outputted.

In case the first job is executed, the CPU circuit unit 150 of the image forming device 10 causes the CPU 661 of the inserter 600*a* to activate the horizontal path conveying motor M61 of the horizontal conveying module. As a result, this motor M61 drives the conveyance roller pairs 602, 603 and 604 of the horizontal conveyance path 612.

Moreover, the CPU circuit unit 150 of the image forming device 10 causes the CPU 561 of the sheet stacker 500*a* to activate the solenoid SL51 and the motor M51 of the conveying module. As a result, the flapper 510 is switched to the position to obstruct the introduction of the sheets into the path 520, and the conveyance roller pairs 503, 504 and 505 are driven.

Still moreover, the CPU circuit unit 150 of the image forming device 10 causes the CPU 761 of the finisher 700*a* to activate the solenoid SL71, the conveying motor M71 of the conveying module, the sort discharge motor M75, the bundle conveying motor M73 and the tray ascending/descending motor M74. As a result, the flapper 710 is switched to the position to block the introduction of the sheets into the non-sort path 712, and the entrance roller pair 702, the sort discharge roller 704, the discharge roller pair 705 and the stack tray 722 are driven.

By thus controlling the sheet processing system, the sheets having the images formed by the printer 300 are conveyed through the horizontal conveyance path 612 of the inserter 600*a* and the horizontal conveyance path 502 of the sheet stacker 500*a* to the intermediate tray 730 of the finisher 700*a* and are stacked in the intermediate tray 730. The sheets stacked in a bundle shape on the intermediate tray 730 are stapled, after aligned (jogged), by the stapler 720 and are discharged onto the stack tray 722. Here, the stapler 720 can select the stapling or punching process or the like properly.

Figure 10:
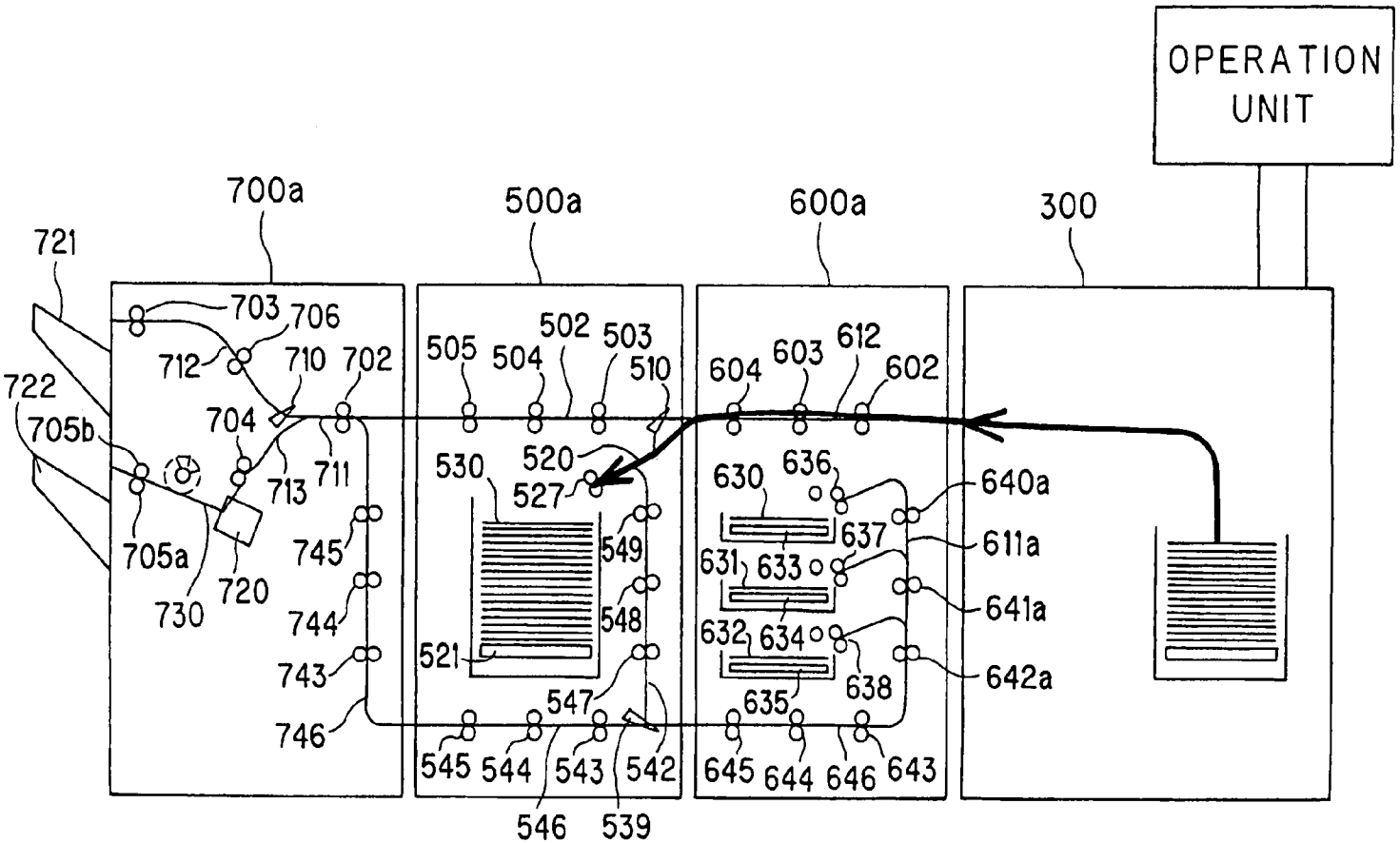
FIG. 10 is a diagram for explaining a second job of the sheet processing system.

FIG. 10 is a diagram for explaining a second job.

The second job is a job to be executed by the printer 300, the inserter 600*a* and the sheet stacker 500*a*. In this job, the sheets having images formed by the printer 300 are stacked on the sheet stacker 500*a*. The sheet stacker 500*a* stacks the sheets outputted from the printer 300, for a while so that the processing capacities can be adjusted and controlled among the printer 300, the inserter 600*a* and the finisher 700*a*.

In the case of executing the second job, the CPU circuit unit 150 of the image forming device 10 causes the CPU 561 of the sheet stacker 500*a* to activate the solenoid SL51, the motor M53 and the sheet stacking plate motor M52 of the stack module. As a result, the flapper 510 is switched to the position to obstruct the introduction of the sheets into the horizontal conveyance path 502, and the conveyance roller 527 and the sheet stacking plate 521 are driven.

Moreover, the CPU circuit unit 150 of the image forming device 10 causes the CPU 661 of the inserter 600*a* to activate the horizontal path conveying motor M61 of the horizontal conveying module. As a result, the conveyance roller pairs 602, 603 and 604 of the horizontal conveyance path 612 are driven.

By thus controlling the sheet processing system, the sheets having the images formed by the printer 300 are guided through the horizontal conveyance path 612 of the inserter 600*a* to the conveyance path 520 of the sheet stacker 500*a* and are stacked in the sheet stacking unit 530. At this time, the sheet stacking plate 521 descends properly according to the number of stacked sheets.

Figure 11:
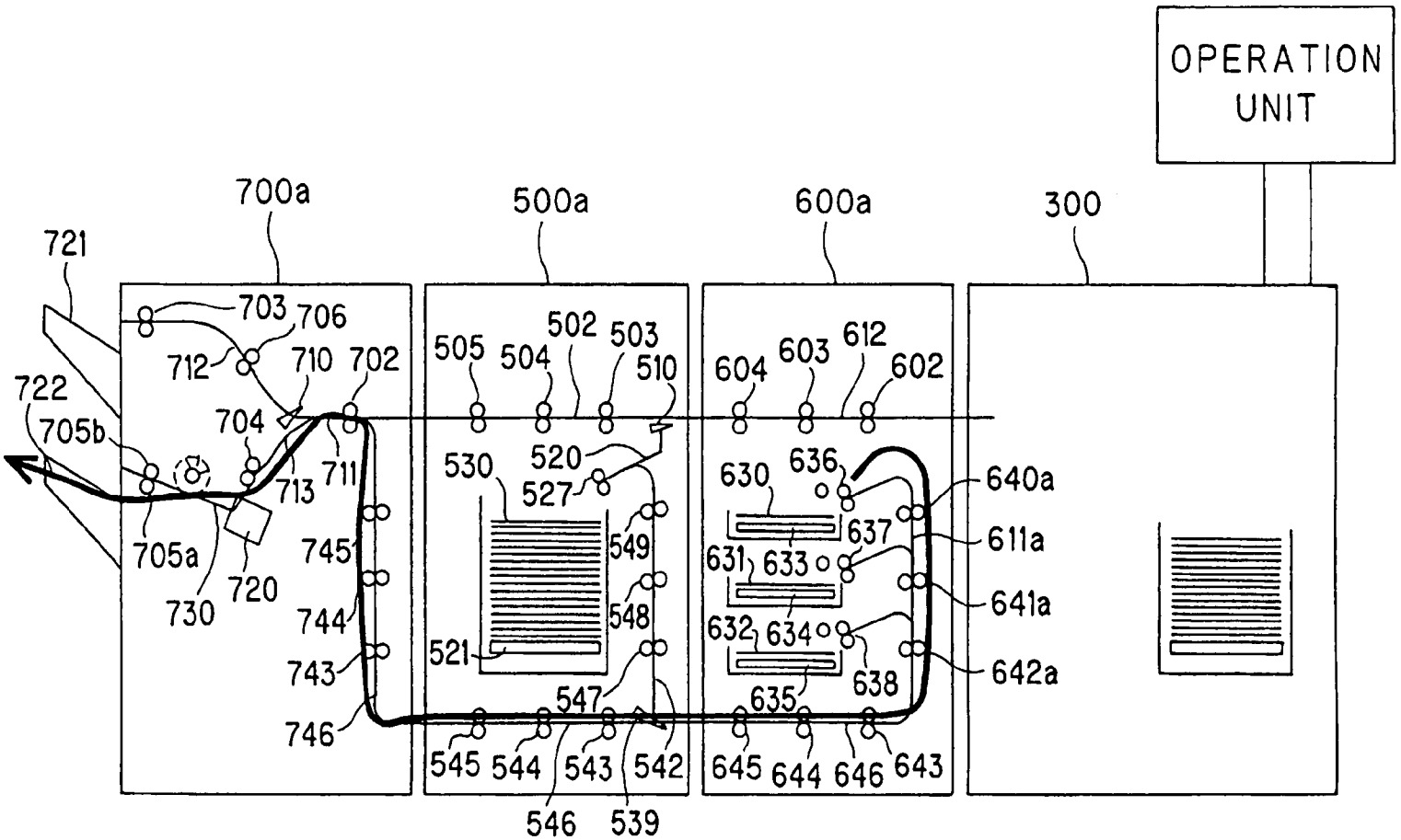
FIG. 11 is a diagram for explaining a third job of the sheet processing system.

FIG. 11 is a diagram for explaining a third job.

The third job is a job to be executed by combining the inserter 600*a*, the sheet stacker 500*a* and the finisher 700*a*. In the third job, specifically, the special sheets (e.g., color copies) stored in the inserter 600*a* are conveyed through the second horizontal conveyance path 646 of the inserter 600*a*, the second horizontal conveyance path 546 of the sheet stacker 500*a* and the vertical conveyance path 746 of the finisher 700*a* to the intermediate tray 730 of the finisher 700*a*. The special sheets thus conveyed are bundled and stapled into a plurality of pages and are then outputted.

In the case of executing the third job, the CPU circuit unit 150 of the image forming device 10 causes the CPU 661 of the inserter 600*a* to activate the sheet separator motor M63 and the intermediate ascending/descending motor M64 of the feed module. As a result, the sheet separators 636, 637 and 638 and the intermediate plates 633, 634 and 635 are driven.

Moreover, the CPU control circuit 150 causes the CPU 661 of the inserter 600*a* to activate the motor M62 of the vertical conveying module. As a result, the conveyance roller pairs 640*a*, 641*a* and 642*a* are driven.

Moreover, the CPU circuit unit 150 causes the CPU 661 of the inserter 600*a* to activate the motor M65 of the second horizontal conveying module. As a result, the conveyance roller pairs 643, 644 and 645 are driven. Moreover, the CPU circuit unit 150 causes the CPU 561 of the sheet stacker 500*a* to activate the motor M55 of the second horizontal conveying module. As a result, the conveyance roller pairs 543, 544 and 545 are driven.

Moreover, the CPU circuit unit 150 causes the CPU 761 of the finisher 700*a* to activate the motor M76 of the vertical conveyance path module. As a result, the conveyance roller pairs 743, 744 and 745 are driven. Moreover, the CPU circuit unit 150 causes the CPU 761 of the finisher 700*a* to activate the solenoid SL71, the conveying motor M71 of the conveying module, the sort discharge motor M75, the bundle conveying motor M73 and the tray ascending/descending motor M74. As a result, the switch flapper 710 is switched to the position to obstruct the instruction of the sheets into the non-sort path 712, and the entrance roller pair 702, the sort discharge roller pair 704, the discharge roller pair 705 and the stack tray 722 are driven.

By thus controlling the sheet processing system, the special sheets such as the color copies fed from the inserter 600*a* are conveyed to the intermediate tray 730 of the finisher 700*a* through the vertical conveyance path 611*a* and the second horizontal conveyance path 646 of the inserter 600*a*, the second horizontal conveyance path 546 of the sheet stacker 500*a* and the vertical conveyance path 746 of the finisher 700*a*, and are stacked in the intermediate tray 730.

The special sheets stacked in a bundle shape on the intermediate tray 730 are stapled, after aligned, by the stapler 720 and are discharged onto the stack tray 722. Here, the stapler 720 can select the stapling or punching process or the like properly.

Figure 12:
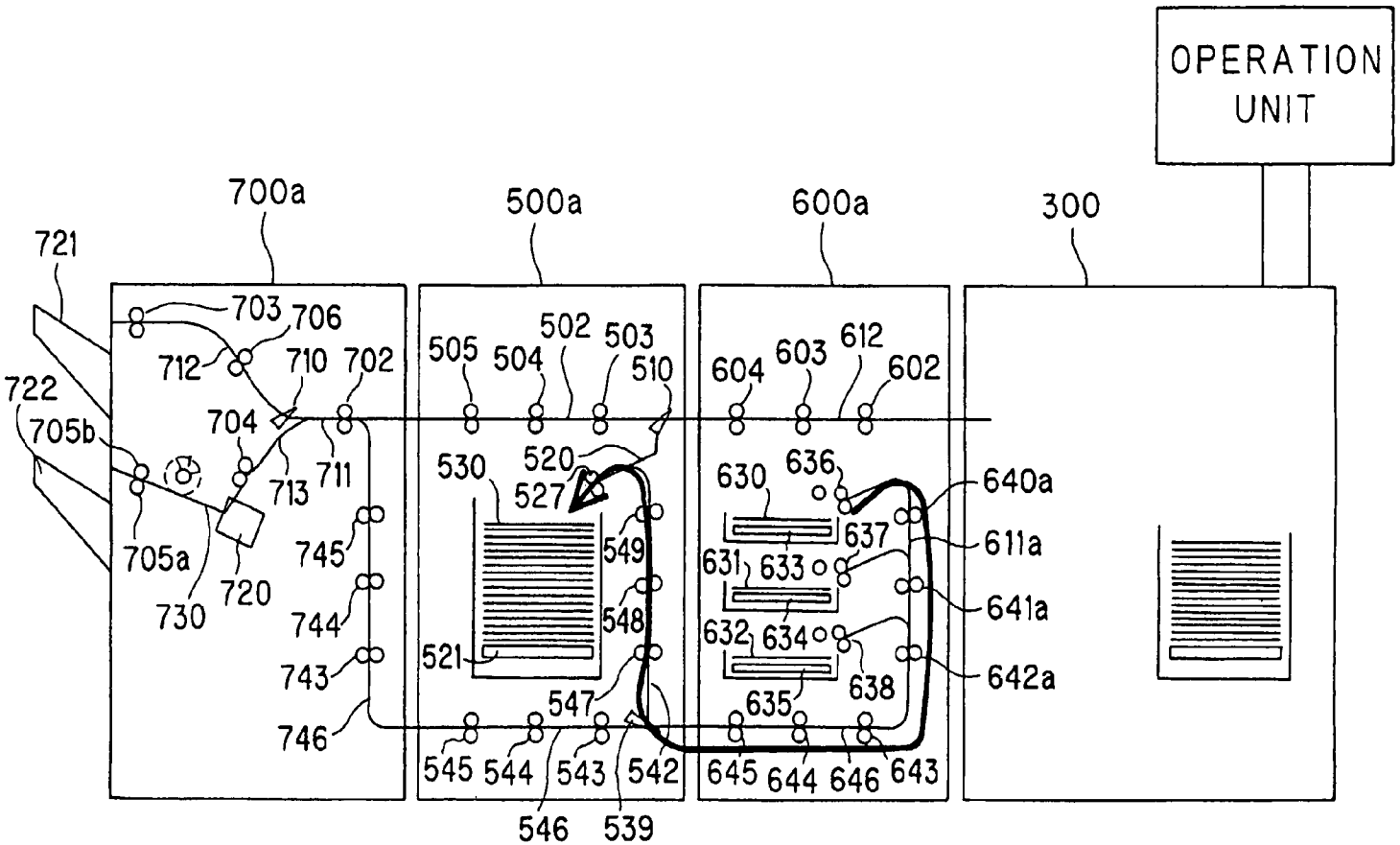
FIG. 12 is a diagram for explaining a fourth job of the sheet processing system.

FIG. 12 is a diagram for explaining a fourth job.

The fourth job is a job to be executed by combining the inserter 600*a* and the sheet stacker 500*a*. In this fourth job, the special sheets (e.g., the color copies) stored in the inserter 600*a* are stacked in the sheet stacking unit 530 through the second horizontal conveyance path 646 of the inserter 600*a* and the vertical conveyance path 542 of the sheet stacker 500*a*. The sheets outputted from the inserter 600*a* are temporarily stacked in the sheet stacker 500*a* so that the processing capacities can be adjusted and controlled among the printer 300, the inserter 600*a* and the finisher 700*a*.

In the case of executing the fourth job, the CPU circuit unit 150 of the image forming device 10 causes the CPU 661 of the inserter 600*a* to activate the sheet separator motor M63 and the intermediate plate ascending/descending motor M64 of the feed module. As a result, the sheet separators 636, 637 and 638 and the intermediate plates 633, 634 and 635 are driven.

Moreover, the CPU circuit unit 150 causes the CPU 661 of the inserter 600*a* to activate the motor M62 of the vertical conveying module. As a result, the conveyance roller pairs 640*a*, 641*a* and 642*a* are driven. Moreover, the CPU circuit unit 150 causes the CPU 661 of the inserter 600*a* to activate the motor M65 of the second horizontal conveying module. As a result, the conveyance roller pairs 643, 644 and 645 are driven.

Moreover, the CPU circuit unit 150 causes the CPU 561 of the sheet stacker 500*a* to activate the motor M54 of the vertical conveying module. As a result, the conveyance roller pairs 547, 548 and 549 are driven.

Moreover, the CPU circuit unit 150 causes the CPU 561 of the sheet stacker 500*a* to activate the motor M53 and the sheet stacking plate motor M52 of the stack module. As a result, the conveyance roller 527 and the sheet stacking plate 521 are driven.

By thus controlling the sheet processing system, the special sheets such as the color copies fed from the inserter 600*a* are stacked in the sheet stacking unit 530 through the vertical conveyance path 611*a* and the second horizontal conveyance path 646 of the inserter 600*a* and the vertical conveyance path 542 of the sheet stacker 500*a*. At this time, the sheet stacking plate 521 is descended properly according to the number of stacked sheets.

<Parallel Execution of Plural Jobs>

Figure 13:
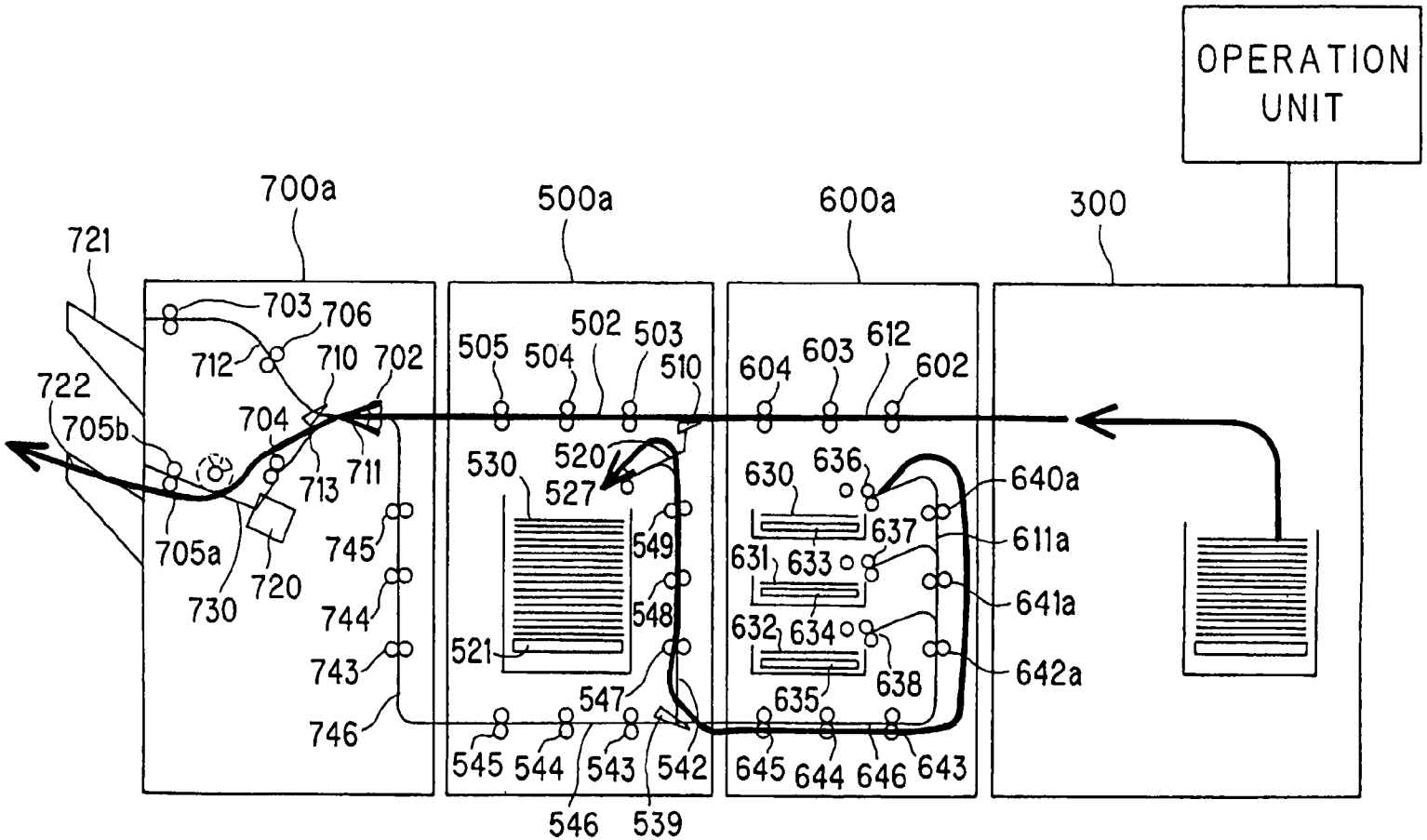
FIG. 13 is a diagram for explaining a parallel execution of the first job and the fourth job.

FIG. 13 is a diagram for explaining the parallel execution of the first job and the fourth job.

Here are described the operations to execute in parallel: the first job (in which the sheets having the images formed by the printer 300 are conveyed to the finisher 700*a* by using the primary sheet conveyance path (including the horizontal conveyance path 612 and the horizontal conveyance path 502) and are bundled and stapled into the plural pages by the finisher 700*a* so that the stapled sheets are outputted); and the fourth job (in which the special sheets (e.g., the color copies) stored in the inserter 600*a* are conveyed to the sheet stacker 500*a* by using the secondary sheet conveyance path (including the second horizontal conveyance path 646 and the vertical conveyance path 542) and are stacked in the sheet stacking unit 530 of the sheet stacker 500*a*).

In this operation, the primary sheet conveying means disposed on the primary sheet conveyance path includes: the conveyance roller pairs 602, 603 and 604 disposed on the horizontal conveyance path 612, and the horizontal path conveying motor M61 acting as the drive source for those roller pairs; and conveyance roller pairs 503, 504 and 505 disposed on the horizontal conveyance path 502, and the horizontal path conveying motor M51 acting as the drive source for those roller pairs. On the other hand, the secondary sheet conveying means disposed on the secondary sheet conveyance path includes the conveyance roller pairs 643, 644 and 645 disposed on the second horizontal conveyance path 646, and the second horizontal conveying motor M65 acting as the drive source for those roller pairs. The primary sheet conveying means and the secondary sheet conveying means are independent of each other so that the two first and fourth jobs can be executed in parallel.

The flapper (or the block means) 510 disposed in the sheet stacker 500*a* is switched to the position to block the introduction of the sheets conveyed from the printer 300, into the path 520.

As a result, the sheets conveyed on the primary sheet conveyance path and the sheets conveyed on the secondary sheet conveyance path can be prevented from being mixed thereby to improve the reliability of the system.

Here, it is like the case of the aforementioned first and fourth jobs that the CPU circuit unit 150 of the image forming device 10 causes the CPU 561 of the sheet stacker 500*a*, the CPU 661 of the inserter 600*a* and the CPU 761 of the finisher 700*a* to activate the individual sheet processing modules.

Figure 14:
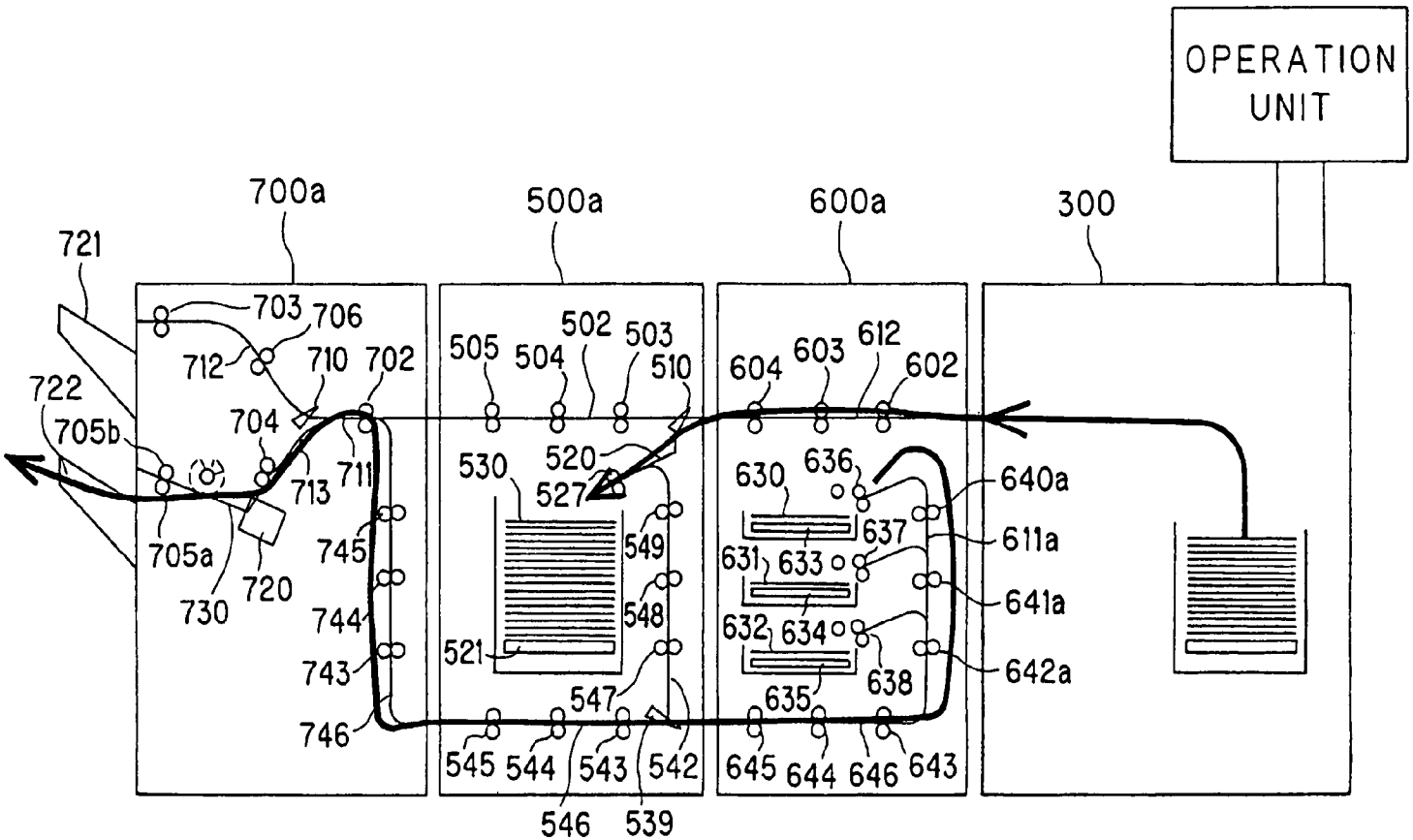
FIG. 14 is a diagram for explaining a parallel execution of the second job and the third job.

FIG. 14 is a diagram for explaining the parallel execution of the second job and the third job.

Here are described the operations to execute in parallel: the second job (in which the sheets having the images formed by the printer 300 are conveyed to the sheet stacker 500*a* by using the primary sheet conveyance path (including the horizontal conveyance path 612) and are stacked in the sheet stacking unit 530 of the sheet stacker 500*a*); and the third job (in which the special sheets (e.g., the color copies) stored in the inserter 600*a* are conveyed to the finisher 700*a* by using the secondary sheet conveyance path (including the second horizontal conveyance path 646, the second horizontal conveyance path 546 and the vertical conveyance path 764) and are bundled and stapled into the plural pages by the finisher 700*a* so that the stapled sheets are outputted).

In this operation, the primary sheet conveying means disposed on the primary sheet conveyance path includes the conveyance roller pairs 602, 603 and 604 disposed on the horizontal conveyance path 612, and the horizontal path conveying motor M61 acting as the drive source for those roller pairs. On the other hand, the secondary sheet conveying means disposed on the secondary sheet conveyance path includes: the conveyance roller pairs 643, 644 and 645 disposed on the second horizontal conveyance path 646, and the second horizontal conveying motor M65 acting as the drive source for those roller pairs; and the conveyance roller pairs 543, 544 and 545 disposed on the second horizontal conveyance path 546, and the second horizontal path conveying motor M55 acting as the drive source for those roller pairs. The primary sheet conveying means and the secondary sheet conveying means are independent of each other so that the two second and third jobs can be executed in parallel.

The path selecting flapper (or the block means) 539 disposed in the sheet stacker 500*a* is switched to the position to block the introduction of the sheets conveyed from the inserter 600*a* to the second horizontal conveyance path 646, into the vertical conveyance path 542.

As a result, the sheets conveyed on the primary sheet conveyance path and the sheets conveyed on the secondary sheet conveyance path can be prevented from being mixed thereby to improve the reliability of the system.

Here, it is like the case of the aforementioned second and third jobs that the CPU circuit unit 150 of the image forming device 10 causes the CPU 561 of the sheet stacker 500*a*, the CPU 661 of the inserter 600*a* and the CPU 761 of the finisher 700*a* to activate the individual sheet processing modules.

Here are described the opening/closing operations of the covers of the sheet processing system according to this embodiment.

Figure 15:
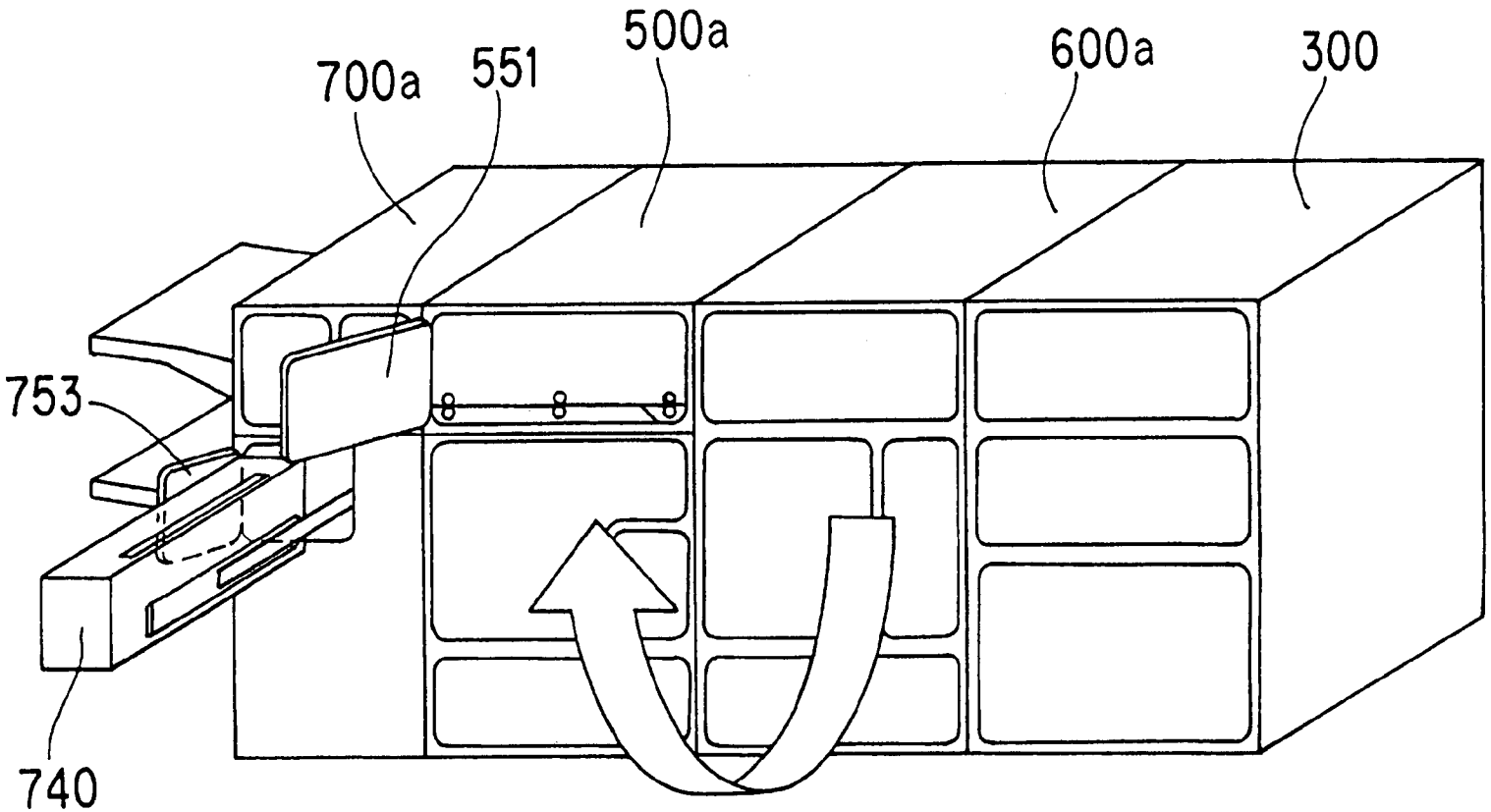
FIG. 15 is a view for explaining the opening/closing operations of the covers of the sheet processing system.

FIG. 15 is a view for explaining the opening/closing operations of the covers of the sheet processing system according to this embodiment.

When the cover 551 attached to the sheet stacker 500*a* is opened during the parallel execution of the first and fourth jobs, as shown in FIG. 15, access can be obtained from the outside of the apparatus to the horizontal conveyance path 502 and the conveyance roller pairs 503, 504 and 505, which configure the conveying module or the first sheet processing module.

When the cover 753 attached to the finisher 700*a* is opened, moreover, a sort unit 740 including the stapler 720 configuring the stack module can be extracted to the outside of the apparatus.

Here, even if the cover 551 or the cover 753 is opened/closed, the execution of the fourth job is not obstructed, but the sheets are conveyed from the inserter 600*a* through the secondary sheet conveyance path to the sheet stacker 500*a*. In other words, the opening/closing operations of the individual covers covering the individual sheet processing modules to be used in the first job and the control of the execution of the first job are independent of the opening/closing operations of the individual covers covering the individual sheet processing modules to be used in the fourth job and the control of the execution of the fourth job.

Although not described, the opening/closing operations of the other covers covering the sheet processing modules unused in the fourth job do not obstruct the execution of the fourth job either. Moreover, the opening/closing operations of the covers covering the sheet processing modules unused in the first job do not obstruct the execution of the first job.

Figure 16:
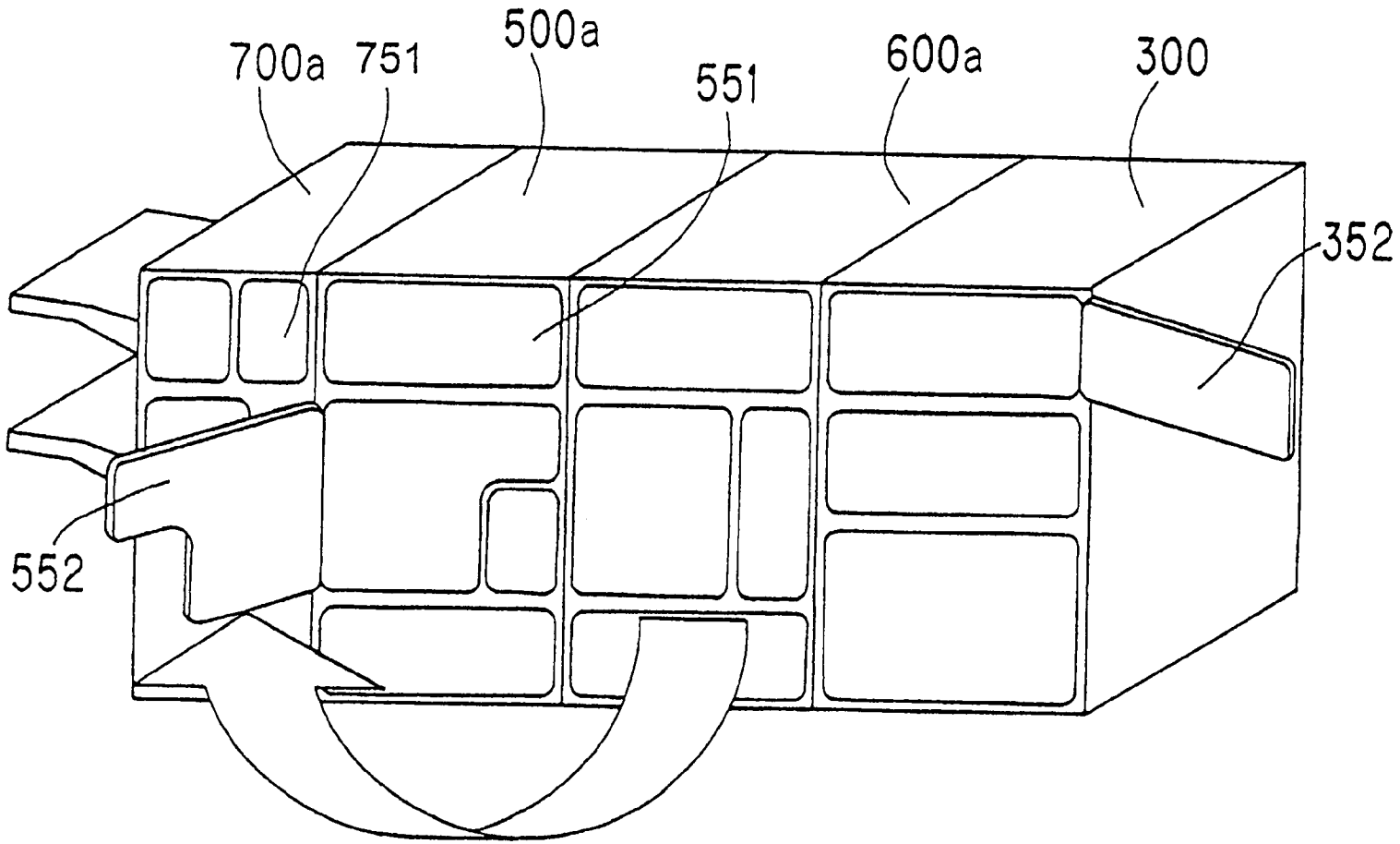
FIG. 16 is a view for explaining the opening/closing operations of the covers of the sheet processing system.

When the cover 552 attached to the sheet stacker 500*a* is opened during the parallel execution of the second and third jobs, as shown in FIG. 16, access can be obtained from the outside of the apparatus to the sheet stacking unit 530 which configures the sheet stacking module.

When the cover 352 attached to the printer 300 is opened, moreover, access can be obtained from the outside of the apparatus to the photosensitive drum 111 or the fixer 117.

Here, even if the cover 552 or the cover 352 is opened/closed, the execution of the third job is not obstructed, but the sheets are conveyed from the inserter 600*a* through the secondary sheet conveyance path to the finisher 700*a*. In other words, the opening/closing operations of the individual covers covering the individual sheet processing modules to be used in the second job and the control of the execution of the second job are independent of the control of the execution of the third job.

Although not described, the opening/closing operations of the other covers covering the sheet processing modules unused in the third job do not obstruct the execution of the third job either. Moreover, the opening/closing operations of the covers covering the sheet processing modules unused in the second job do not obstruct the execution of the second job.

In the sheet processing system according to this embodiment, the covers covering the individual sheet processing modules used in one job and the operation control line are made so independent of the covers covering the individual sheet processing modules used in the other job and the operation control lines as to raise no trouble in the parallel process of the jobs of the individual sheet processing devices. As a result, even if the sheet processing module executing one job is stopped in the case of the parallel process of the plural jobs, the other job can be continuously executed.

When the cover 652 of the inserter 600*a* is opened during the parallel execution of the first and fourth jobs, the open state of the cover 652 is detected by the cover opening/closing detection sensor S65 so that the powers of the drivers 666, 667 and 668 are turned OFF.

As a result, there are turned OFF the powers of the vertical conveying module (including the conveyance roller pairs 640*a*, 641*a* and 642*a* and the vertical path conveying motor M62), the feed module (including the conveyance roller pairs 636, 637 and 638 and the sheet separator motor M63) and the second horizontal conveying module (including the conveyance roller pairs 643, 644 and 645 and the horizontal path conveying motor M65). Moreover, there are also turned OFF the powers of the drivers 566 and 567 which belong to the sheet stacker 500*a*.

As a result, the drives of the vertical conveying module (including the conveyance roller pairs 547, 548 and 549 and the vertical path conveying motor M54) and the sheet stacking module (including the conveyance roller 527 and the sheet stacking conveying motor M53) are forcibly stopped to stop the fourth job.

However, the printer 300, the horizontal conveying module disposed on the horizontal conveyance path 612 of the inserter 600*a*, the conveying module disposed on the horizontal conveyance path 502 of the sheet stacker 500*a*, and the finisher 700*a* are left able to execute the first job.

Like discussion applies even if the other covers 653, 654, 553, 554 and 552 covering the other sheet processing modules to be unused in the first job are opened.

In case the covers covering the sheet processing modules to be used in the first job of the printer 300 or the finisher 700*a* are opened during the parallel execution of the first and fourth jobs, the operations of those sheet processing modules are forcibly stopped to stop the first job.

However, the operations of the sheet processing modules to be used in the fourth jobs of the inserter 600*a* and the sheet stacker 500*a* can be continued to execute the fourth job.

Even if the cover covering any sheet processing module is opened for the jam-clearing, parts-replacing, cleaning, adjusting, sheet supplying operation or the like while the plural jobs are being executed in parallel, therefore, the stop of the drive occurs only at the sheet processing module which needs the maintenance. The drives of the individual sheet processing modules to be used for the other job can be continued to execute the other job.

Figure 17:
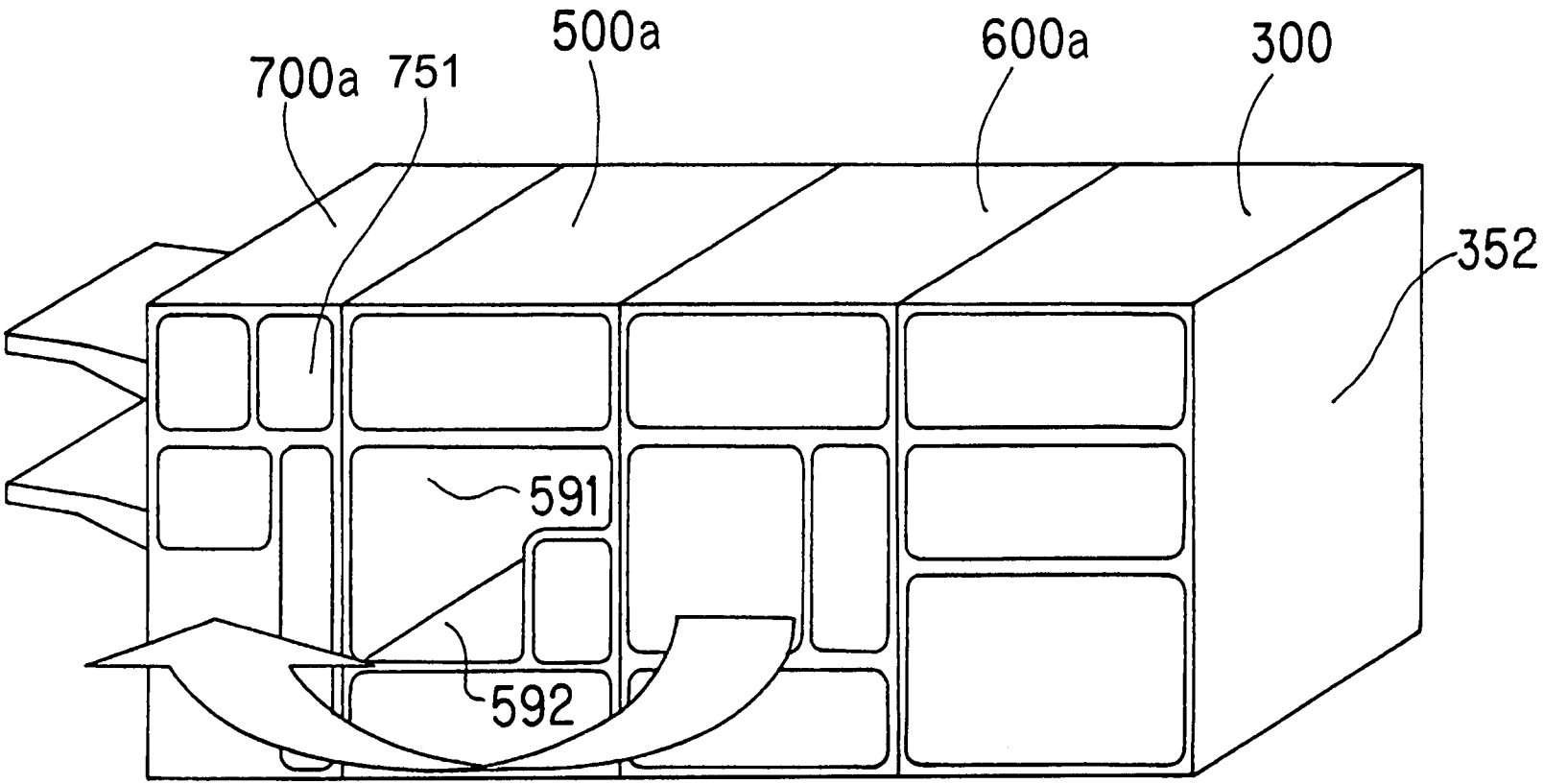
FIG. 17 is a view for explaining a construction of partitions.

FIG. 17 is a view for explaining a construction of partitions.

As shown in FIG. 17, the sheet processing system according to this embodiment is provided with a partition 591 for partitioning the sheet stacker 500*a* and the finisher 700*a*.

As shown in FIG. 17, moreover, the sheet processing system according to this embodiment is provided with a partition 592, which separates the sheet stacking unit 530 configuring the sheet stack module of the sheet stacker 500*a* and the second horizontal conveyance path 546 having the second horizontal conveying module.

The cover 552 and the internal configuration of the sheet stacker 500*a* are omitted from FIG. 17 so as to explain the partitions 591 and 592.

The partition 591 blocks access from the sheet stacker 500*a* to the finisher 700*a* or vice versa. On the other hand, the partition 592 blocks access from the sheet stacking unit 530 of the sheet stacker 500*a* to the second horizontal conveyance path 546 or vice versa.

The partitions 591 and 592 block access from the side of the sheet stacker 500*a* having interrupted the second job to the side of the finisher 700*a* executing the third job thereby to prevent the execution of the third job from being obstructed (by the touch of the sheets being conveyed or the path sensor). On the contrary, it is possible to prevent the access from the side of the finisher 700*a* executing the third job to the side of the sheet stacker 500*a* executing the second job.

The sheet processing system according to this embodiment divides the drive sources of the individual conveying modules for every path, but should not be limited thereto. For example, the discharge roller 118 of the printer 300 and the horizontal conveyance path 502 of the sheet stacker 500*a* may be driven by a common drive source.

Moreover, the horizontal conveyance path 612 of the inserter 600*a* and the entrance roller pair 702 of the finisher 700*a* may be driven by a common drive source.

The construction of the covers attached to the individual sheet processing devices can also be modified. For example, the cover 352 attached to the printer 300 and the cover 551 attached to the sheet stacker 500*a* may be constructed of identical covers. Moreover, the cover 651 attached to the inserter 600*a* and the cover 751 attached to the finisher 700*a* may also be constructed of identical covers.

Second Embodiment

A second embodiment of the invention will be described in the following.

Figure 18:
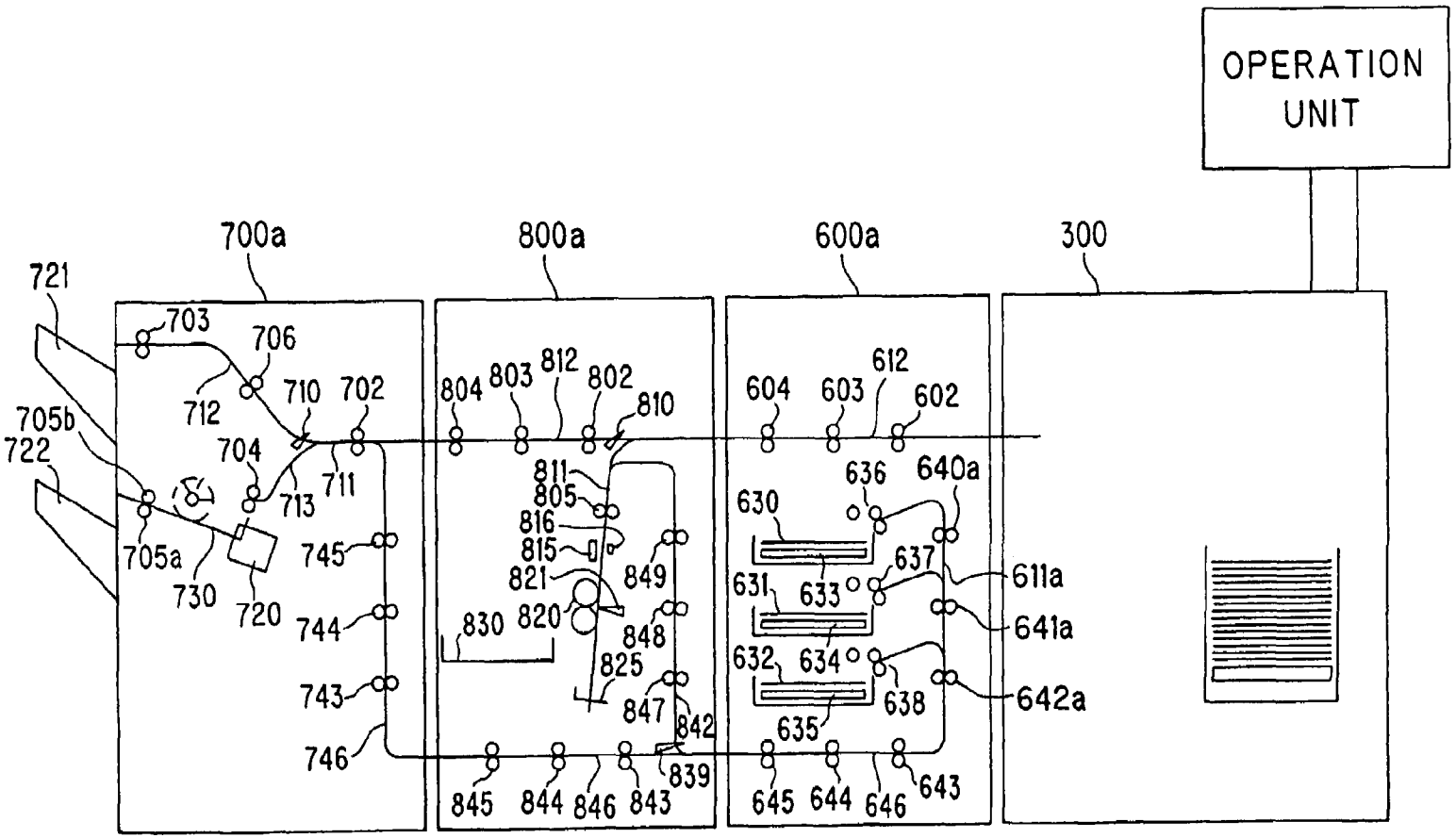
FIG. 18 is a schematic construction diagram showing an internal construction of a sheet processing system according to a second embodiment.

FIG. 18 is a schematic construction diagram showing an internal construction of a sheet processing system according to the second embodiment of the invention.

The sheet processing system is provided with a plurality of sheet processing devices having individually different sheet processing functions. In this embodiment, the four sheet processing devices of the printer 300, the inserter 600*a*, a bookbinder 800*a* and the finisher 700*a* are sequentially connected in tandem.

<Bookbinder 800*a*>

The bookbinder 800*a* is provided with: a binding horizontal conveyance path (or the primary sheet conveyance path) 812 for guiding the sheets outputted from the printer 300 or the inserter 600*a*, to the side of the finisher 700*a*; conveyance roller pairs 802, 803 and 804 disposed on the binding horizontal conveyance path 812; a binding path 811 branched downward from the binding horizontal conveyance path 812; a conveyance roller pair 805 disposed on the binding path 811; a binding path selecting flapper 810 disposed at the entrance portion of the binding horizontal conveyance path 812 for a switching operation to guide the sheets selectively to the side of the binding path 811 or the inserter 600*a*; two pairs of staplers 815 disposed midway of the binding path 811; anvils 816 arranged at the positions to confront the staplers 815; a roller pair 820 arranged below the staplers 815; a protruding member 821 arranged at the position to confront the folding roller pair 820; a movable sheet positioning member 825 arranged below the folding roller pair 820 for positioning the leading end of the sheets guided on the binding path 811; and a binding discharge tray 830. The bookbinder 800*a* is further provided with: a vertical conveyance path 842 for conveying the sheets outputted from the inserter 600*a*, through the second horizontal conveyance path 646 to the binding path 811; conveyance roller pairs 847, 848 and 849 disposed on the vertical conveyance path 842; a second horizontal conveyance path (or a secondary sheet conveyance path) 846 for conveying the sheets outputted from the second horizontal conveyance path 646 of the inserter 600*a*, to the adjoining finisher 700*a*; conveyance roller pairs 843, 844 and 845 disposed on the second horizontal conveyance path 846; and a path selecting flapper 839 disposed on the entrance sides of the second horizontal conveyance path 846 and the vertical conveyance path 842 for guiding the sheets selectively to the binding path 811 or the finisher 700*a*.

The operations to be performed on the sheets outputted from the horizontal conveyance path 612 of the inserter 600*a* are similar to those of the first embodiment so that their description is omitted. The following description is made on the operations to be performed on the sheets outputted from the second horizontal conveyance path 646.

In the case of executing the bookbinding job, the sheets outputted from the printer 300 or the inserter 600*a* are guided into the binding path 811. These sheets are conveyed so far as their leading end comes into contact with the movable sheet positioning member 825, and are once stored.

Then, the sheet bundle stored on the binding path 811 is protruded to the folding roller pair 820 by the protruding member 821 so that they are folded by the folding roller pair 820. The sheet bundle thus folded is discharged through the folding roller pair 820 onto the binding discharge tray 830. In case the sheet bundle stapled by the staplers 815 is to be folded, the positioning member 825 is so properly descended that the stapling position of the sheet bundle may come to the center position of the folding roller pair 820 after the end of the stapling operation.

In case no bookbinding job is performed, on the contrary, the binding path selecting flap 810 is switched to the position to block the introduction of the sheets into the binding path 811. As a result, the sheets are conveyed through the binding horizontal conveyance path 812 to the side of the finisher 700*a*.

When the bookbinding job is to be executed on the sheets outputted via the second horizontal conveyance path 646, the path selecting flapper 839 is switched to the position to block the introduction of the sheets into the second horizontal conveyance path 846. As a result, the sheets outputted from the inserter 600*a* are guided into the vertical conveyance path 842. The sheets thus guided into the vertical conveyance path 842 are guided into the binding path 811 so that they are bound.

In case no bookbinding job is performed, on the contrary, the path selecting flapper 839 is switched to the position to block the introduction of the sheets into the vertical conveyance path 842. As a result, the sheets outputted from the inserter 600*a* are conveyed via the second horizontal conveyance path 846 to the finisher 700*a*.

In the sheet processing system provided with such bookbinder 800*a*, too, the two jobs can be simultaneously executed among the printer 300, the inserter 600*a*, the bookbinder 800*a* and the finisher 700*a*, and between the inserter 600*a* and the bookbinder 800*a*.

In this case, one job is executed by using the primary sheet conveyance path, and another job can be executed in parallel with that one job by using the secondary sheet conveyance path.

The remaining constructions are similar to those of the sheet processing system according to the aforementioned first embodiment, and their description is omitted.

Third Embodiment

A third embodiment of the invention will be described in the following.

Figure 19:
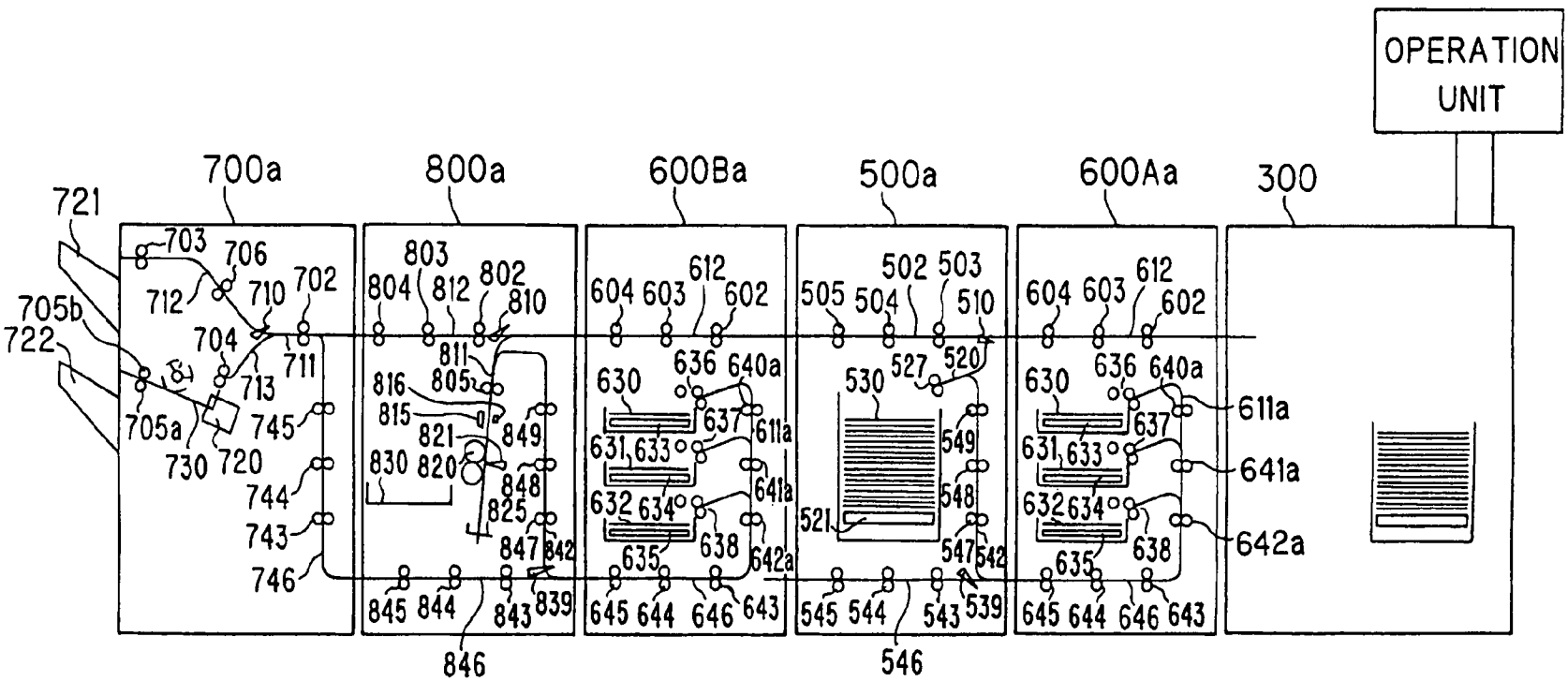
FIG. 19 is a schematic construction diagram showing an internal construction of a sheet processing system according to a third embodiment.

FIG. 19 is a schematic construction diagram showing an internal construction of a sheet processing system according to a third embodiment of the invention.

The sheet processing system of this embodiment is provided with a plurality of sheet processing devices having individually different sheet processing functions. In this embodiment, the six sheet processing devices of the printer 300, the sheet stacker 500*a*, two sets of inserter 600*a*A and inserter 600*a*B, the bookbinder 800*a* and the finisher 700*a* are sequentially connected in tandem.

In this sheet processing system, for example, there can be executed in parallel: the first job to be executed by combining all the sheet processing devices from the printer 300 to the finisher 700*a*; the second job to be executed by combining the printer 300, the sheet stacker 500*a*, the inserter 600*a*A and the bookbinder 800*a*; and the third job to be executed by combining the inserter 600*a*A, the bookbinder 800*a*, the inserter 600*a*B and the finisher 700*a*.

In this sheet processing system according to this embodiment, the sheet stacker 500*a*, the inserter 600*a*B and the bookbinder 800*a* are provided with the primary sheet conveyance path (including the horizontal conveyance path 502, the horizontal conveyance path 612 and the binding horizontal conveyance path 812) and the secondary sheet conveyance path (including the second horizontal conveyance path 546, the second horizontal conveyance path 646 and the second horizontal conveyance path 846) which communicate individually with the other post-processing devices arranged sequentially in tandem. The primary sheet conveyance path and the secondary sheet conveyance path merge into each other at the finisher 700*a* arranged at the last portion.

As a result, the array/combination of the sheet stacker 500*a*, the inserter 600*a*B and the bookbinder 800*a* can be freely set according to the contents of the bookbinding works. Another sheet processing device can also be suitably connected.

Therefore, those sheet processing devices constructing the sheet processing system can be freely combined according to the spaces for their installations or the contents of the bookbinding works thereby to satisfy the various bookbinding works.

In this case, too, one job is executed by using the primary sheet conveyance path, and another job can be executed in parallel with that one job by using the secondary sheet conveyance path.

Here, another job is arbitrarily executed by the combination of the sheet processing devices other than the aforementioned combination.

The remaining constructions are similar to those of the sheet processing system according to the aforementioned first embodiment, and their description is omitted.

The first to third embodiments thus far described are summarized, as follows.

(1) The sheet processing system is provided with: the plural sheet processing devices (e.g., the printer 300, the sheet stacker 500*a*, the inserter 600*a*, the finisher 700*a* and the bookbinder 800*a*) having the sheet processing functions; the primary sheet conveyance path (e.g., the horizontal conveyance paths 502 and 612 and the binding horizontal conveyance path 812) for conveying the sheets outputted from one of the plural sheet processing devices, to another sheet processing device; the secondary sheet conveyance path (e.g., the second horizontal conveyance paths 546, 646 and 846) disposed independently of the primary sheet conveyance path for conveying the sheets between the plural sheet processing devices; and the controller for controlling the plural sheet processing devices. The controller uses the primary sheet conveyance path to execute one job, and uses the secondary sheet conveyance path to execute another job in parallel with that one job.

As a result, it is possible to enhance the productivity of the sheet processing system.

(2) The primary sheet conveyance path provides communication from the sheet processing device (e.g., the printer 300) arranged most upstream of the sheet conveyance direction to the sheet processing device (e.g., the finisher 700*a*) arranged most downstream. The secondary sheet conveyance path (e.g., the second horizontal conveyance path 646) conveys the sheets from one sheet processing device (e.g., the inserter 600*a*) to another adjoining sheet processing device (e.g., the bookbinder 800*a*).

As a result, it is possible to execute the plural different jobs simultaneously.

(3) Each of the plural sheet processing devices is provided with the primary sheet conveyance path and the secondary sheet conveyance path so that the primary sheet conveyance path and the secondary sheet conveyance path are formed by connected the plural sheet processing devices.

(4) In the sheet processing device (e.g., the finisher 700*a*) arranged most downstream of the sheet conveyance direction, the primary sheet conveyance path and the secondary sheet conveyance path merge into each other.

As a result, the sheet processing devices (e.g., the sheet stacker 500*a*, the inserter 600*a* and the bookbinder 800*a*) can be freely arrayed/combined according to the contents of the bookbinding works. Moreover, another sheet processing device can be additionally connected. Therefore, these sheet processing devices constructing the sheet processing system are enabled to match the various bookbinding works by combining them freely according to the spaces for their installations and the contents of the bookbinding works.

(5) The primary sheet conveyance path (e.g., the horizontal conveyance path 502) is equipped with the primary sheet conveying means (e.g., the conveyance roller pairs 503, 504 and 505), and the secondary sheet conveyance path (e.g., the second horizontal conveyance path 546) is equipped with the secondary sheet conveying means (e.g., the conveyance roller pairs 543, 544 and 545). The controller controls the primary sheet conveying means and the secondary sheet conveying means independently of each other.

As a result, it is possible to execute the two different jobs in parallel.

(6) The sheet processing system is preferably provided with: the first sheet processing module (e.g., the conveyance roller pairs 503, 504 and 505, and the horizontal path conveying motor M51 acting as the drive source for the roller pairs) to be used for that one job; the second sheet processing module (e.g., the conveyance roller pairs 643, 644 and 645, and the second horizontal path conveying motor M52 acting as the drive source for the roller pairs) to be used for that another job; the first cover member (e.g., the cover 551) for covering the first sheet processing module; the second cover member (e.g., the cover 654) for covering the second sheet processing module; and the sensors for detecting the opened/closed states of the individual cover members. On the basis of the signals of the sensors, the controller makes the stops of the first sheet processing module and the second sheet processing module independently of each other.

Therefore, even if the cover (e.g., the cover 551) covering any of the process modules (e.g., the conveyance roller pairs 503, 504 and 505) is opened for the reasons of the jam-clearing, parts-replacing, cleaning, adjusting, sheet supplying operation or the like while the plural jobs are being executed in parallel, the stop of the drive occurs only at the process module (e.g., the conveyance roller pairs 503, 504 and 505) which needs the maintenance. Therefore, the drives of the individual sheet processing modules (e.g., the conveyance roller pairs 643, 644 and 645) to be used for the another job can be continued to execute the another job.

(7) The sheet processing system is provided with at least one of the partition for partitioning the first sheet processing module and the other portions, and the partition for partitioning the second sheet processing module and the other portions.

As a result, it is possible to prevent the execution of the other job from being obstructed (by the touch of the sheets being conveyed or the path sensors) by making access from the side of the first sheet processing module to the side of the second sheet processing module.

(8) The sheet processing system is provided with the partition for partitioning the sheet processing device for executing that one job and the sheet processing device for executing the another job.

As a result, it is possible to prevent the execution of the job of the other sheet processing device (e.g., the finisher 700*a*) from being obstructed (by the touch of the sheets being conveyed or the path sensors) by making access from the side of the one sheet process device (e.g., the sheet stacker 500*a*) to the side of the other sheet process device.

(9) The sheet processing device is either the sheet output device for outputting the sheets or the post-processing device for subjecting the sheets outputted from the sheet output device to the post-processing.

(10) The sheet output device is; the image forming apparatus (device) (e.g., the printer 300) for forming images on the sheets and outputted the sheets; the inserter device (e.g., the inserter 600*a*) for outputting the sheets without forming any image; the buffer device (e.g., the sheet stacker 500*a*) for re-outputting the outputted sheets after a temporary standby;

or the sheet feeding device (e.g., the cassettes 114 and 115) for feeding the sheets to another sheet processing device.

(11) The post-processing device is: the punching device (e.g., the finisher 700*a*) for punching the sheets; the stapling device (e.g., the finisher 700*a*) for stapling the sheet; the storing device for storing the sheets; the aligning device (e.g., the finisher 700*a*) for aligning the sheets; the folding device (e.g., the finisher 700*a*) for folding the sheets; or the bookbinding device (e.g., the bookbinder 800*a*) for bookbinding the sheets.

Here, the first to third embodiments have been described on the construction, in which the conveyance of the sheets either from the sheet output device to the adjoining sheet output device or from the sheet output device to the adjoining sheet post-processing device is performed via the secondary sheet conveyance path. Despite of this description, however, the sheets may also be conveyed to a more downstream sheet processing device by connecting the secondary sheet conveyance path (e.g., the second horizontal conveyance paths 646 and 546 in FIG. 2) belonging to each sheet processing device.

Fourth to sixth embodiments of the invention will be described in the following. The constructions common to those of the first to third embodiments are designated by the common reference numerals, and their detailed description is omitted.

Fourth Embodiment

Figure 20:
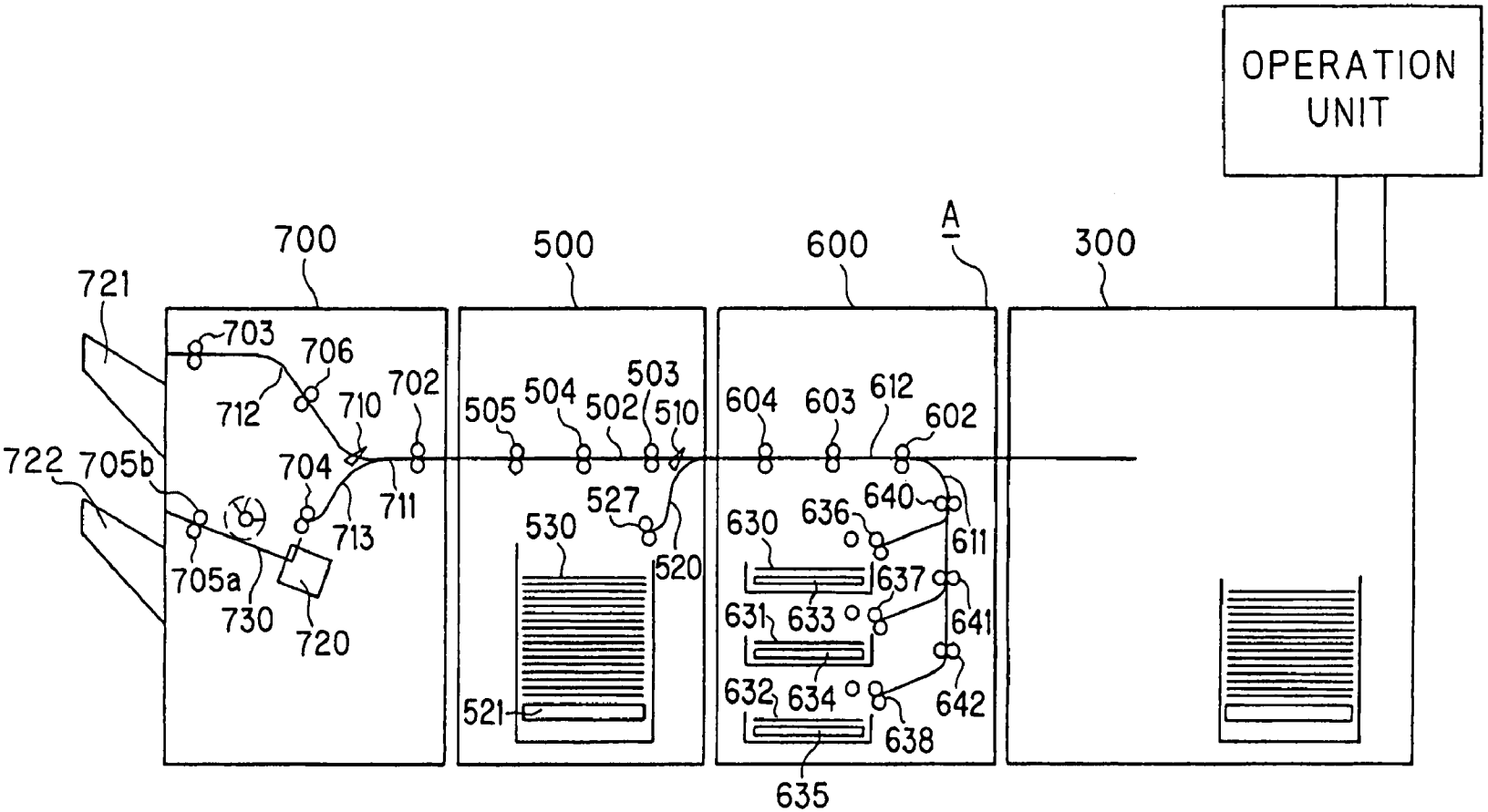
FIG. 20 is a schematic construction diagram showing an internal construction of a sheet processing system according to a fourth embodiment.

FIG. 20 is a schematic construction diagram showing an internal construction of a sheet processing system according to a fourth embodiment of the invention.

The sheet processing system of this embodiment is provided with a plurality of sheet processing devices having different sheet processing functions. In this embodiment, four sheet processing devices of a printer 300, an inserter 600, a sheet stacker 500 and a finisher 700 are sequentially connected in tandem. Here, the printer 300 is disposed in the image forming device 10 as in the first embodiment.

<Inserter 600>

The inserter 600 inserts a special sheet (e.g., color copy paper) such as a cover or a tab into the head page or an intermediate page of the sheets outputted from the printer 300. The inserter 600 itself does not form any image on the sheets. The inserter 600 is equipped, as shown in FIG. 20, with: a horizontal conveyance path 612 acting as a conveyance path for guiding the sheets discharged from the printer 300, into the sheet stacker 500 or the finisher 700; conveyance roller pairs 602, 603 and 604 disposed on the horizontal conveyance path 612; sheet storages 630, 631 and 632 for storing special sheets such as covers or tabs; sheet separators 636, 637 and 638 for feeding the special sheets stored in the sheet storages 630, 631 and 632; a vertical conveyance path 611 for guiding the special sheets fed from the sheet storages 630, 631 and 632, to the horizontal conveyance path 612; and conveyance roller pairs 640, 641 and 642 disposed on the vertical conveyance path 611.

<Sheet Stacker 500>

The sheet stacker 500 is a buffer device for temporarily storing the sheets outputted from another sheet output device (e.g., the printer 300 or the inserter 600) and for subsequently outputting them again. The sheet stacker 500 is equipped, as shown in FIG. 20, with: a horizontal conveyance path 502 acting as a conveyance path for introducing the sheets discharged from the printer 300 or the inserter 600, into the finisher 700; conveyance roller pairs 503, 504 and 505 disposed on the horizontal conveyance path 502 for conveying the sheets; a flapper 510 disposed on the entrance side of the horizontal conveyance path 502 (i.e., on the side of the inserter 600); a sheet stacking unit 530 capable of storing the sheets outputted from the printer 300 or the inserter 600; and a path 520 for introducing the sheets outputted from the printer 300 or the inserter 600 into the sheet stacking unit 530.

Figure 21:
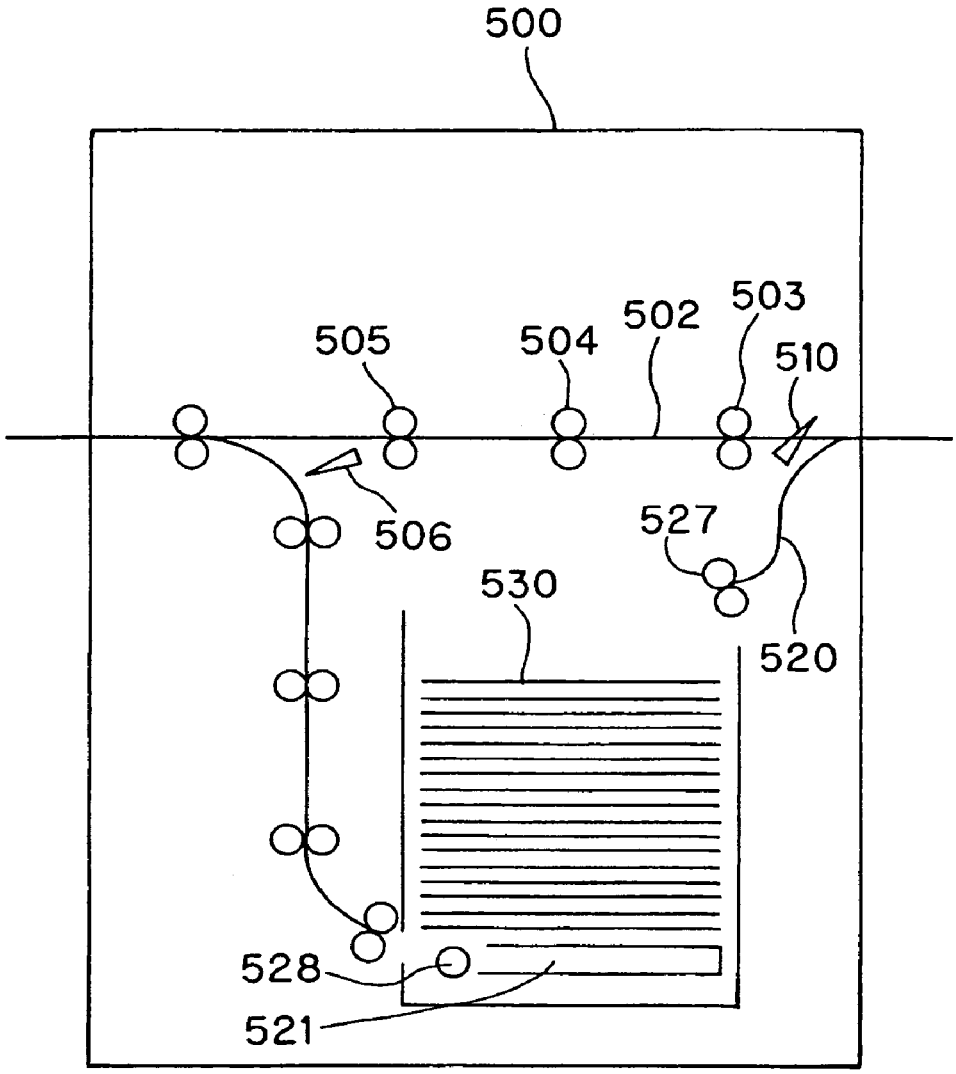
FIG. 21 is a diagram showing a modification of the sheet stacker.

In case the sheet stacker 500 performs the sheet stacking operation, the flapper 510 is switched to the position, in which it blocks the introduction of the sheets into the horizontal conveyance path 502. As a result, the sheets discharged from the printer 300 are guided to the path 520. The sheets thus guided to the path 520 are sequentially stacked in the sheet stacking unit 530. As shown in FIG. 21, a sheet stacker 500 may also be provided with the re-feed means (or the re-feed roller) 528. The sheets stacked in the sheet stacking unit 530 are returned again to the horizontal conveyance path 502 by the re-feed means 528 and are conveyed to the finisher 700.

In case the sheets are not stacked in the sheet stacking unit 530, on the other hand, the flapper 510 is switched to the position, in which it blocks the introduction of the sheets to the path 520. As a result, the sheets discharged from the printer 300 are conveyed through the horizontal conveyance path 502 to the finisher 700.

Here, though not shown in figures, it is also preferable to provide a separate path for conveying the sheets temporarily stacked in the sheet stacking unit 530, to the finisher 700. In this case, it is possible to adjust/control the processing capacities between the printer 300, and the inserter 600 and the finisher 700. On the other hand, the sheet stacker 500 may be provided with not the buffer function but only the sheet stacking function.

<Finisher 700>

The finisher 700 performs a sorting operation, a stapling operation, a punching operation and so on. The finisher 700 is equipped, as shown in FIG. 20, with: a finisher path 711 and an entrance roller pair 702 for introducing the sheets outputted from the sheet stacker 500; a non-sort path 712 not for sorting but for conveying the sheets to a sample tray 721; a sort path 713 for conveying the sheet to a sorter; a switch flapper 710 for switching the non-sort path 712 and the sort path 713 selectively; an intermediate tray 730 for performing the sorting operation, the stapling operation and so on; a stapler 720 for stapling the sheets stacked and arranged on the intermediate tray 730; and a stack tray 722, to which the sheets having been subjected to the sorting operation, the stapling operation and the like on the intermediate tray 730 are discharged.

In the finisher 700 thus constructed, the switch flapper 710 is switched to the position, in which it obstructs the introduction of the sheets into the sort path 713, in case the sorting operation or the like is not performed. The sheets outputted from the sheet stacker 500 are guided into the non-sort path 712 and are discharged onto the sample tray 721 through a conveyance roller pair 706 and a non-sort discharge roller pair 703, which are disposed on the non-sort path 712.

In the case of performing the sorting operation and so on, on the other hand, the switch flapper 710 is switched to the position, in which it blocks the introduction of the sheets into the non-sort path 712. The sheets thus outputted from the sheet stacker 500 are guided into the sort path 713 and are stacked in a bundled shape on the intermediate tray 730 through a sort discharge roller 704. Moreover, the sheets stacked on the intermediate tray 730 are properly subjected to an arranging operation, the stapling operation, the punching operation or the like and are then discharged through a pair of discharge rollers 705*a*, 705*b* onto the stack tray 722. Here, the stack tray 722 is constructed to run properly by itself in the vertical directions.

<Armor Cover Construction>

Figure 22:
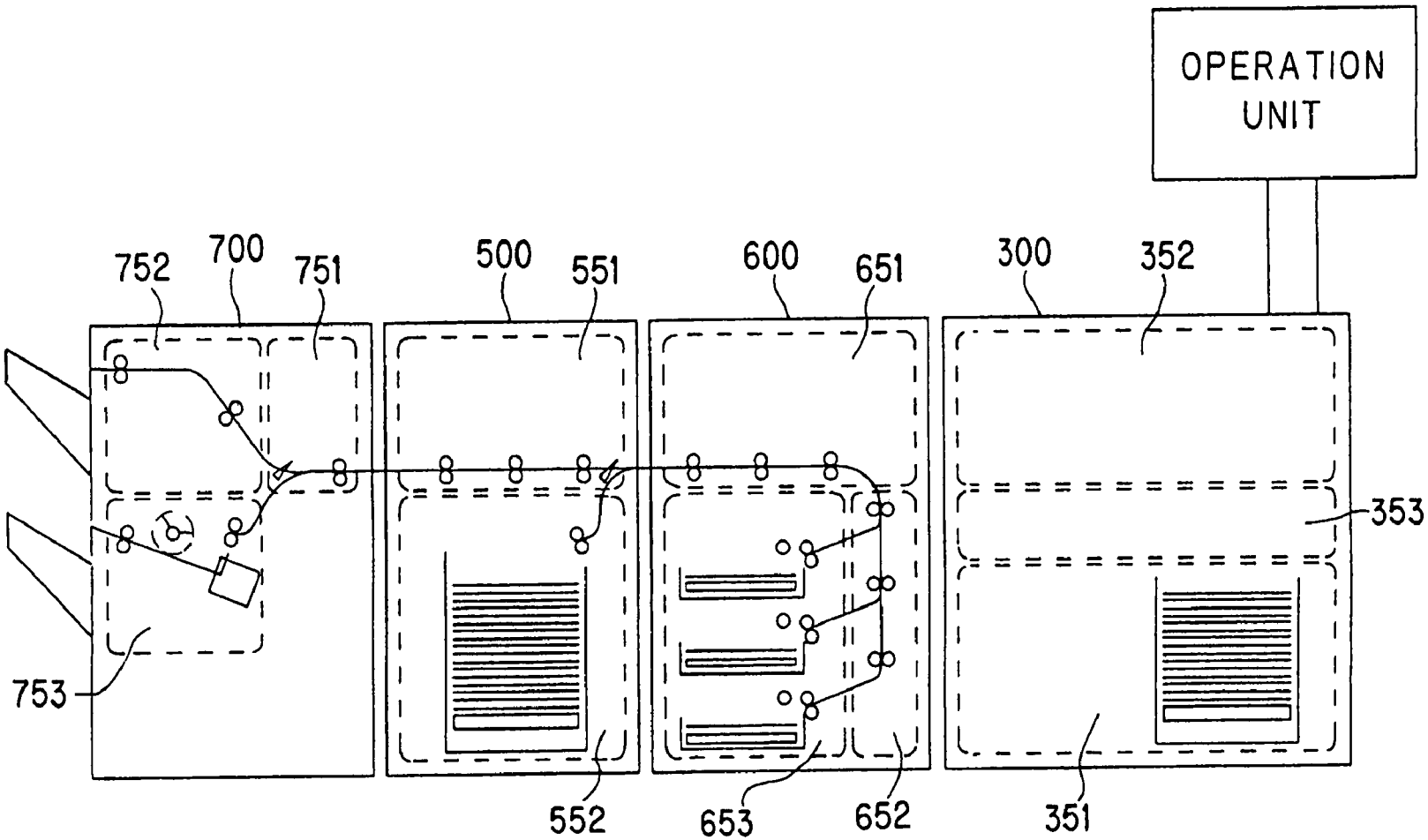
FIG. 22 is a schematic construction diagram showing a construction of cover members.

FIG. 22 is a schematic construction diagram showing the construction of the armor covers of the printer 300, the inserter 600, the sheet stacker 500 and the finisher 700.

The sheet processing system of this embodiment is provided with cover members (as will be called the "covers") for opening the individual insides of the sheet processing devices (i.e., the printer 300, the inserter 600, the sheet stacker 500 and the finisher 700).

The sheet stacker 500 is equipped with: a cover 551 for covering the horizontal conveyance path 502; and a cover 552 for covering the sheet stacking unit 530. These covers 551 and 552 can be opened/closed independently of each other. The opened/closed states of the covers 551 and 552 are detected by cover opening/closing detection sensors S54 and S55, respectively (as referred to FIG. 23).

These covers 551 and 552 are opened/closed at the time of clearing the jam of the sheet stacker 500 or at the time of maintenances for parts-replacing, cleaning, adjusting or sheet extracting operation or the like.

The inserter 600 is equipped with: a cover 651 for covering the horizontal conveyance path 612; a cover 652 for covering the vertical conveyance path 611; and a cover 653 for covering the sheet stackers 630, 631 and 632 and the sheet separators 636, 637 and 638. These covers 651, 652 and 653 can be opened/closed independently of one another. The opened/closed states of the covers 651, 652 and 653 are detected by cover opening/closing detection sensors S64, S65 and S66, respectively (as referred to FIG. 24).

These covers 651, 652 and 653 are opened/closed at the jam clearing time or at the time of maintenances for parts-replacing, cleaning, adjusting or sheet supplying operation or the like.

The finisher 700 is equipped with: a cover 751 for covering the finisher path 711; a cover 752 for covering the non-sort path 712; and a cover 753 for covering a stapling unit including the stapler 720. The covers 751, 752 and 753 can be opened/closed independently of one another. The opened/closed states of the covers 751, 752 and 753 are detected by cover opening/closing detection sensors S74, S75 and S76, respectively (as referred to FIG. 25).

These covers 751, 752 and 753 are opened/closed at the jam clearing time or at the time of maintenances for parts-replacing, cleaning, adjusting or sheet supplying operation or the like.

The construction of the covers of the printer 300 is similar to that of the first embodiment.

<Configuration of Controller>

The entire configuration of a controller for controlling the sheet processing system is similar to that (as referred to FIG. 5) of the first embodiment. Here will be described the configuration of the control units of the individual sheet processing devices.

<Configuration of Sheet Stacker Control Unit>

Figure 23:
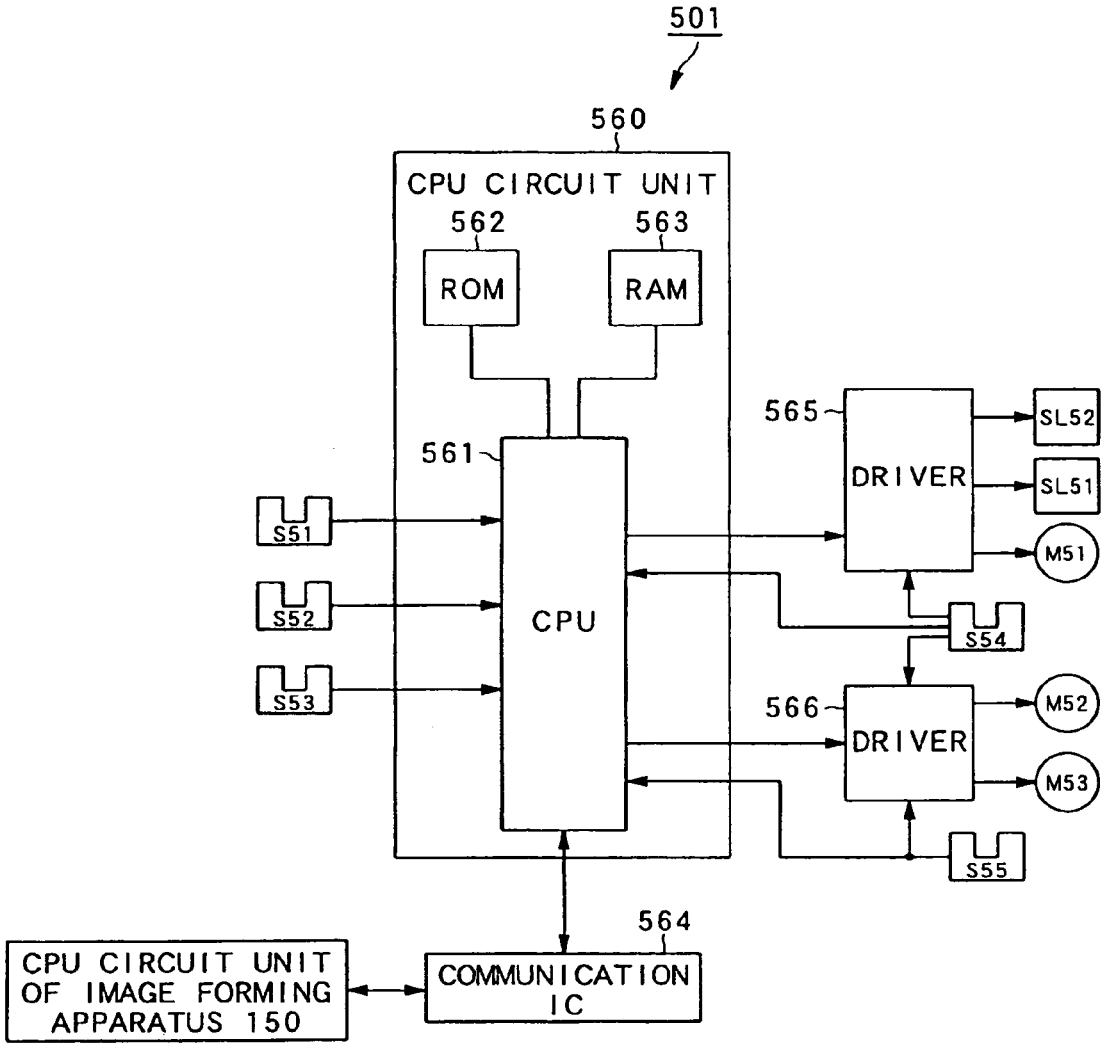
FIG. 23 is a block diagram showing a configuration of a sheet stacker control unit for controlling the drive of the sheet stacker.

FIG. 23 is a block diagram showing a configuration of the sheet stacker control unit 501 for controlling the drive of the sheet stacker 500.

As shown in FIG. 23, the sheet stacker control unit 501 includes a CPU circuit unit 560, which is configured of a CPU 561, a ROM 562 and a RAM 563. The CPU circuit unit 560 communicates and exchanges data with the CPU circuit unit 150 disposed on the side of the image forming device 10, through a communication IC 564, and executes various programs stored in the ROM 562, on the basis of an instruction coming from the CPU circuit unit 150 thereby to control the drive of the sheet stacker 500. To the CPU circuit unit 560, there are inputted the detection signals coming from various path sensors S51, S52 and S53 for detecting the delay and jam of the sheets being conveyed, and the detection signals coming from the cover opening/closing detection sensors S54 and S55.

With the CPU circuit unit 560, there are connected drivers 565 and 566.

The driver 565 drives a motor M51 and solenoids SL51 and SL52 of a conveying module on the basis of signals coming from the CPU circuit unit 560.

The driver 566 drives motors M52 and M53 of a stack module on the basis of signals coming from the CPU circuit unit 560.

Here, the conveying module is configured of: the conveyance roller pairs 503, 504 and 505 disposed in the sheet stacker 500; the horizontal path conveying motor M51 acting as the drive source for the roller pairs; and the solenoid SL51 for switching the flapper 510 and the solenoid SL52 for switching a flapper 506.

Moreover, the stack module is configured of: the sheet stacking plate motor M52 acting as the drive source for a sheet stacking plate 521 composing the sheet stacking unit 530; and the sheet stacking/conveying motor M53 acting as the drive source for a conveyance roller 527 disposed on the path 520.

In case the open state of the cover 551 is detected with the detection signal coming from the cover opening/closing detection sensor S54, the power of the driver 565 is turned OFF to stop the drive of the conveying module forcibly. Simultaneously with this, the power of the driver 566 is turned OFF to stop the drive of the stack module forcibly, too.

In case the open state of the cover 552 is detected with the detection signal coming from the cover opening/closing detection sensor S55, on the other hand, only the power of the driver 566 is turned OFF to stop only the drive of the stack module forcibly.

<Configuration of Feeder Control Unit>

Figure 24:
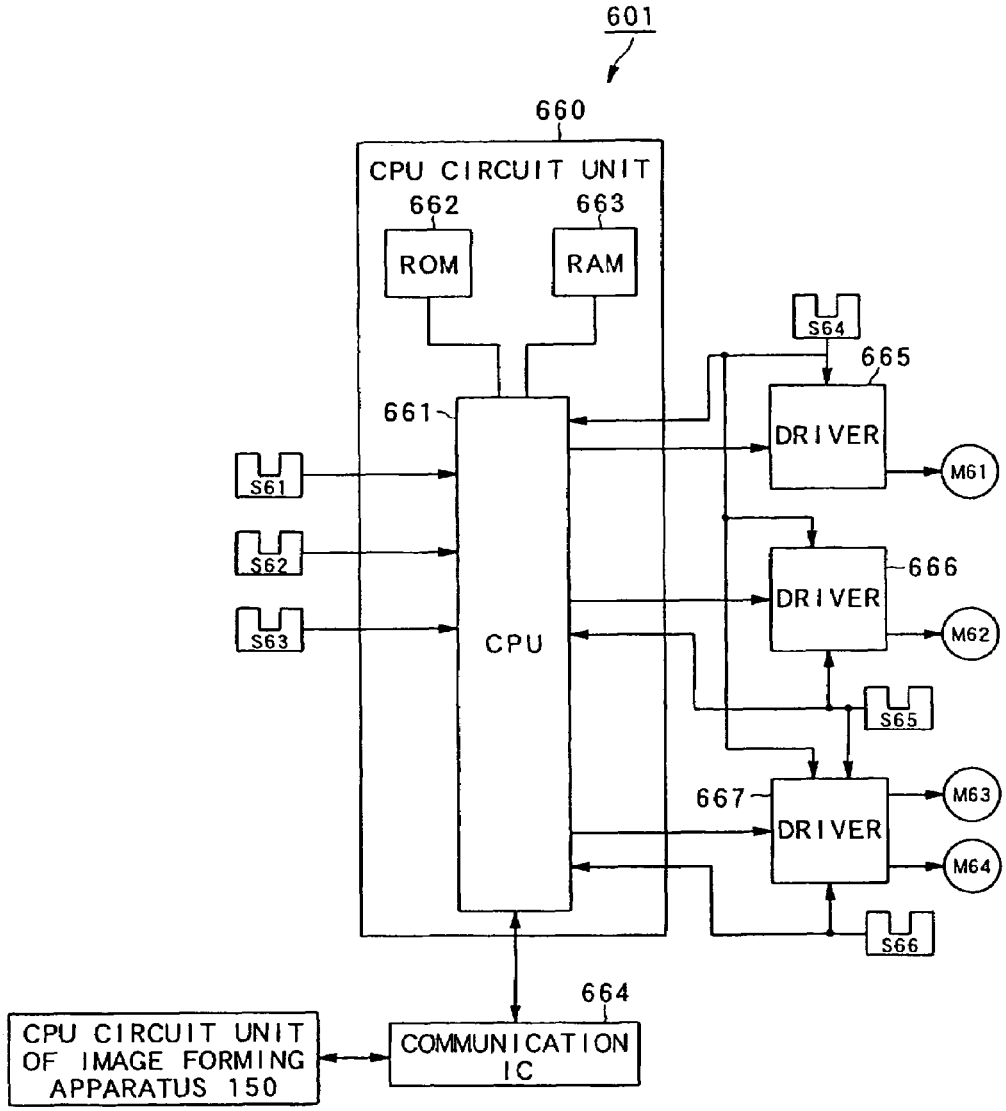
FIG. 24 is a block diagram showing a configuration of an inserter control unit for controlling the drive of the inserter.

FIG. 24 is a block diagram showing a configuration of the inserter control unit 601 for controlling the drive of the inserter 600.

As shown in FIG. 24, the inserter control unit 601 includes the CPU circuit unit 660, which is configured of a CPU 661, a ROM 662 and a RAM 663. The CPU circuit unit 660 communicates and exchanges data with the CPU circuit unit 150 disposed on the side of the image forming device 10, through a communication IC 664, and executes various programs stored in the ROM 662, on the basis of an instruction coming from the CPU circuit unit 150 thereby to control the drive of the inserter 600. To the CPU circuit unit 660, there are inputted the detection signals coming from various path sensors S61, S62 and S63, and the detection signals coming from the cover opening/closing detection sensors S64, S65 and S66.

With the CPU circuit unit 660, there are connected drivers 665, 666 and 667.

The driver 665 drives a motor M61 of the horizontal conveying module on the basis of a signal coming from the CPU circuit unit 660.

The driver 666 drives a motor M62 of the vertical conveying module on the basis of a signal coming from the CPU circuit unit 660.

The driver 667 drives motors M63 and M64 of a feed module on the basis of a signal coming from the CPU circuit unit 660.

Here, the horizontal conveying module is configured of: the conveyance roller pairs 602, 603 and 604; and the horizontal path conveying motor M61 acting as the drive source for the roller pairs.

Moreover, the vertical conveying module is configured of: conveyance roller pairs 641, 642 and 643; and the vertical path conveying motor M62 acting as the drive source for the roller pairs.

Moreover, the feed module is configured of: the sheet separators 636, 637 and 638; the sheet separator motor M63 acting as the drive source for the separators; and the intermediate plate ascending/descending motor M64 acting as the drive source for ascending/descending intermediate plates 633, 634 and 635.

In case the open state of the cover 651 is detected with the detection signal coming from the cover opening/closing detection sensor S64, the power of the driver 665 is turned OFF to stop the drive of the horizontal conveying module forcibly, and the powers of the drivers 666 and 667 are turned OFF to stop all the drives of the inserter 600 forcibly.

In case the open state of the cover 652 is detected with the detection signal coming from the cover opening/closing detection sensor S65, on one hand, the power of the driver 666 is turned OFF to stop the drive of the vertical conveying module forcibly. Simultaneously with this, the power of the driver 667 is turned OFF to stop the drive of the feed module forcibly, too.

In case the open state of the cover 653 is detected with the detection signal coming from the cover opening/closing detection sensor S66, on the other hand, the power of the driver 667 is turned OFF to stop the drive of the feed module forcibly.

<Configuration of Finisher Control Unit>

Figure 25:
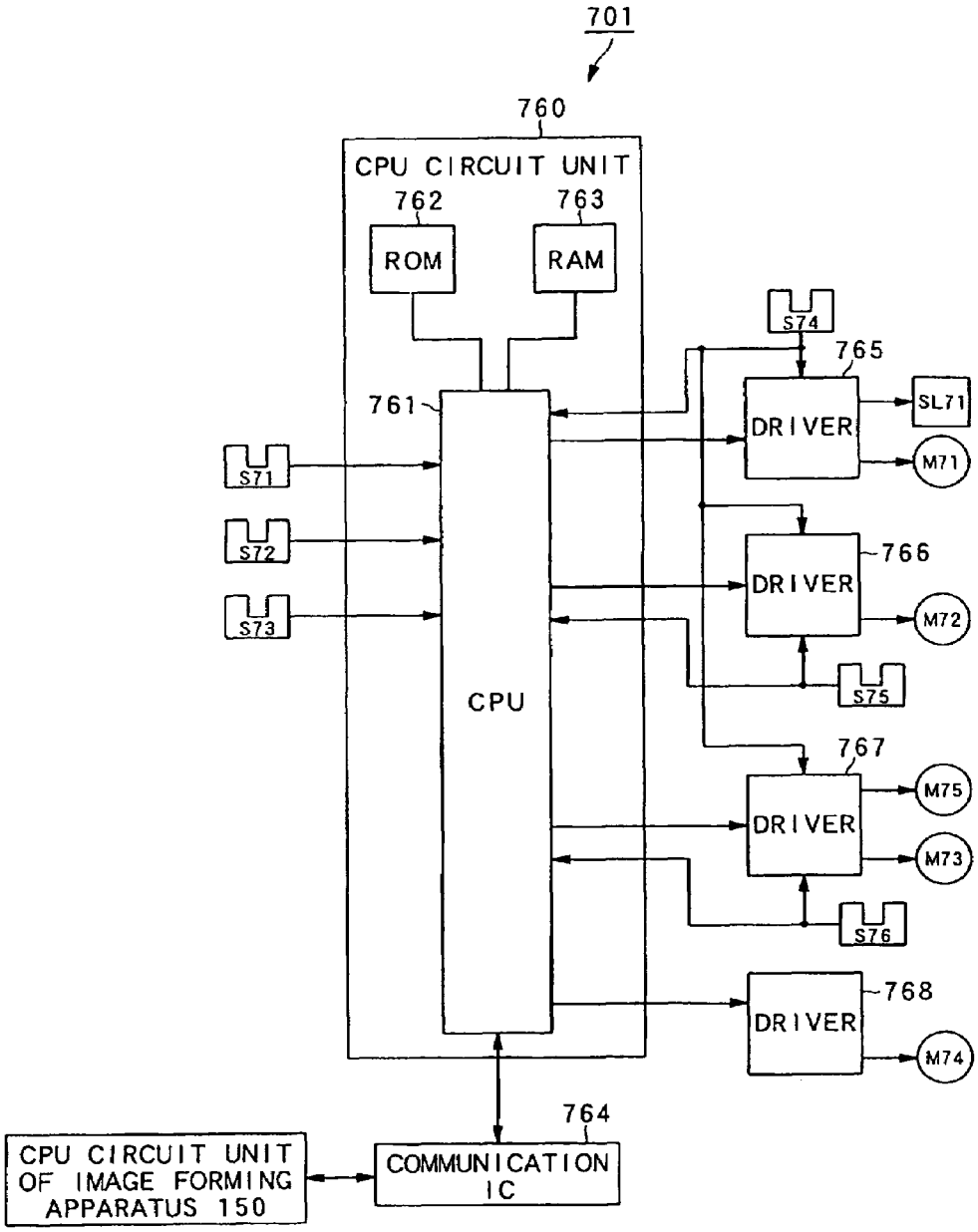
FIG. 25 is a block diagram showing a configuration of a finisher control unit for controlling the drive of the finisher.

FIG. 25 is a block diagram showing a configuration of the finisher control unit 701 for controlling the drive of the finisher 700.

As shown in FIG. 25, the finisher control unit 701 includes the CPU circuit unit 760, which is configured of a CPU 761, a ROM 762 and a RAM 763. The CPU circuit unit 760 communicates and exchanges data with the CPU circuit unit 150 disposed on the side of the image forming device 10, through a communication IC 764, and executes various programs stored in the ROM 762, on the basis of an instruction coming from the CPU circuit unit 150 thereby to control the drive of the finisher 700. To the CPU circuit unit 760, there are inputted the detection signals coming from various path sensors S71, S72 and S73, and the detection signals coming from the cover opening/closing detection sensors S74, S75 and S76.

With the CPU circuit unit 760, there are connected drivers 765, 766, 767 and 768.

The driver 765 drives a motor M71 and a solenoid SL71 of the conveying module on the basis of signals coming from the CPU circuit unit 760.

The driver 766 drives a motor M72 of the non-sort discharge module on the basis of a signal coming from the CPU circuit unit 760.

The driver 767 drives motors M75 and M73 of a sort discharge module on the basis of a signal coming from the CPU circuit 760.

The driver 768 drives a motor M74 of the stack module on the basis of a signal coming from the CPU circuit unit 760.

Here, the conveying module is configured of: the input roller pair 702; the conveying motor M71 acting as the drive source for the roller pair; and the solenoid SL71 for switching the switch flapper 710.

The non-sort discharge module is configured of: the conveyance roller pair 706; the non-sort discharge roller pair 703; and the discharge motor M72 acting as the drive source for those roller pairs.

Moreover, the sort module is configured of: the sort discharge roller 704; the sort discharge motor M75 acting as the drive source for the roller; a discharge roller pair 705; and the bundle conveying motor M73 acting as the drive source for the roller pair.

Moreover, the stack module is configured of: the stack tray 722; and the tray ascending/descending motor M74 acting as the drive source for the tray.

The conveying motor M71, the non-sort discharge motor M72 and the sort discharge motor M75 are made of a stepping motor, so that they are enabled by controlling an energizing pulse rate to rotate the driving roller pairs at common or individual speeds. On the other hand, the bundle conveying motor M73 is made of a DC motor.

In case the open state of the cover 751 is detected with the detection signal coming from the cover opening/closing detection sensor S74, the power of the driver 765 is turned OFF to stop the drive of the conveying module forcibly. Simultaneously with this, the powers of the drivers 766, 767 and 768 are turned OFF to stop all the drives of the finisher 700 forcibly.

In case the open state of the cover 752 is detected with the detection signal coming from the cover opening/closing detection sensor S75, on one hand, the power of the driver 766 is turned OFF to stop only the drive of the non-sort module forcibly.

In case the open state of the cover 753 is detected with the detection signal coming from the cover opening/closing detection sensor S76, on the other hand, the power of the driver 767 is turned OFF to stop only the drive of the sort module forcibly.

<Description of Operations of Sheet Processing System>

Here are described the operations of the sheet processing system according to this embodiment.

The sheet processing system according to this embodiment is provided with a plurality of sheet processing devices. These sheet processing devices include sheet output devices for outputting the sheets, and a post-processing device for subjecting the sheets outputted from the sheet output device, to a post-processing. This embodiment is provided as the sheet output devices with: the image forming device 10 equipped with the printer 300 for forming images on the sheets and outputting them; the inserter 600 for outputting the sheets without forming the images; the sheet stacker (or the buffer device) 500*b* for re-outputting the once-outputted sheets after a temporary standby; and the sheet feeding devices (i.e., the cassettes 114 and 115) for feeding the sheets to other sheet processing devices. The finisher 700 is provided as the post-processing device.

The sheet processing system combines the plural sheet processing devices arbitrarily to execute the jobs or the sheet processing units. While one job is being executed, moreover, at least one of the sheet processing devices for executing that job is shared to execute the other job. As a result, it is possible to execute the plural jobs in parallel.

Figure 26:
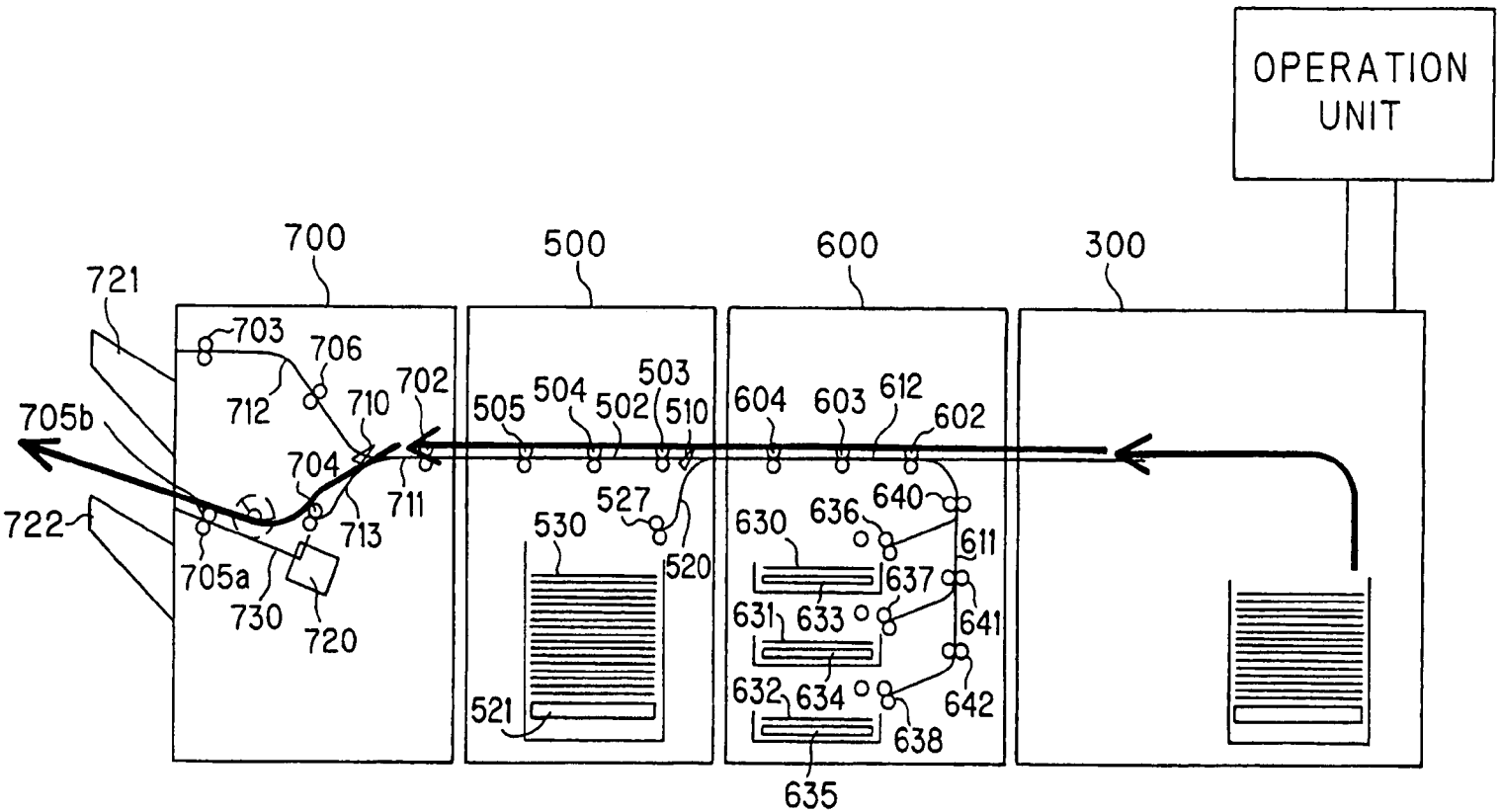
FIG. 26 is a diagram for explaining a first job of the sheet processing system.

FIG. 26 is a diagram for explaining the first job.

The first job is a bookbinding job to be executed by combining the printer 300, the inserter 600, the sheet stacker 500 and the finisher 700. In this bookbinding job, the sheets having images formed by the printer 300 are bundled and stapled into a plurality of pages by the finisher 700 and are then outputted. The process of the first job of this embodiment is similar to the first job (as referred to FIG. 9) in the first embodiment, and its detailed description is omitted.

Figure 27:
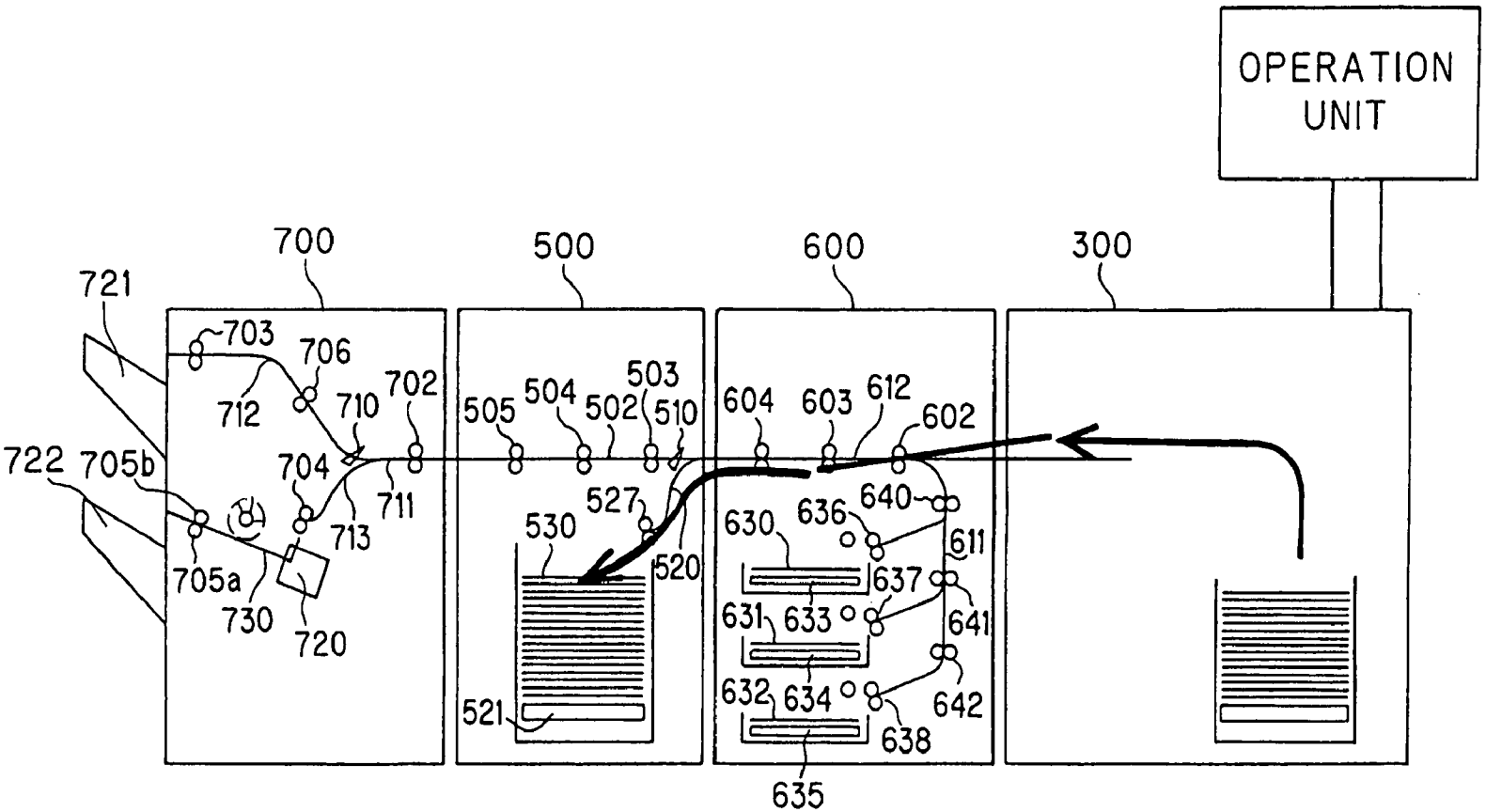
FIG. 27 is a diagram for explaining a second job of the sheet processing system.

FIG. 27 is a diagram for explaining a second job.

The second job is a job to be executed by the printer 300, the inserter 600 and the sheet stacker 500. In this job, the sheets having images formed by the printer 300 are stacked on the sheet stacker 500. The process of the second job of this embodiment is similar to the second job (as referred to FIG. 10) in the first embodiment, and its detailed description is omitted.

Figure 28:
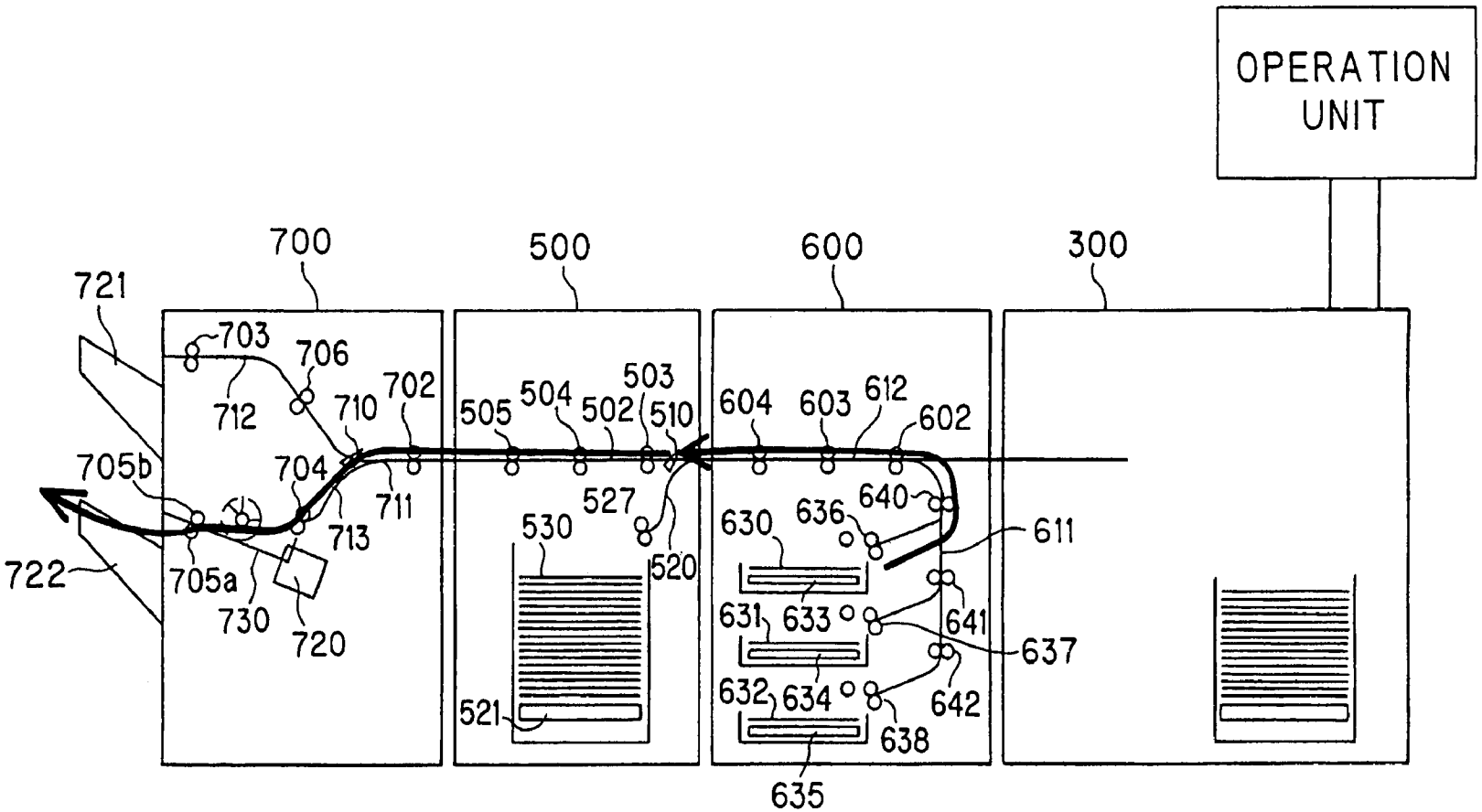
FIG. 28 is a diagram for explaining a third job of the sheet processing system.

FIG. 28 is a diagram for explaining a third job.

The third job is executed by combining the inserter 600, the sheet stacker 500 and the finisher 700. In the third job, specifically, the special sheets (e.g., color copies) stored in the inserter 600 are bundled and stapled into a plurality of pages by the finisher 700 and are then outputted.

In the case of executing the third job, the CPU circuit unit 150 of the image forming device 10 causes the CPU 661 of the inserter 600 to activate the sheet separator motor M63 and the intermediate ascending/descending motor M64 of the feed module. As a result, the sheet separators 636, 637 and 638 and the intermediate plates 633, 634 and 635 are driven.

Moreover, the CPU circuit unit 150 of the image forming device 10 causes the CPU 561 of the sheet stacker 500 to activate the solenoid SL51 and the motor M51 of the conveying module. As a result, the flapper 510 is switched to the position to block the introduction of the sheets into the path 520, and the conveyance roller pairs 503, 504 and 505 are driven.

Moreover, the CPU circuit unit 150 causes the CPU 761 of the finisher 700 to activate the solenoid SL71, the conveying motor M71 of the conveying module, the sort discharge motor M75, the bundle conveying motor M73 and the tray ascending/descending motor M74. As a result, the switch flapper 710 is switched to the position to obstruct the introduction of the sheets into the non-sort path 712, and the entrance roller pair 702, the sort discharge roller pair 704, the discharge roller pair 705 and the stack tray 722 are driven.

By thus controlling the sheet processing system, the special sheets such as the color copies fed from the inserter 600 are conveyed to the intermediate tray 730 of the finisher 700 through the horizontal conveyance path 502 of the sheet stacker 500, and are stacked in the intermediate tray 730. Moreover, the special sheets stacked in a bundle shape on the intermediate tray 730 are stapled, after aligned, by the stapler 720 and are discharged onto the stack tray 722.

Here, the stapler 720 can select the stapling or punching process or the like properly.

Figure 29:
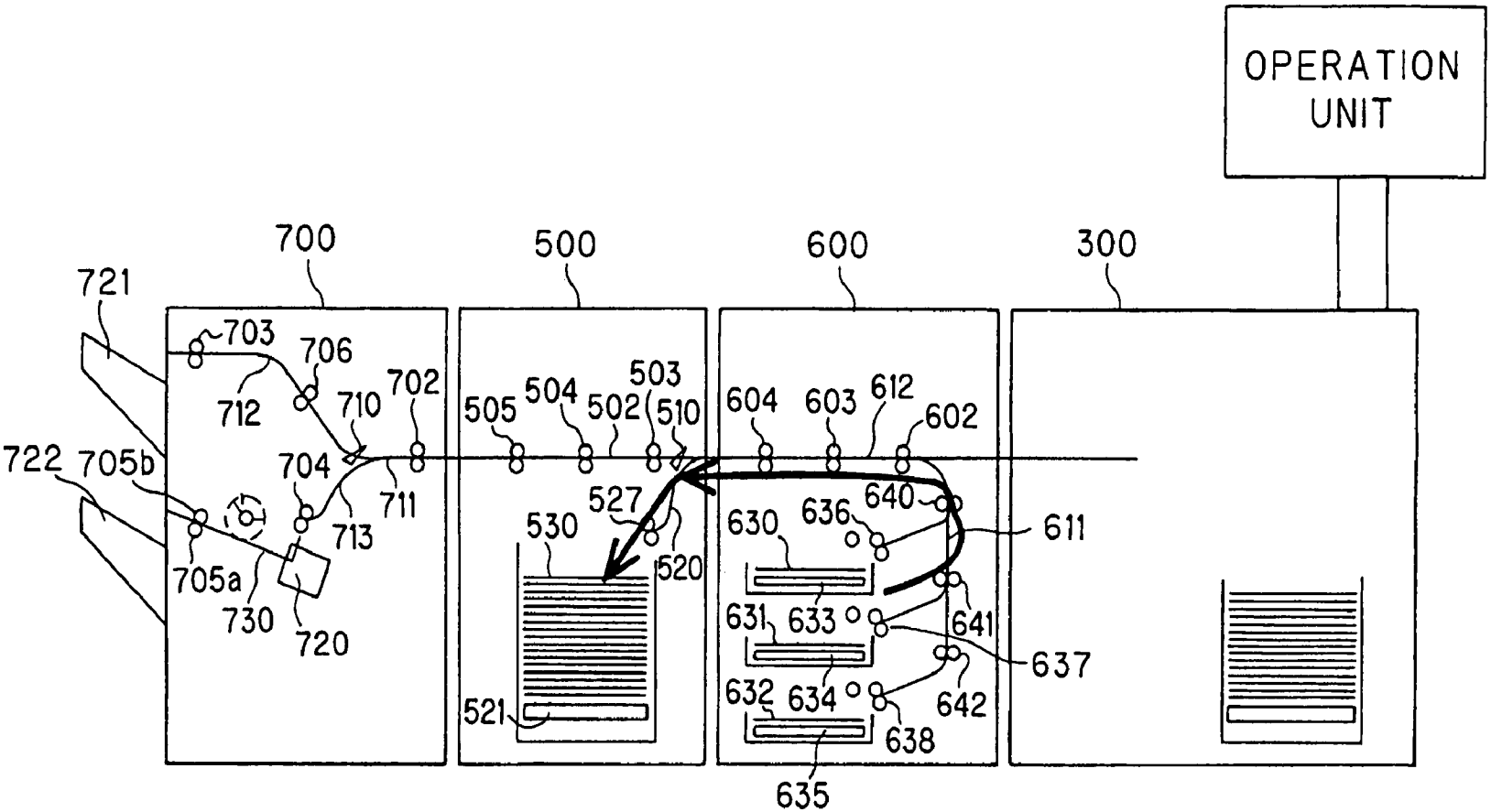
FIG. 29 is a diagram for explaining a fourth job of the sheet processing system.

FIG. 29 is a diagram for explaining a fourth job.

The fourth job is a job to be executed by combining the inserter 600 and the sheet stacker 500. In this fourth job, the special sheets (e.g., the color copies) stored in the inserter 600 are stacked in the vertical conveyance path 542 of the sheet stacker 500. The sheets outputted from the inserter 600 are temporarily stacked in the sheet stacker 500 so that the processing capacities can be adjusted and controlled among the printer 300, the inserter 600 and the finisher 700.

In the case of executing the fourth job, the CPU circuit unit 150 of the image forming device 10 causes the CPU 561 of the sheet stacker 500 to activate the solenoid SL 51, the motor M53 of the sheet stacking module and the sheet stacking plate motor M52. As a result, the flapper 510 is switched to the position to block the introduction of the sheets into the horizontal conveyance path 502, and the conveyance roller 527 and the sheet stacking plate 521 are driven.

Moreover, the CPU circuit unit 150 of the image forming device 10 causes the CPU 661 of the inserter 600 to activate the sheet separator motor M63 and the intermediate plate ascending/descending motor M64 of the feed module and the horizontal path conveying motor M61 of the horizontal conveying module. As a result, the sheet separators 636, 637 and 638 and the intermediate plates 633, 634 and 635, and the roller pairs 602, 603 and 604 of the horizontal conveyance path 612 are driven.

By thus controlling the sheet processing system, the special sheets such as the color copies fed from the inserter 600 are stacked in the sheet stacking unit 530 through the conveyance path 520 of the sheet stacker 500. At this time, the sheet stacking plate 521 is descended properly according to the number of stacked sheets.

<Parallel Execution of Plural Jobs>

Here will be described one example of the operations at the time when the plural jobs are executed in parallel in the sheet processing system according to this embodiment.

Here are described the operations to execute in parallel: the first job (in which the sheets having the images formed by the printer 300 are conveyed to the finisher 700 and are bundled and stapled into the plural pages by the finisher 700 so that the stapled sheets are outputted); and the fourth job (in which the special sheets (e.g., the color copies) stored in the inserter 600 are conveyed to the sheet stacker 500 and are stacked in the sheet stacker 500).

First of all, the CPU circuit unit 150 of the image forming device 10 decides whether or not the sheets relating to the execution of the fourth job can be conveyed between the sheets of the first job.

In case it is decided that the conveyance of the sheets is possible, moreover, the CPU circuit unit 150 starts the execution of the fourth job. At this time, the CPU circuit unit 150 activates the individual drive lines for executing the first job and the fourth job.

In case it is decided that the conveyance of the sheets is impossible, on the contrary, the CPU circuit unit 150 does not execute the fourth job but displays that information in the operation display device 400.

Here, similar controls are made, too, in case the execution of the first job is designated during the execution of the fourth job.

In the operations described above, at least one of the plural sheet processing devices to execute one job is shared to execute the other job in parallel by interrupting that one job being executed, by that other job.

In short, the horizontal conveyance path 612 or the sheet conveyance path of the inserter 600 is shared between the first job and the fourth job. This will be described in detail.

For example, the sheets to be used in the first job are designated by A1, A2, A3, A4, A5, . . . , and so on in the conveyance order, and the sheets to be used in the fourth job are designated by B1, B2, B3, B4, B5, . . . , and so on in the conveyance order.

At first, the sheet A1 to be used in the first job is outputted from the printer 300 and passes the horizontal conveyance path 612 of the inserter 600 and then the horizontal conveyance path 502 of the sheet stacker 500.

When the trailing end of the sheet A1 passes over the horizontal conveyance path 612, the inserter 600 starts the feed of the sheet B1 to be used in the fourth job. The sheet B1 passes over the horizontal conveyance path 612 and is guided into the path 520 of the sheet stacker 500 so that it is stacked in the sheet stacking unit 530.

When the trailing end of the sheet B1 passes over the horizontal conveyance path 612, the next sheet A2 to be used in the first job is outputted from the printer 300 and is guided into the horizontal conveyance path 612.

When the trailing end of the sheet A2 passes over the horizontal conveyance path 612, the inserter 600 feeds the next sheet B2 to be used in the fourth job, from the inserter 600. Then, the sheet B2 passes over the horizontal conveyance path 612 and is guided into the path 520 of the sheet stacker 500 so that it is stacked in the sheet stacking unit 530.

When the trailing end of the sheet B2 passes over the horizontal conveyance path 612, the sheet A3 to be used in the first job is outputted from the printer 300 and guided into the horizontal conveyance path 612.

Thus, the sheets are caused to pass through the horizontal conveyance path 612 of the inserter 600 in the sequence of A1, B1, A2, B2, A3, B3, A4, B4, . . . , and so on, so that the two jobs can be executed in parallel by sharing the horizontal conveyance path 612 of the inserter 600 and by interrupting the first job by the fourth job.

Naturally, the horizontal conveyance path 612 of the inserter 600 may be used not only in case it is used by turns by the sheets to be used in the two jobs but also alternately. Between the sheets outputted from the printer 300, specifically, the sheets may be conveyed to the horizontal conveyance path 612 in the sequence of sheets A1, A2, B1, A3, A4, B2, A5, A6, B3, . . . , and so on. Between the sheets fed from the inserter 600, moreover, the sheets may pass through the horizontal conveyance path 612 in the sequence of A1, B1, B2, B3, A2, B4, B5, B6, A3, B7, B8, B9, A4, . . . , and so on.

Moreover, at the instant when the trailing end of the sheet A1 passes over not the horizontal conveyance path 612 but the conveyance roller pair 602, for example, the sheet B1 may be introduced into the horizontal conveyance path 612 so that after the trailing end of the sheet A1 passed over the conveyance roller pair 603, the leading end of the sheet B1 may reach the conveyance roller pair 603, and so that after the trailing end of the sheet A1 passed over the conveyance roller pair 604, the leading end of the sheet B1 may reach the conveyance roller pair 604. After the trailing end of the sheet A1 passed over the flapper 510, the flapper 510 can be switched to guide the sheet B1 into the path 520.

Alternatively, at the instant when the trailing end of the sheet B1 passes over the conveyance roller pair 602, the next sheet A2 to be used in the first job may be introduced into the horizontal conveyance path 612, so that after the trailing end of the sheet B1 passed over the conveyance roller pair 603, the leading end of the sheet A2 may reach the conveyance roller pair 603, and so that after the trailing end of the sheet B1 passed over the conveyance roller pair 604, the leading end of the sheet A2 may reach the conveyance roller pair 604.

In short, if the sheet to be used in the first job and the sheet to be used in the fourth job are not conveyed to overlap at the common portion of the horizontal conveyance path 612, the sheets to be used in the individual jobs may be simultaneously conveyed in the horizontal conveyance path 612.

Fifth Embodiment

A fifth embodiment of the invention will be described in the following.

Figure 30:
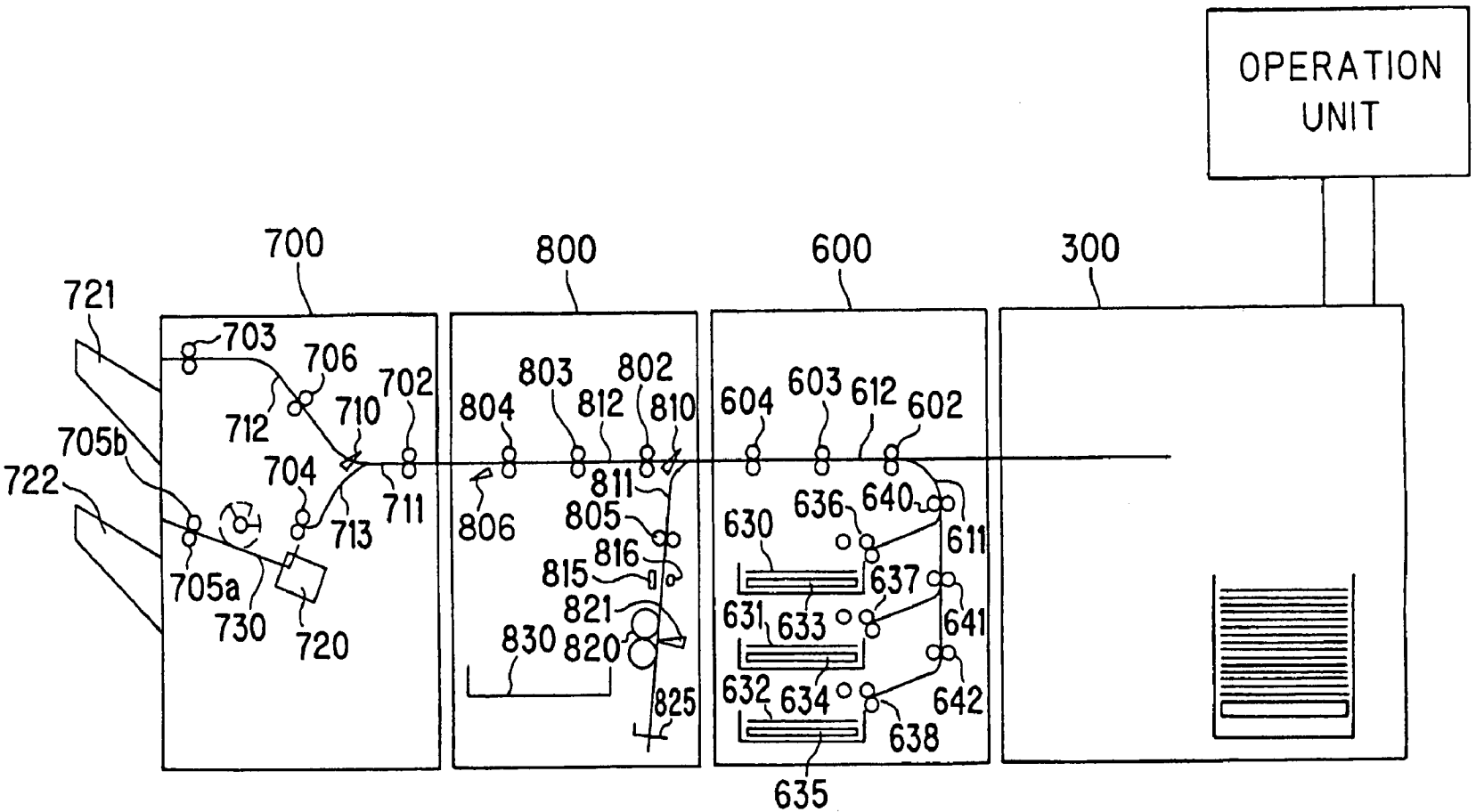
FIG. 30 is a schematic construction diagram showing an internal construction of a sheet processing system according to a fifth embodiment.

FIG. 30 is a schematic construction diagram showing an internal construction of a sheet processing system according to the fifth embodiment of the invention.

The sheet processing system is provided with a plurality of sheet processing devices having individually different sheet processing functions. In this embodiment, the four sheet processing devices of the printer 300, the inserter 600, a bookbinder 800 and the finisher 700 are sequentially connected in tandem.

<Bookbinder 800>

The bookbinder 800 is provided with: a binding horizontal conveyance path or the sheet conveyance path 812 for guiding the sheets outputted from the printer 300 or the inserter 600, to the side of the finisher 700; conveyance roller pairs 802, 803 and 804 disposed on the binding horizontal conveyance path 812; a binding path 811 branched downward from the binding horizontal conveyance path 812; a conveyance roller pair 805 disposed on the binding path 811; a binding path selecting flapper 810 disposed at the entrance portion of the binding horizontal conveyance path 812 for a switching operation to guide the sheets selectively to the side of the binding path 811 or the inserter 600; a flapper 806 disposed on the exit side of the binding horizontal conveyance path 812; two pairs of staplers 815 disposed midway of the binding path 811; anvils 816 arranged at the positions to confront the staplers 815; a roller pair 820 arranged below the staplers 815; a protruding member 821 arranged at the position to confront the folding roller pair 820; a movable sheet positioning member 825 arranged below the folding roller pair 820 for positioning the leading end of the sheets guided on the binding path 811; and a binding discharge tray 830.

In the case of executing the bookbinding job, the sheets outputted from the printer 300 or the inserter 600 are guided into the binding path 811. These sheets are conveyed so far as their leading end comes into contact with the movable sheet positioning member 825, and are once stored.

Then, the sheet bundle stored on the binding path 811 is protruded to the folding roller pair 820 by the protruding member 821 so that they are folded by the folding roller pair 820. The sheet bundle thus folded is discharged through the folding roller pair 820 onto the binding discharge tray 830. In case the sheet bundle stapled by the staplers 815 is to be folded, the positioning member 825 is so properly descended that the stapling position of the sheet bundle may come to the center position of the folding roller pair 820 after the end of the stapling operation.

In case no bookbinding job is performed, on the contrary, the binding path selecting flap 810 is switched to the position to block the introduction of the sheets into the binding path 811. As a result, the sheets are conveyed through the binding horizontal conveyance path 812 to the side of the finisher 700.

In the sheet processing system provided with such bookbinder 800, too, the two jobs can be simultaneously executed among the printer 300, the inserter 600, the bookbinder 800 and the finisher 700, and between the inserter 600 and the bookbinder 800.

In this case, the sheets are conveyed from the inserter 600 to the bookbinder 800 between the sheets conveyed from the printer 300 to the finisher 700 so that the two jobs can be simultaneously executed by sharing the horizontal conveyance path 612 of the inserter 600.

The remaining constructions are similar to those of the sheet processing system according to the aforementioned fourth embodiment, and their description is omitted.

Sixth Embodiment

A sixth embodiment of the invention will be described in the following.

Figure 31:
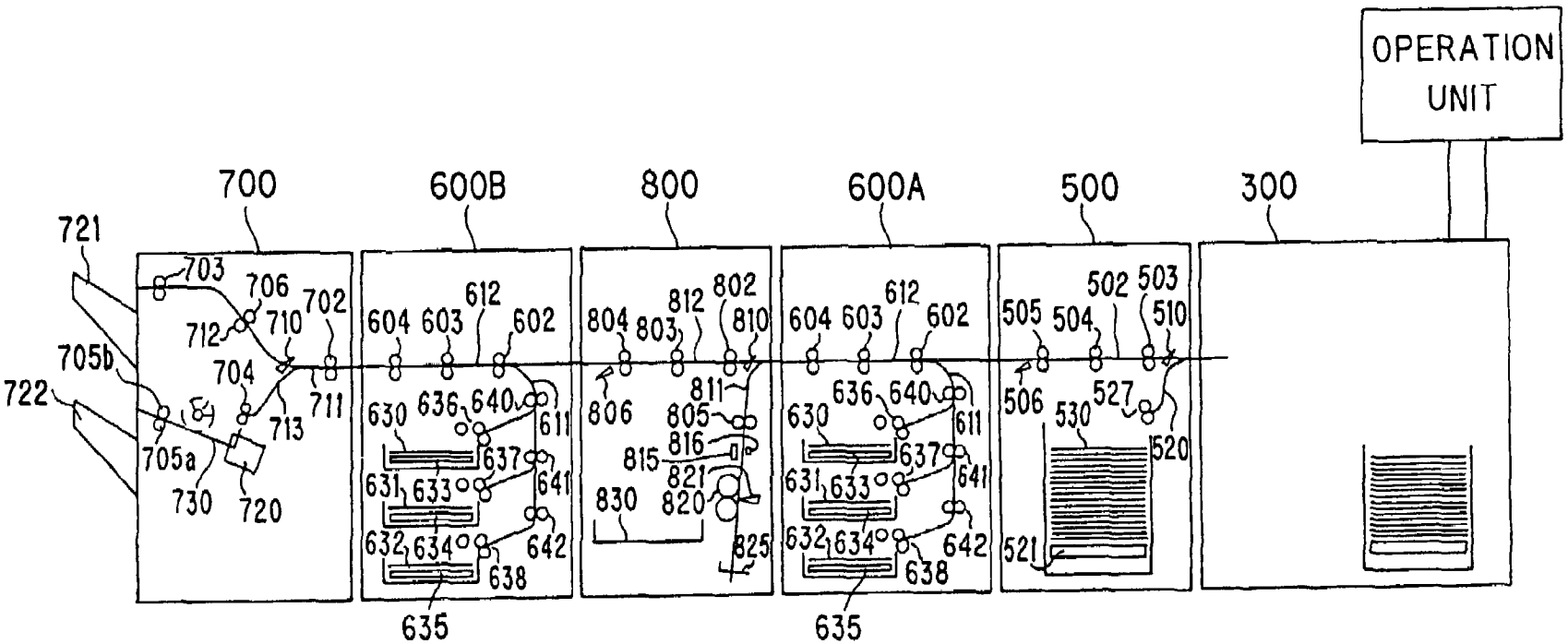
FIG. 31 is a schematic construction diagram showing an internal construction of a sheet processing system according to a sixth embodiment.
Figure 32:
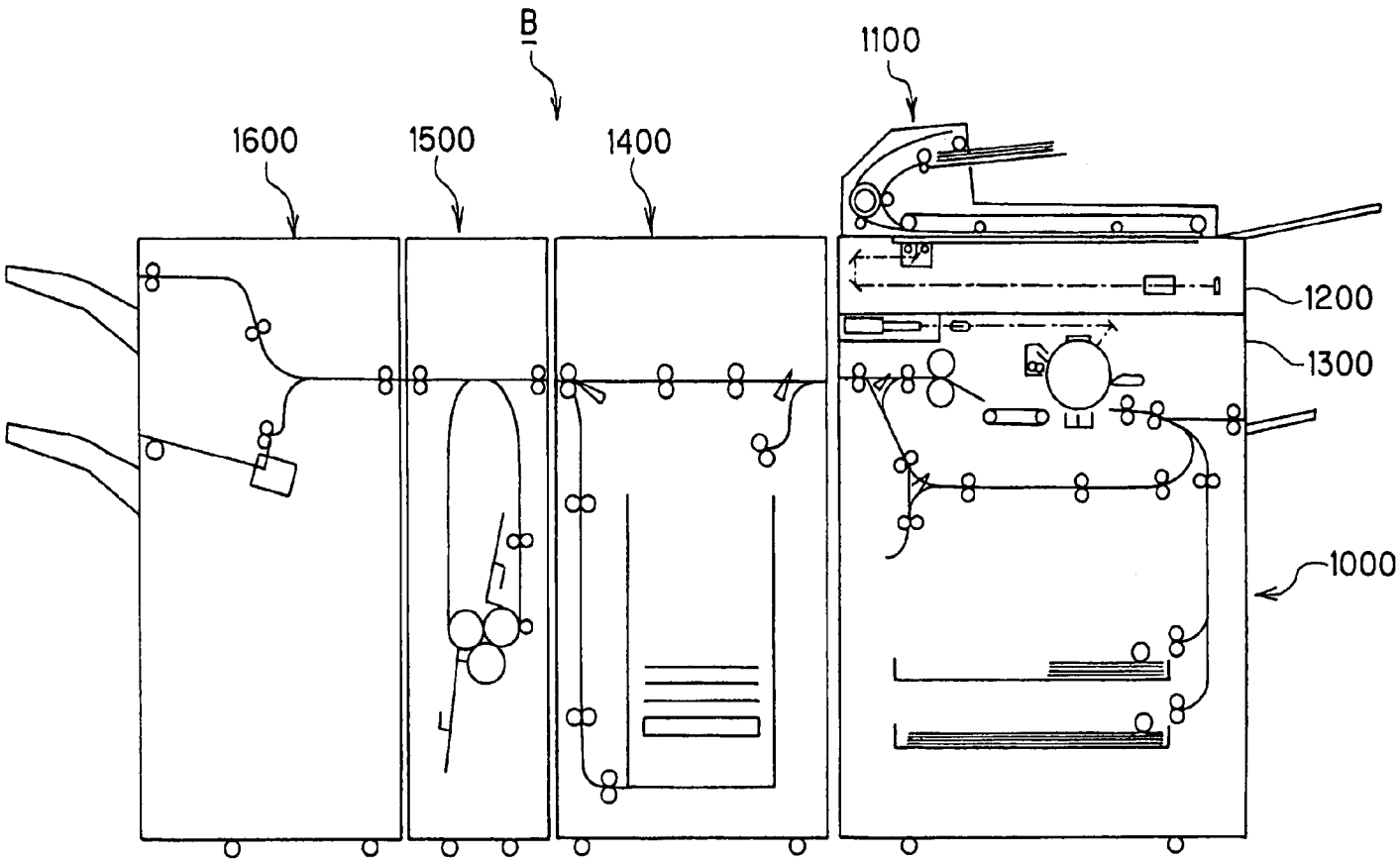
FIG. 32 is a schematic construction diagram showing a construction of the sheet processing system of the related art.

FIG. 31 is a schematic construction diagram showing an internal construction of a sheet processing system according to a sixth embodiment of the invention.

The sheet processing system of this embodiment is provided with a plurality of sheet processing devices having individually different sheet processing functions. In this embodiment, the six sheet processing devices of the printer 300, the sheet stacker 500, two sets of inserter 600A and inserter 600B, the bookbinder 800 and the finisher 700 are sequentially connected in tandem.

In this sheet processing system, for example, there can be executed in parallel: the first job to be executed by combining all the sheet processing devices from the printer 300 to the finisher 700; the second job to be executed by combining the printer 300, the sheet stacker 500, the inserter 600A and the bookbinder 800; and the third job to be executed by combining the inserter 600A, the bookbinder 800, the inserter 600B and the finisher 700.

In this case, too, the second job and the third job are executing by interrupting the first job so that the plural jobs can be executed in parallel to improve the productivity of the sheet processing system.

Here, another job is arbitrarily executed by the combination of the sheet processing devices other than the aforementioned combination.

The remaining constructions are similar to those of the sheet processing system according to the aforementioned fourth embodiment, and their description is omitted.

The fourth to sixth embodiments thus far described are summarized, as follows.

(1) The sheet processing system is provided with: the plural sheet output devices (e.g., the printer 300, the inserter 600 and the sheet stacker 500) for outputting the sheets; the plural sheet post-processing devices (e.g., the finisher 700 and the bookbinder 800) for subjecting the sheets outputted from the sheet output devices, to the post-processing; and the controller for controlling the plural sheet output devices and the plural sheet post-processing devices. The controller combine either the sheet output device and the sheet output device, or the sheet output device and the sheet post-processing device to execute the job, and can share at least one of the plural sheet output devices and the plural sheet post-processing devices to execute the plural jobs in parallel.

As a result, it is possible to enhance the productivity of the sheet processing system.

(2) The controller executes, while one of the plural jobs is being executed, another job by interrupting the one job.

As a result, it is possible to execute the plural different jobs without awaiting the end of the preceding job.

(3) The sheet processing system is provided with the sheet conveyance path for conveying the sheets either from the sheet output device to the sheet output device, or from the sheet output device to the sheet post-processing device, and the controller executes the plural jobs in parallel by sharing at least one portion of the sheet conveyance path.

(4) The controller executes the plural jobs in parallel by using the sheet conveyance path alternately.

As a result, the sheets to be processed by the individual jobs are conveyed in the sheet conveyance path without being overlapped on each other.

(5) The sheet processing system is provided with: the first sheet processing module (e.g., the conveyance roller pairs 602, 603 and 604, and their drive source) to be used in one of the plural jobs; the second sheet processing module (e.g., the conveyance roller pairs 640 and 641, and their drive source) to be used in another job in parallel with that one job; the first cover member (e.g., the cover 651) for covering the first sheet processing module; the second cover member (e.g., the cover 652) for covering the second sheet processing module; and the sensors for detecting the opened/closed states of the individual cover members. The controller controls the stops of the first sheet processing module and the second sheet processing module independently of each other on the basis of the signals coming from the sensors.

Even if the cover of any one of the sheet processing modules is opened for the reasons of the jam-clearing, parts-replacing, cleaning, adjusting, sheet supplying operation or the like while the plural jobs are being executed in parallel, the stop of the drive occurs only at the sheet processing module which needs the maintenance, and the other job can be continued.

(6) The sheet output device is any of the image forming apparatus (10) for forming the images on the sheets and outputting the sheets, the inserter device (e.g., the inserter 600) for outputting the sheets without forming the images, the buffer device (e.g., the sheet stacker 500) for re-outputting the outputted sheets after the temporary standby, and the sheet feeding device (e.g., the cassettes 114 and 115) for feeding the sheets to the other sheet processing devices.

(7) The post-processing device is any of the punching device (e.g., the finisher 700) for punching the sheets, the stapling device (e.g., the finisher 700) for stapling the sheets, the storing device (e.g., the bookbinder 800) for storing the sheets, the aligning device (e.g., the finisher 700) for aligning the sheets, the folding device (e.g., the bookbinder 800) for folding the sheets, and the bookbinding device (e.g., the bookbinder 800) for bookbinding the sheets.

This application claims priority from Japanese Patent Application Nos. 2003-356733 and 2003-356734 filed on Oct. 16, 2003, which are hereby incorporated by reference herein.

What is claimed is:

1. A sheet processing system comprising:

a sheet output device which outputs a sheet, the sheet output device includes a first conveying path in which a sheet is conveyed from upstream in a sheet conveyance direction of the sheet output device to downstream, and an output path, different from the first conveying path, in which a sheet is outputted to an adjoining device of the sheet output device; and a sheet post-processing device which applies post-processing to the sheet, the sheet post-processing device includes a second conveying path in which a sheet is conveyed from upstream in the sheet conveyance direction of the sheet post-processing device to downstream, and a receiving path, different from the second conveying path, in which a sheet is received from an adjoining device of the sheet post-processing device, wherein, when the sheet output device and the sheet post-processing device are juxtaposed to each other, a primary sheet conveyance path is formed by connecting the first conveying path and the second conveying path, and a secondary sheet conveyance path is formed by connecting the output path and the receiving path.

2. A sheet processing system according to claim 1, wherein when a plurality of the sheet output devices and a plurality of the sheet post-processing devices are connected, the primary sheet conveyance path provides communication from the sheet output device arranged most upstream in the sheet conveyance direction to the sheet post-processing device arranged most downstream.

3. A sheet processing system according to claim 2, further comprising:

a controller which controls the sheet output device and the sheet post-processing sing device, wherein said controller uses the primary sheet conveyance path to execute one job by one combination of sheet output device and sheet post-processing device and uses the secondary sheet conveyance path to execute another job by another combination of sheet output device and sheet post-processing device in parallel with said one job.

4. A sheet processing system according to claim 3, further comprising:

a first cover member which covers a first sheet processing module, the first sheet processing module having a sheet processing function to execute said one job, provided on the sheet post-processing device used in said one job;

a second cover member which covers a second sheet processing module, said second sheet processing module having a sheet processing function to execute the another job, provided on the sheet post-processing device used in said another one job; and sensors which individually detect the opened/closed states of the cover members, wherein the controller controls the stops of the first sheet processing module and the second sheet processing module independently of each other on the basis of the signals of the sensors.

5. A sheet processing system according to claim 1, wherein the sheet output device is any one of an image forming apparatus which forms an image on a sheet and outputting the sheet, an inserter device which outputs a sheet without forming any image, a buffer device which re-outputs an outputted sheet after a temporary standby, and a sheet feeding device which feeds a sheet to another device.

6. A sheet processing system according to claim 1, wherein said post-processing device is any one of a punching device which punches a sheet a stapling device which staples sheets, a storing device which stores a sheet a aligning device which aligns sheets, a folding device which folds a sheet and a bookbinding device which bookbinds sheets.

* * * * *